US006561931B1

(12) United States Patent
Reeves

(10) Patent No.: US 6,561,931 B1
(45) **Date of Patent: *May 13, 2003**

(54) JOINT FOR FACILITATING FABRICATION OF COLLAPSIBLE ASSEMBLIES

(76) Inventor: Francis J. Reeves, 357 Council Oak Dr., Severn, MD (US) 21144

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/958,346

(22) Filed: Oct. 27, 1997

Related U.S. Application Data

(63) Continuation-in-part of application No. 08/288,309, filed on Aug. 10, 1994, now Pat. No. 5,681,231.

(51) Int. Cl.[7] ..... A63B 63/00
(52) U.S. Cl. ..... 473/471; 403/99; 403/102
(58) Field of Search ..... 473/197, 462, 473/471, 476, 477, 478; 403/101, 102, 100, 99, 84, 113, 116, 117

(56) References Cited

U.S. PATENT DOCUMENTS 3,642,282 A * 2/1972 Frischman ..... 135/139
3,698,715 A * 10/1972 Browning et al.
3,979,120 A * 9/1976 Dietrich ..... 473/478
4,493,344 A 1/1985 Mathison et al. ..... 138/89
5,080,375 A * 1/1992 Moosavi
5,195,839 A * 3/1993 Wicklund et al. ..... 403/12
5,566,952 A * 10/1996 Mullin et al. ..... 273/400
5,590,674 A * 1/1997 Eppenbach ..... 473/125
5,628,336 A * 5/1997 Lee ..... 135/127
5,695,195 A * 12/1997 John et al. ..... 473/478
5,830,089 A * 11/1998 Halter et al. ..... 473/478
5,839,733 A * 11/1998 Meeks et al. ..... 273/400
5,842,939 A * 12/1998 Pui et al. ..... 473/478

* cited by examiner

*Primary Examiner*—William M. Pierce
(74) *Attorney, Agent, or Firm*—Foley & Lardner

(57) ABSTRACT

A link which facilitates forming a collapsible structure which has a shell at least one attachable portion and at least one socket portion. The socket portion has a flexible, preferably twistable, member which connects to a frame member. The frame member moves into and out of the socket portion of the shell to erect and collapse the structure. The walls of the socket portion may be formed a constant distance apart for at least a portion of the circumference of the shell to permit fabricating the shell from non-resilient material. Caps, detents and protrusions can be used to secure the member to the shell in the erect position by positioning the socket and attachable portions at desired angular relationships and placing the socket portions at any desired position in the circumference of the shell, virtually any collapsible structure can be configured.

35 Claims, 41 Drawing Sheets

JOINT FOR FACILITATING FABRICATION OF COLLAPSIBLE ASSEMBLIES

RELATED APPLICATIONS

This is a Continuation-in-Part of application Ser. No. 08/288,309 now filed on Aug. 10, 1994 which will issue on Oct. 28, 1997.

BACKGROUND OF THE INVENTION

Many games, such as soccer, hockey and lacrosse, require a goal incorporating a net such that a participant scores by causing a ball, puck or other projectile to enter the goal. Goals for these games are large and not easily transportable. When such goals are put in a specific location, they tend to remain in that location on a substantially permanent basis. It is therefore inconvenient for one to use the same goal to support games occurring at different times and at different locations.

The lack of mobility of these goals is a function of their size and the fact that they cannot be collapsed, folded or disassembled.

Similar difficulties occur with other devices and assemblies where transportability is desirable, but the requirements of physical size and strength prevent such assemblies from being collapsed.

SUMMARY OF THE INVENTION

It is therefore an object of this invention to provide an assembly such as a game goal which is easily collapsible.

It is another object of the invention to provide a link for joining members of such an assembly.

It is a still further object of this invention to provide a goal or other assembly where a portion of a net is incorporated into the frame such that the net remains attached to the frame when the assembly is collapsed.

It is another object of the invention to provide for easy removal and replacement of such a net.

In one embodiment of a goal according to the invention, for example, a goal used for the game of lacrosse, the goal includes a net, a crossbar, at least two uprights, and joints provided between the uprights and the crossbar. The uprights and the crossbar also have net receiving means which receive and hold a portion of the net such that the net is attached to the crossbar and the uprights. This embodiment of the invention may also include means for attaching the bottom portion of the net to the ground.

Alternatively, in another embodiment of a goal according to the invention, the frame further includes lower frame members which lie upon the ground. Like the uprights and the crossbar, these lower frame members also contain net receiving means. These lower frame members, in an embodiment of the invention designed for lacrosse, are connected to each other by a joint forming a point with the lower frame members.

In yet another embodiment according to the invention, the uprights and crossbar (and lower frame members, if used) contain grooves within which the hem of the net is positioned such that these grooves provide the net receiving means.

In still another embodiment of a goal according to the invention, the net does not have a hem, but is configured such that each outer strand of the net ends with a terminating point which can be inserted into a corresponding hole in the crossbar, uprights, or lower frame members, which forms the net receiving means.

In another embodiment of a goal according to the invention the hem of the net is attached to the uprights by a plurality of U-shaped terminating points. In still another embodiment of the invention, joints, for example, where the uprights intersect with the crossbar and/or the lower frame members include an elbow having a gapped arm and an ungapped arm. The ungapped arm is fixed to one of the two intersecting members. The other of the intersecting members is proximate to the gapped arm, such that this intersecting member can be placed in a fixed position inside the gapped arm or a collapsed position substantially outside the gapped arm. The two frame members are connected by a flexible material, such as a piece of rubber hose. According to the invention, this embodiment may also include a cap which engages the gapped arm to provide added support when the joint is in the fixed position. The cap may also include a tooth which is fit into a corresponding notch in the gapped arm when the joint is in the fixed position. This embodiment may also employ a clamp connecting the ungapped arm to its frame member.

In yet another embodiment of a goal according to the invention, one or more joints can also be provided in the crossbar. Similarly, joints can be provided in any of the substantially straight members of the frame, such as within an upright or a lower frame member.

Another embodiment of a goal according to the invention provides a method of connecting two frame members of a collapsible game goal by connecting a first frame member to an ungapped arm of an elbow and also connecting the first frame member to one end of a flexible material, such as a rubber hose. The other end of the flexible material is connected to the second frame member, such that the second frame member can be placed inside a gapped arm of the elbow. According to this method, a cap can then be engaged with the gapped arm of the elbow.

Yet another embodiment of a goal according to the invention provides a method of installing a net inside the frame of the goal by cutting a groove into the frame members and placing the hem of the net inside of the groove.

A still further embodiment according to the invention provides for installing a net inside a goal by inserting a plurality of terminating points of the net into a corresponding plurality of holes contained in the frame members.

Yet another embodiment according to the invention provides a method of collapsing a game goal by disengaging a cap from a gapped arm of an elbow of at least one joint and pushing a frame member through a gap in the gapped arm.

Another embodiment of the invention includes a link or joint with a gapped portion and an ungapped portion. Links can be arranged in various configurations with the gapped portion facing in any desirable direction to facilitate assembly of collapsible structures.

BRIEF DESCRIPTION OF THE DRAWINGS

These and other embodiments of the invention will be apparent to one skilled in the art upon review of the drawings wherein.

DETAILED DESCRIPTION OF THE PREFERRED EMBODIMENTS

Figure 1:
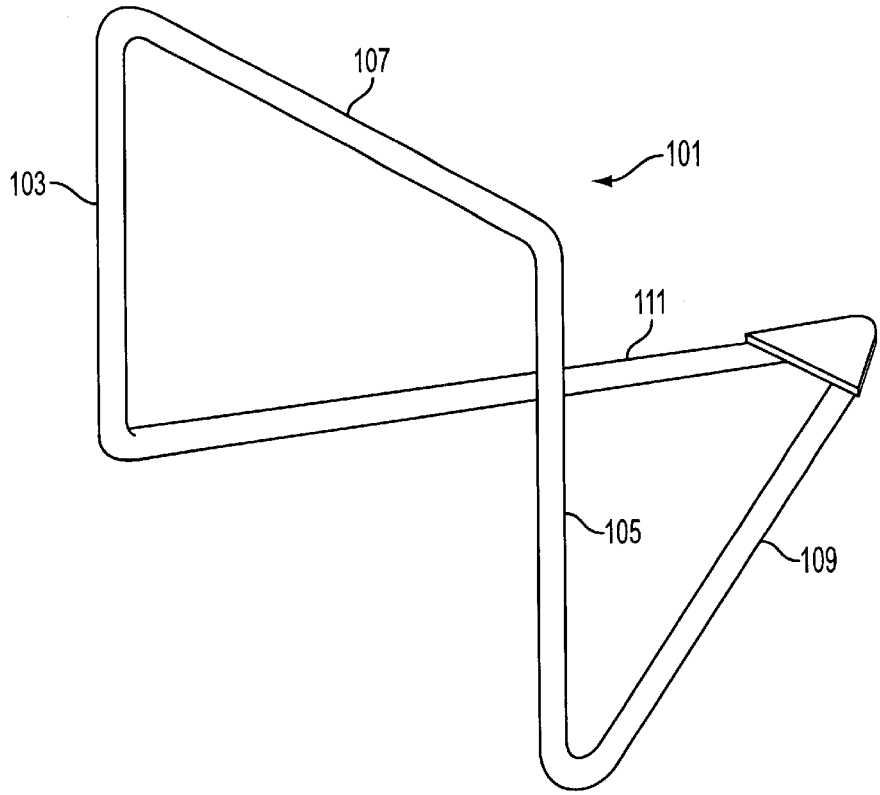
FIG. 1 is a view of the frame of a traditional lacrosse goal.

FIG. 1 displays a conventional lacrosse goal frame 101. Frame 101 includes left upright 103, right upright 105, crossbar 107, and lower frame members 109 and 111. The members of frame 101 are permanently attached to each other. For example, if frame 101 is constructed from metal pipe, the frame members can either be constructed from the same piece of pipe, or be separate pieces of pipe which are welded to each other or separate pieces of pipe which are threaded and screwed together.

Figure 2:
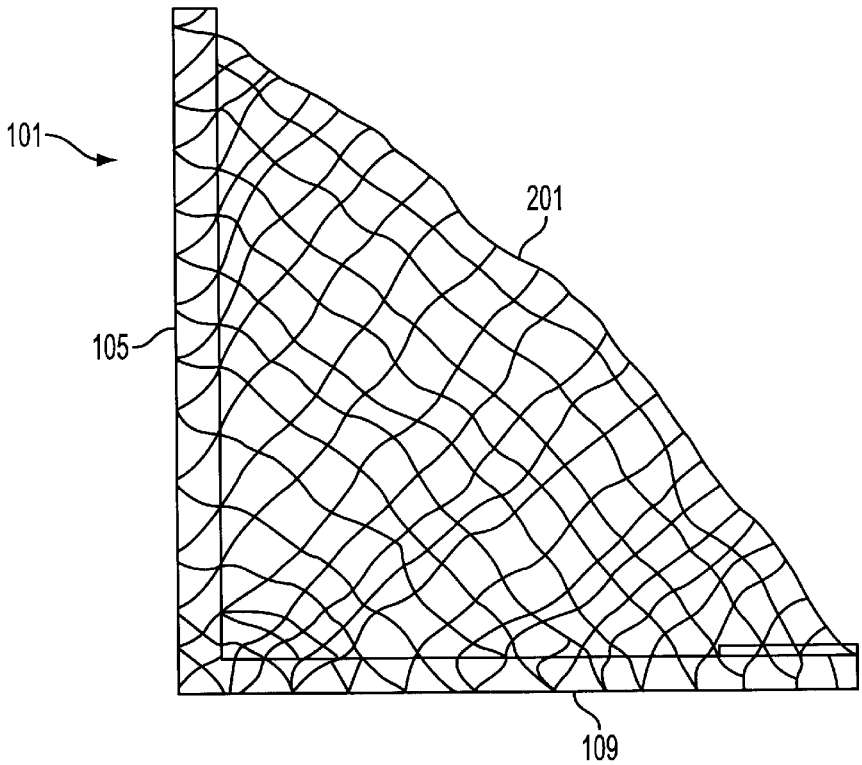
FIG. 2 is a side view of the frame of FIG. 1 with a net attached in a conventional manner.

FIG. 2 shows a side view of frame 101 with net 201 attached. Net 201 is strung around frame 101. The process of stringing a net to a lacrosse goal frame is very time consuming, requiring up to two man hours. Alternatively, conventional nets can be attached to a frame by plastic "ties" such as those conventionally used for harnessing wires or cables.

Figure 3:
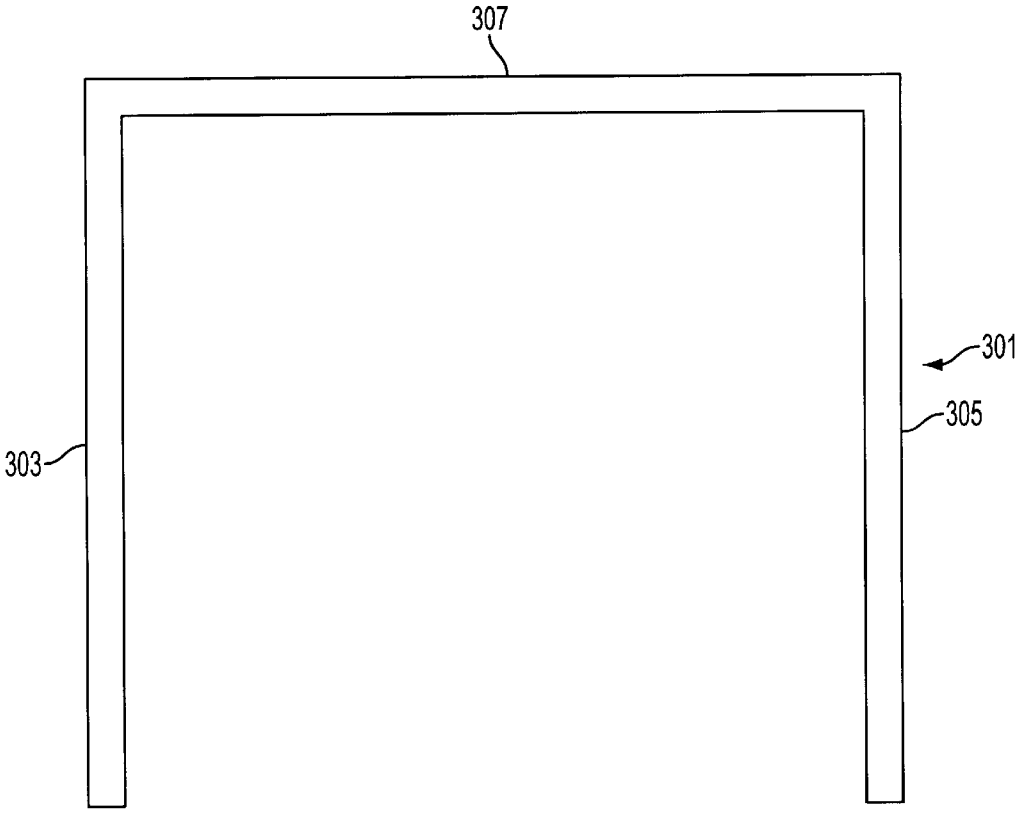
FIG. 3 is a view of an alternate embodiment of a conventional lacrosse goal.

FIG. 3 shows an alternative configuration of a lacrosse goal. Here, frame 301 includes left upright 303, right upright 305 and crossbar 307. Thus, frame 301 differs from frame 101 in that frame 301 does not have lower frame members analogous to frame members 109 and 111 shown in FIG. 1.

Figure 4:
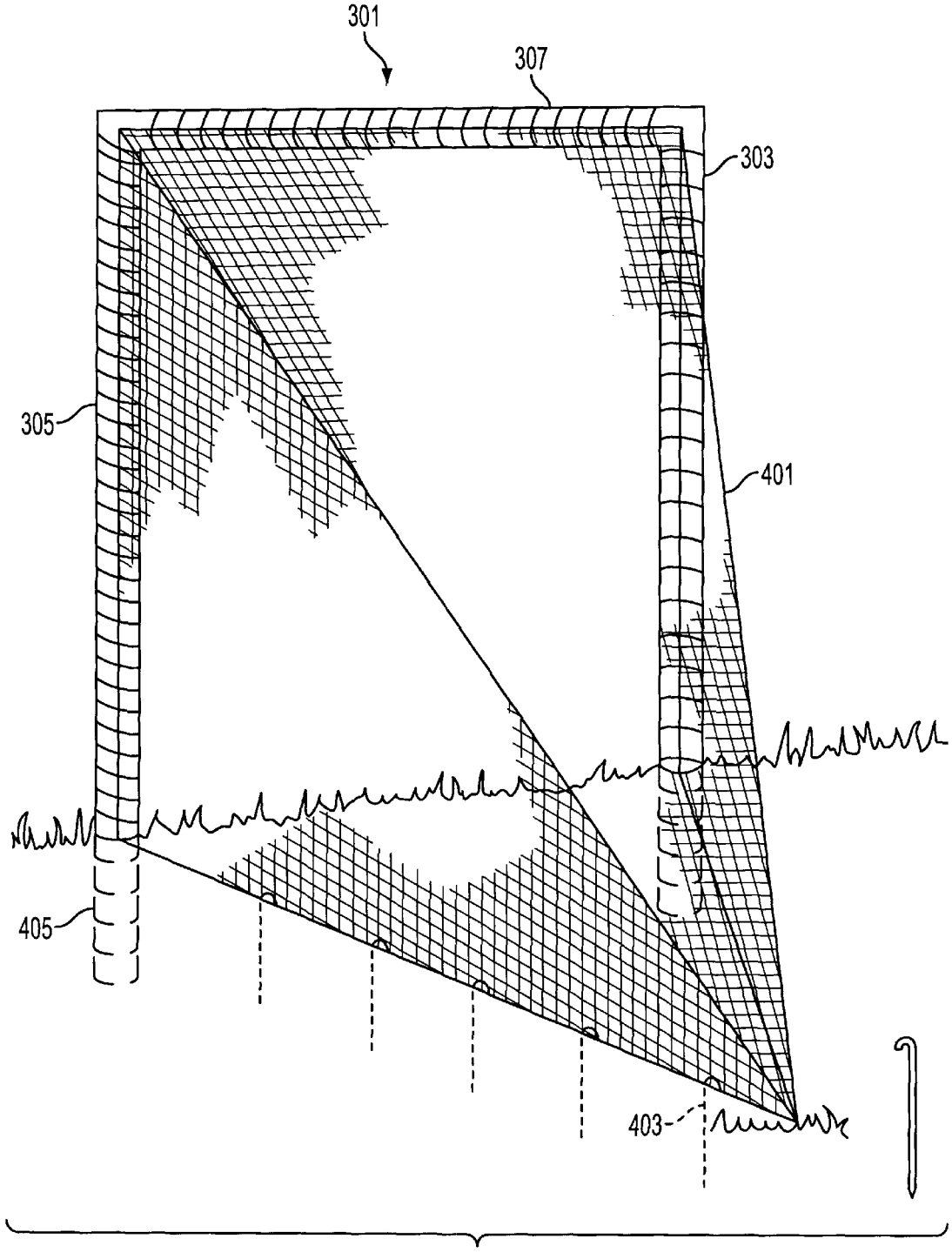
FIG. 4 provides a rear view of the goal of FIG. 3 with a net installed in the conventional manner.

FIG. 4 displays a rear view of frame 301 with net 401 attached. U-shaped spikes 403 connect net 401 to the ground. To hold the frame in place, uprights 303 and 305, which are typically made of hollow piping, could be fit over spikes 405 which are properly positioned in the ground. It can thus be seen that the configuration using frame 301 is not suitable for use on astro turf or other hard surfaces. Instead, frame 301 and net 401, as shown in FIG. 4, can only be used when the game is played on natural turf. As with the goal of FIG. 2, the net is strung around the frame in a time consuming manner, once this frame is put in place, it is very inconvenient to move it to another location.

It can therefore be seen that although the goals of FIGS. 2 and 4 are theoretically transportable, their transport to alternative locations is problematical. Further, if the net used in either of these goals breaks, as may result from a mishap during transport or from dry rot due to extended exposure to outside elements, replacement of the net is very inconvenient and time consuming.

The goal according to the invention provides a new configuration of goal which can be easily collapsed for transport. Thus, the net can be easily transported and can be brought inside when not in use. Moreover, in at least one embodiment of the goal according to the invention, the net can be replaced in a greatly reduced amount of time when compared to net replacement time of a conventional goal. This goal according to the invention incorporates collapsible joints into the frame, at, for example, the points of intersection of the frame members. These joints allow the goal to be easily collapsed and easily emplaced.

Figure 5:
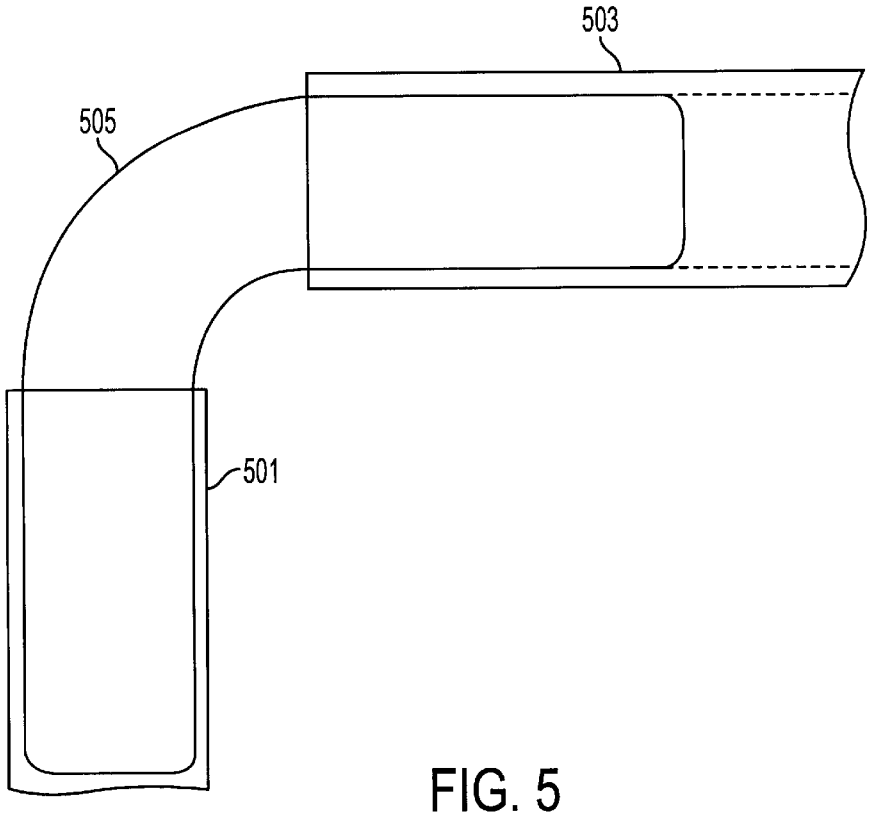
FIG. 5 shows the connection of two frame members with a flexible material such as a rubber hose forming a part of one embodiment according to the invention.

FIG. 5 shows two frame members 501 and 503 which intersect in a goal according to the invention. These frame members can be viewed as any two intersecting frame members, but for purposes of this discussion frame member 501 will be viewed as the left upright and frame member 503 will be viewed as the crossbar. In a conventional goal, as discussed above, these two members would be permanently attached. For example, if the frame is metal, they would either be part of the same piece of pipe, or would be welded or screwed together. In a conventional goal there is, thus, no freedom of movement between the two frame members.

At least a portion of the frame members in a goal according to the invention 501 and 503 can be hollow pipes composed of any type of material. For example, they can be constructed from aluminum, steel, copper or any other metal, or can be composed of synthetic materials, such as polyvinyl chloride. For example, frame members 501 and 503 can be constructed of one inch schedule 40 PVC piping.

According to the invention, a flexible member, such as hose 505, is inserted into frame members 501 and 503 and secured in place. It is preferable that hose 505 be constructed of a strong flexible material, such as rubber, and be dimensioned such that its outer diameter is substantially equivalent to the inner diameter of frame members 501 and 503. Hose 505 can be attached to frame members 501 and 503 in any manner, such as by gluing. Hose 505 can also be a solid flexible member.

Alternatively, hose 505 can continue through the frame members such that it constitutes a closed member. In this case, hose 505 need not be glued to the frame members, as the structural arrangement will keep the frame members and hose in the proper relative position.

Figure 6:
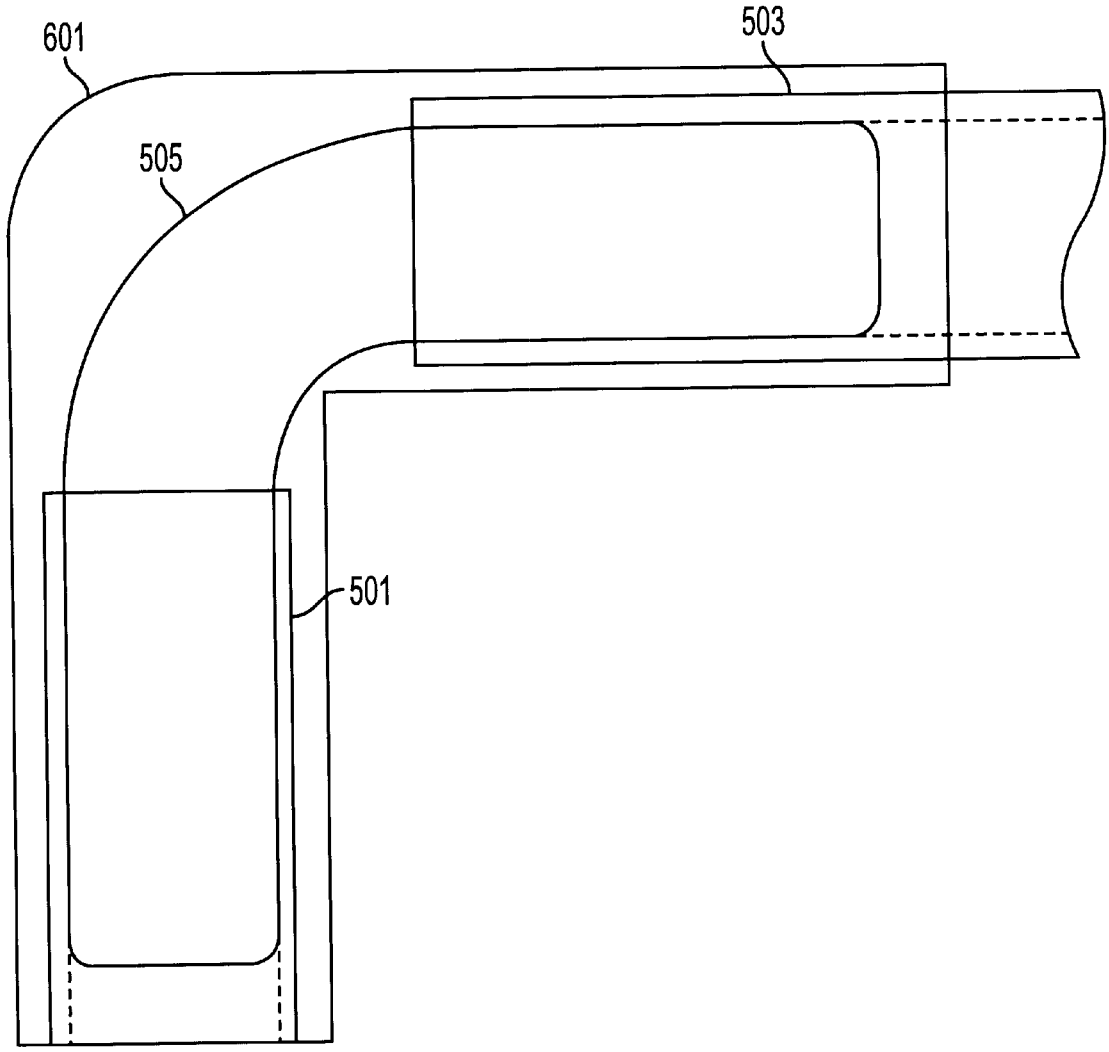
FIG. 6 shows the frame members and hose of FIG. 5 incorporated into an elbow consistent with one embodiment of the invention.

FIG. 6 shows the elements of FIG. 5 along with elbow 601. Elbow 601 is permanently attached to one of the two frame members 501 and 503. Like the frame members, elbow 601 can be constructed of any material. For example, where frame members 501 and 503 are made of PVC piping, elbow 601 can be a PVC joint. Although the frame members and elbow can be constructed of the same material, this is not a requirement of a goal according to the present invention. Thus, it is possible for elbow 601 to be constructed of material which differs from that used for frame members 501 and 503.

In the embodiment shown in FIG. 6, the inner dimension of elbow 601 is the same as the outer dimension of frame members 501 and 503. Thus, the outer dimension of elbow 601 is slightly larger than that of frame members 501 and 503. Alternatively, frame members 501 and 503 can have the same outer dimension as elbow 601 with a gradual or stepped taper such that the end of each frame member fits within elbow 601 and the combination of frame members 501, 503 and elbow 601 provide a smooth outer surface.

The means for permanently attaching elbow 601 to one of the two frame members 501 and 503 can be by any appropriate means, including gluing and/or clamping. Alternatively, elbow 601 and one of the frame members 501 and 503 can be constructed as a single element. For example, if made from PVC, a single piece combining elbow 601 and a frame member, e.g., frame member 503, can be injection molded.

Figure 7:
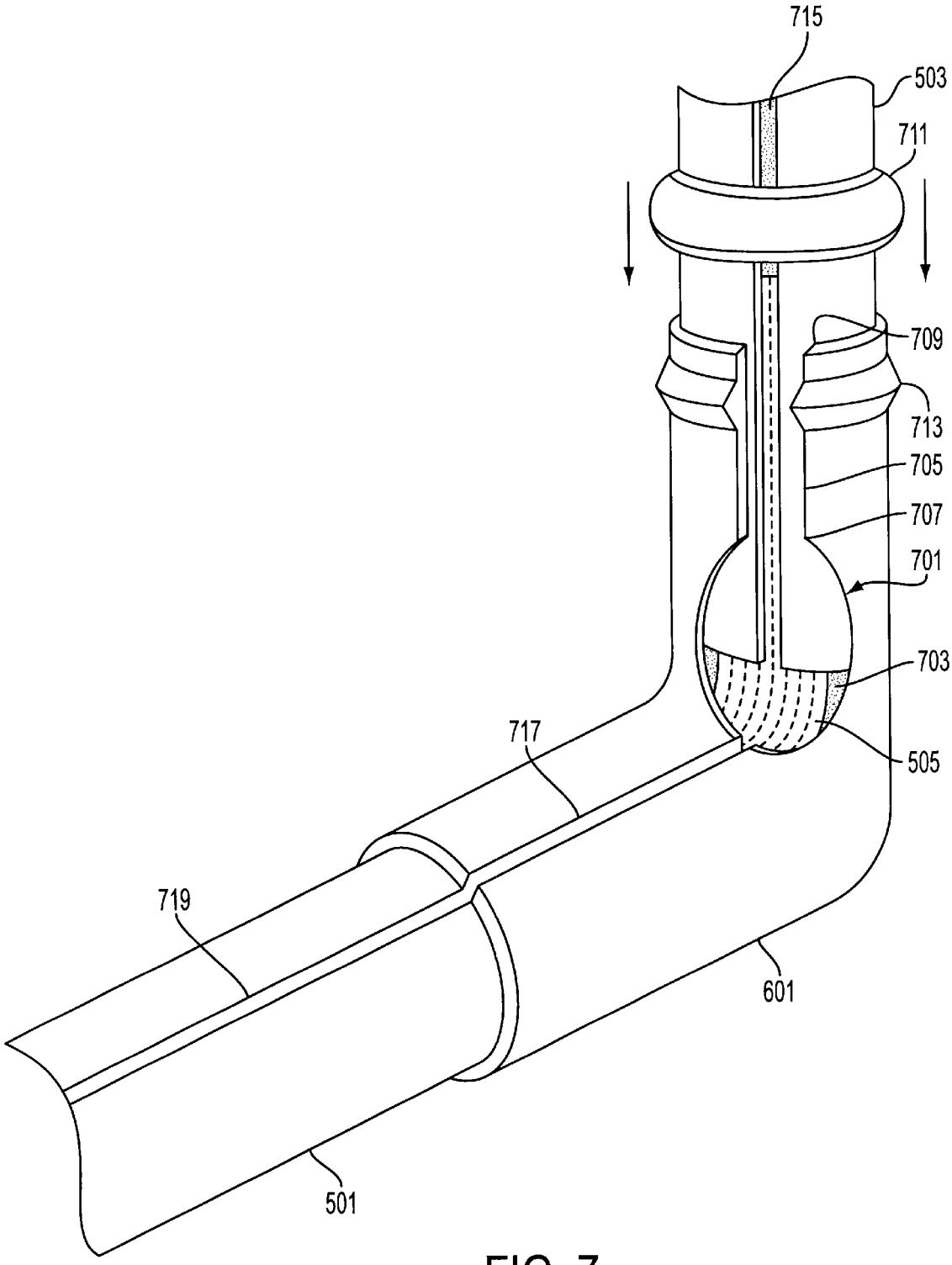
FIG. 7 shows a cap placed around one of the two frame members such that the cap can be engaged with the elbow according to one embodiment of the invention.

As can be seen in FIG. 7, and in accordance with this embodiment of the invention, elbow 601 contains a gap 701. Gap 701 provides freedom of movement of the frame member located in the arm of elbow 601 that contains gap 701. Thus, in the configuration shown in FIG. 7, frame member 501 is permanently attached to elbow 601. Frame member 503 remains attached to frame member 501 via hose 505.

In the collapsed position of the embodiment of FIG. 7, frame member 503 is bent into gap 701, such that frame member 503 is substantially parallel to frame member 501. Here, gap 701 is positioned such that frame member 503 bends directly toward frame member 501. Alternatively, the gap can be positioned such that frame member 503 can bend in any direction, but preferably within ±450 of the position shown in FIG. 7. Regardless of the direction which gap 701 allows frame member 503 to bend, hose 505 allows sufficient flexibility such that, when in the collapsed position, the frame members can rest in a substantially parallel position. The flexible connection of frame member 503 to frame member 501 via hose 505 allows sufficient freedom I of movement such that frame member 503 is not restricted by the portion of elbow 601 opposite the gap as frame member 503 moves into gap 701. In the upright position, frame member 503 is snapped into elbow 601 through gap 701, thereby assuming a substantially fixed position. Thus, it can be seen that if all the joints of a game goal are constructed in this manner, the frame can be easily collapsed for transport and then easily emplaced when use of the goal is desired.

The amount of force necessary to move frame member into and out of gap 701 is a function of the materials used for elements 503 and 601 and is also a function of the size and shape of gap 701. In one example, gap 701 has a substantially circular portion 703 which is approximately 1 inch in diameter such that it matches the outer dimension of frame member 503, and a straight or slightly tapered portion 705 which is, for example, approximately ¾ inch wide between points 707 and 709 in the embodiment disclosed in FIG. 7. An alternate version employs a taper which is ¾ inches wide at point 707 and ½ inch wide at point 709. This configuration, which is constructed of PVC, provides relatively easy movement of frame member 503 into and out of gap 701. This configuration would therefore be suitable for use in a light duty or children's model of a goal according to the present invention. Heavier duty versions can be made of stronger materials, such that there is less "spring" provided by gap 701 or can have a more narrow or more greatly tapered portion 705.

To add to the strength of the joints when the goal is emplaced, a cap 711 can also be employed. As shown in FIG. 7, cap 711 can be slid onto elbow 601 to snap over ridge 713. When collapsing of the joint is desired, cap 711 can then be slid such that it unsnaps from ridge 713. Thus, in the embodiment shown in FIG. 7, cap 711 slides down to engage with elbow 601 and slides up to disengage from elbow 601.

In one example, cap 711 is constructed from a hollowed-out plastic bottle top. However, as should be clear to one skilled in the art, this cap can be made of any material and may or may not match the materials used for frame members 501 and 503 and elbow 601. Also, cap 711 can be built into frame member 503, such that cap 711 slides within a tapered portion of frame member 503, wherein the combination of frame member 503, elbow 601 and cap 711 present a substantially uniform exterior appearance.

In FIG. 7, frame member 503 has groove 715 running along its length. Groove 715 is used in an embodiment of a goal according to the invention in which the hem of the net for the goal is installed inside the frame members. Similar grooves 719 and 717 are contained in frame member 501 and elbow 601. The existence of groove 715, and its dimension, also provide "spring" to frame member 503 which is a factor in determining the amount of force necessary to move frame member 503 into and out of gap 701 of elbow 601.

As shown, groove 717 is centrally located in elbow 601, aligning with groove 719 and groove 715. Alternatively, groove 719 can be positioned such that it contacts any portion of gap 701. Also, grooves 719 and 715 are shown as substantially straight grooves extending the length of their respective frame members, one should understand that these grooves need not be substantially straight, and can therefore rotate, preferably no more than 900 in either direction, around their respective frame members. This will allow a given frame member to have joints at both ends, wherein the joints need not be in exact alignment along the frame member. Of course, the given application to which the joints described herein are applied will likely dictate the optimum placement of the joints, and hence the positioning of the grooves within the frame members.

Figure 8A:
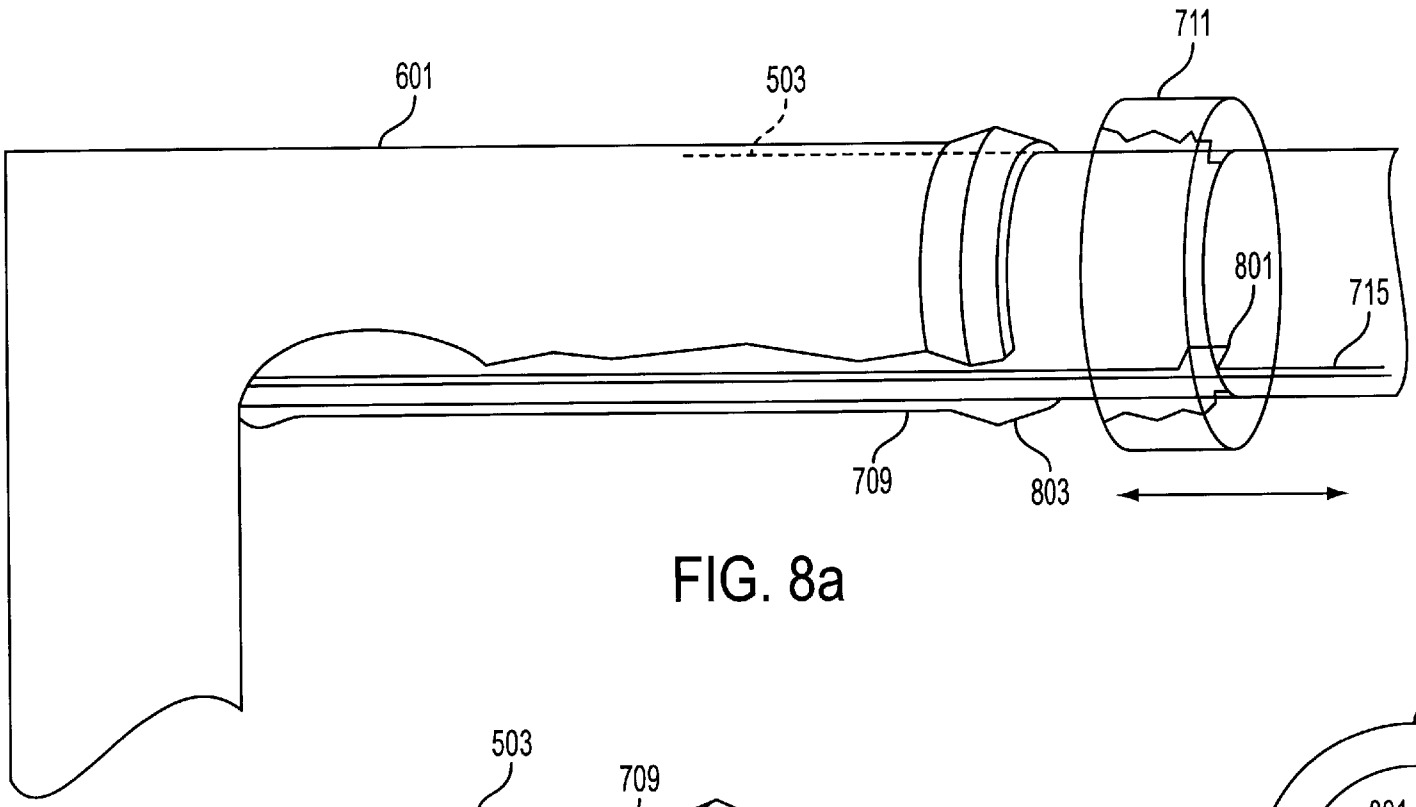
FIGS. 8*a*–8*c* show the cap of FIG. 7 further incorporating a tooth which aligns with a notch in the elbow in accordance with one embodiment of the invention.
Figure 8C:
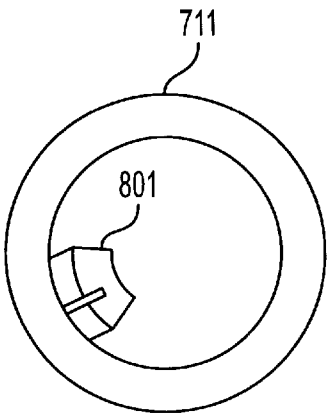
Figure 8B:
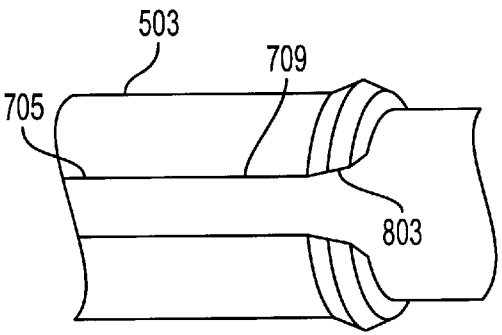

FIGS. 8*a*–8*c* show an alternative to the joint shown in FIG. 7. In FIGS. 8*a*–8*c* cap 711 includes tooth 801 which is dimensioned to fit in notch 803 in elbow 601. This configuration provides for additional strength of the joint when the goal is emplaced.

Figure 9:
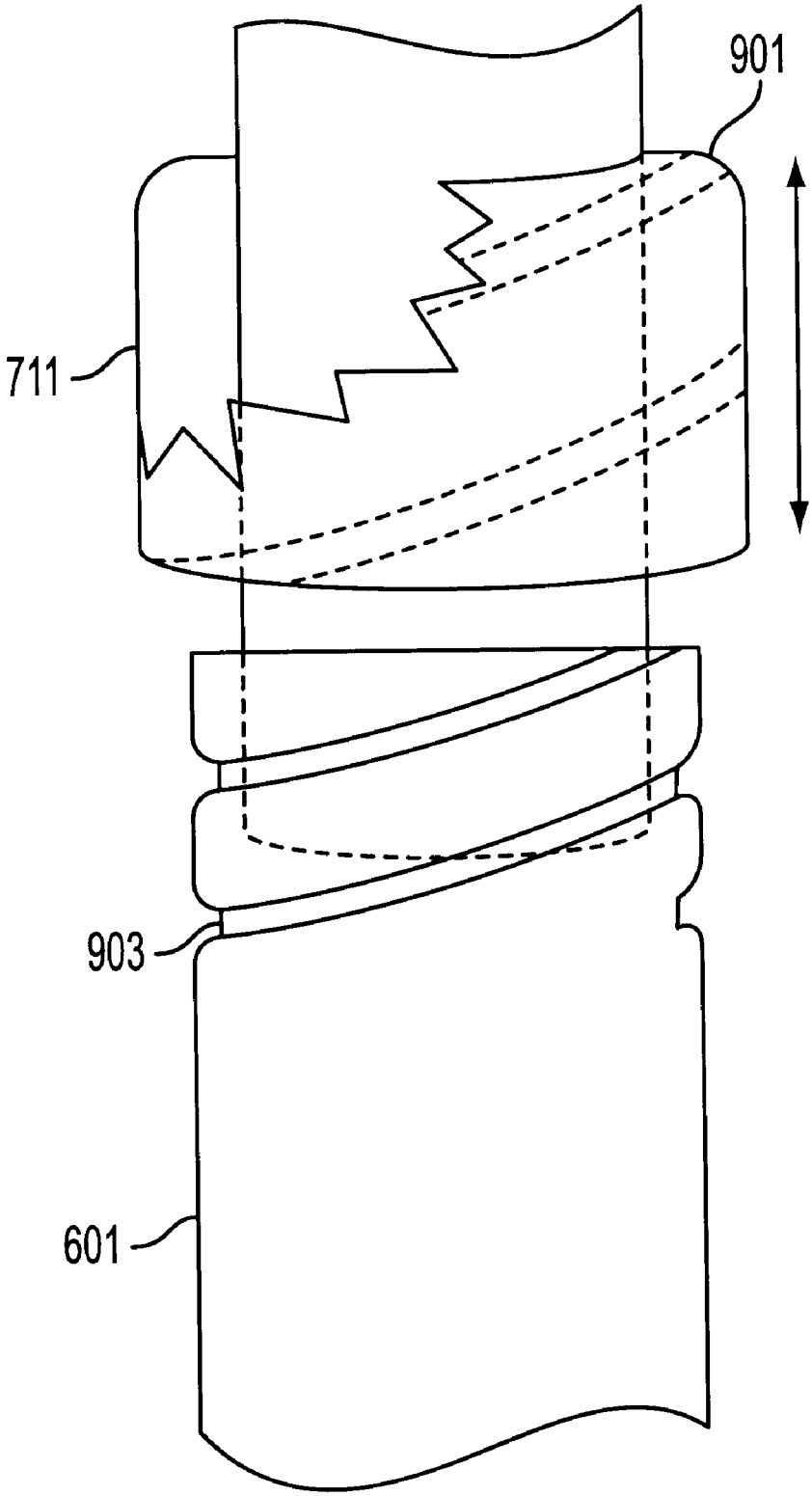
FIG. 9 displays an alternative method according to the invention for engaging the cap with the elbow.

FIG. 9 illustrates an alternative wherein cap 711 has threads 901 which engage corresponding threads 903 of elbow 601 when the cap is engaged with the elbow. Thus, cap 711 can be screwed onto and screwed off of elbow 601. Other methods of attaching cap 711 to elbow 601 are possible in a goal according to the invention. For example, cap 711 can be snapped onto elbow 601 but be configured in a manner wherein it is screwed off of elbow 601.

Figure 10:
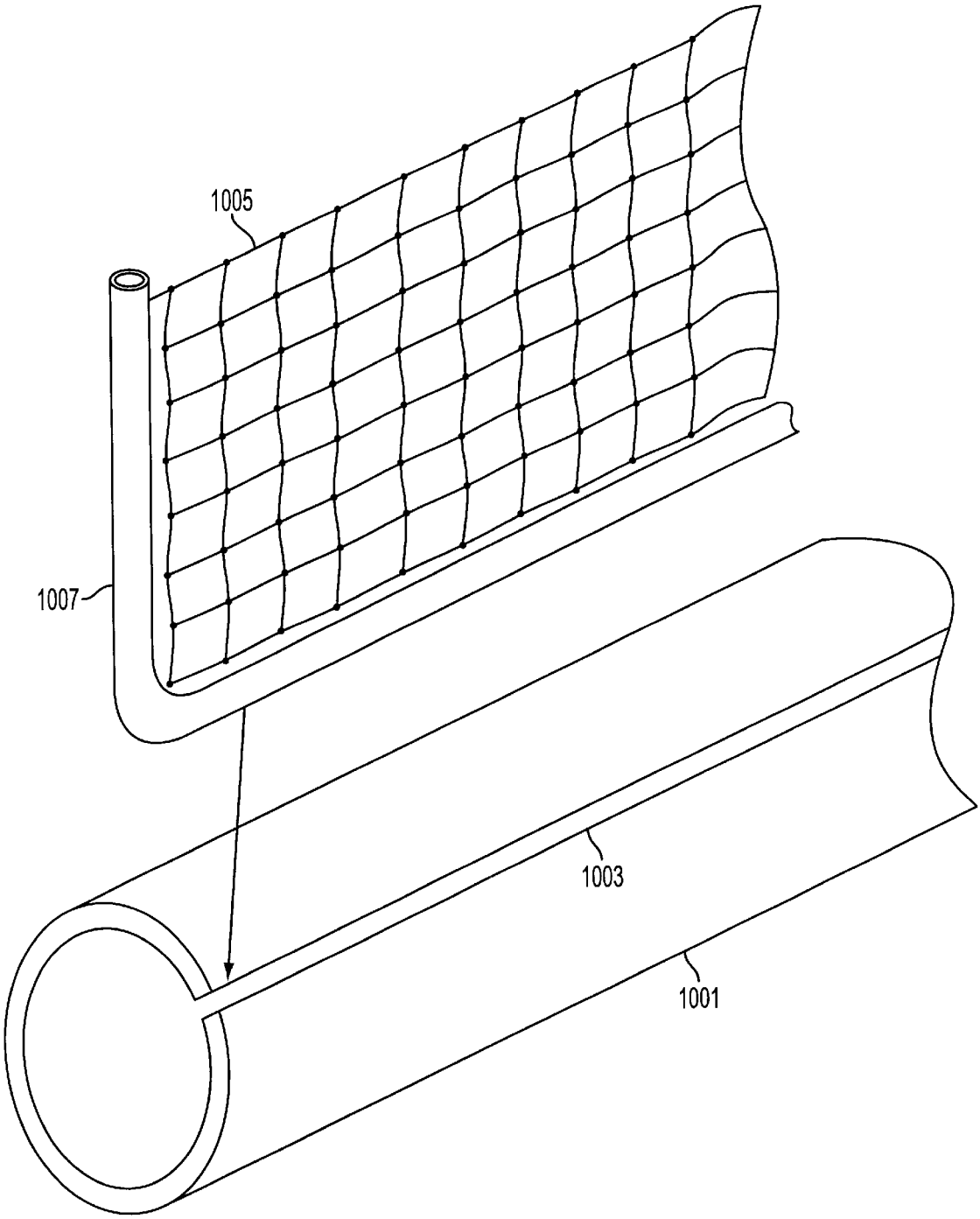
FIG. 10 shows portions of a frame member and a net wherein the hem of the net is placed inside the frame members through a groove in the frame member in accordance with one embodiment of the invention.

FIG. 10 shows a method according to the invention of incorporating the net into the frame. Frame member 1001 has a groove 1003 extending its entire length. Net 1005 has a hem 1007. In the preferred embodiment, groove 1003 is a break in the piping used for frame member 1001. The size of groove 1003 shown in FIG. 10 is for purposes of illustration and not limitation. Depending on the material used for frame member 1001, there will be an amount of spring tension, such that the groove can be expanded to allow for insertion of hem 1007. When the expanding force to overcome the spring tension is removed from groove 1003, the groove will return to its narrow dimension, retaining hem 1007 inside of frame member 1001. In one example previously discussed, groove 1003 is a length-wise cut in schedule 40 PVC pipe used for the frame members. The resulting pipe has sufficient spring tension to allow opening of groove 1003 by hand. The groove 1003 then snaps closed when the opening force is removed. Thus, the hem of the net is retained inside the frame member. The elbows, such as elbow 601, and the caps, such as cap 711, which are used at the joints, provide additional force to keep the grooves, such as groove 1003, in a substantially closed position around the hem, such as hem 1007.

Returning to FIG. 7, it can be seen that the groove 715, 717, 719 is contained in the frame members, such as frame members 501 and 503 and the elbows, such as elbow 601 for use with a goal according to this embodiment of the invention. However, as shown in FIG. 7, cap 711 does not contain such a groove. It would therefore not be possible to install the net into frame member 503 while cap 711 is around frame member 503. Similarly, it would not be possible to put cap 711 around frame member 503 while the net is contained in frame member 503.

One way to provide a cap is to construct a groove in cap 711 similar to groove 715 in frame member 503. However, a groove therein may reduce the strength providing attributes of cap 711. A preferable alternative is to construct cap 711 in a snap-cap fashion, similar to that used for rings to support shower curtains. The ability of the ends of the cap to snap together would enable cap 711 to be partially opened for placement around frame member 503 through one of the holes of the net. The cap is then snapped closed into a substantially rigid form which provides substantially the same amount of strength when snapped into place as an unbroken cap. The cap can be formed of a resilient material to include a hinge for opening. The cap can be closed by a snap, screw or other convenient means. Alternatively, cap 711 can be sewn into the net such that emplacing the net and putting the cap around frame member 503 can be accomplished at the same time.

Figure 11A:
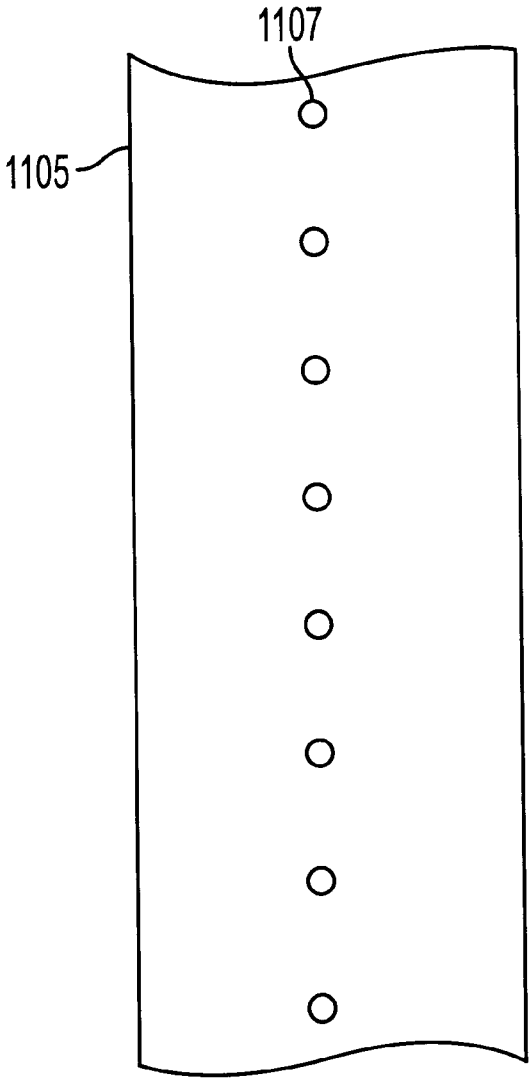
FIGS. 11*a*, 11*b* and 11*c* show alternative embodiments of the invention wherein the net is held in place by a plurality of terminating points which are inserted into a corresponding plurality of holes in the frame members.
Figure 11B:
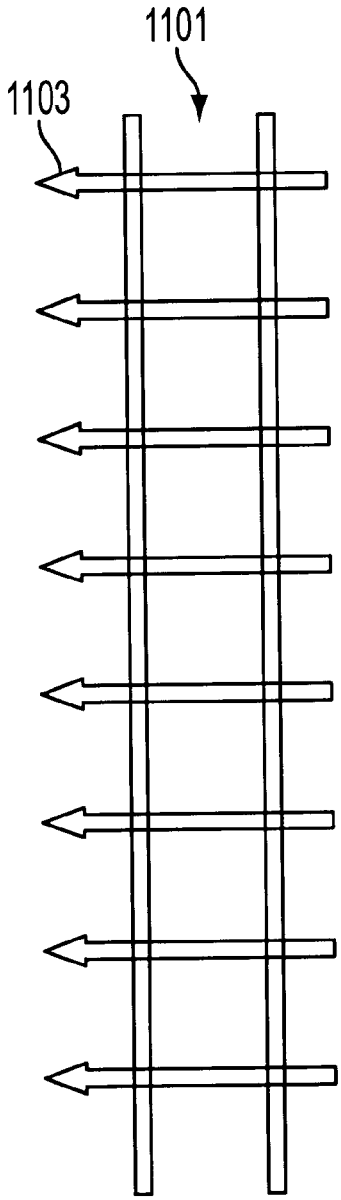

In the alternative embodiment shown in FIGS. 11*a* and 11*b* the net does not have a hem. The edges of net 1101 have a plurality of terminating points 1103. Similarly, frame member 1105 contains a plurality of holes 1107 corresponding to terminating points 1103. The terminating points are, e.g., resilient plastic arrowheads with tips and flared ends. The flared ends deform when pushed through the holes and when completely through assume their flared shape retaining the arrowhead and the net on the frame. The net 1101 is snapped into frame 1105 by inserting terminating points 1103 into their corresponding holes 1107. This configuration has the advantage of maintaining the structural integrity of the frame members but has a disadvantage of complicating the replacement of the net. Here, once net 1101 is installed into frame member 1105, the only way to remove net 1101 is to cut the net near frame 1105. This will cause terminating points 1103 to fall through hollow frame member 1105 and allow for the installation of another net by placing its terminating points 1103 into holes 1107. An advantage of this configuration is that it allows for the replacement of the net without the aforementioned concerns about cap 711. In addition, individual terminating points may be replaced, as needed.

Figure 11C:
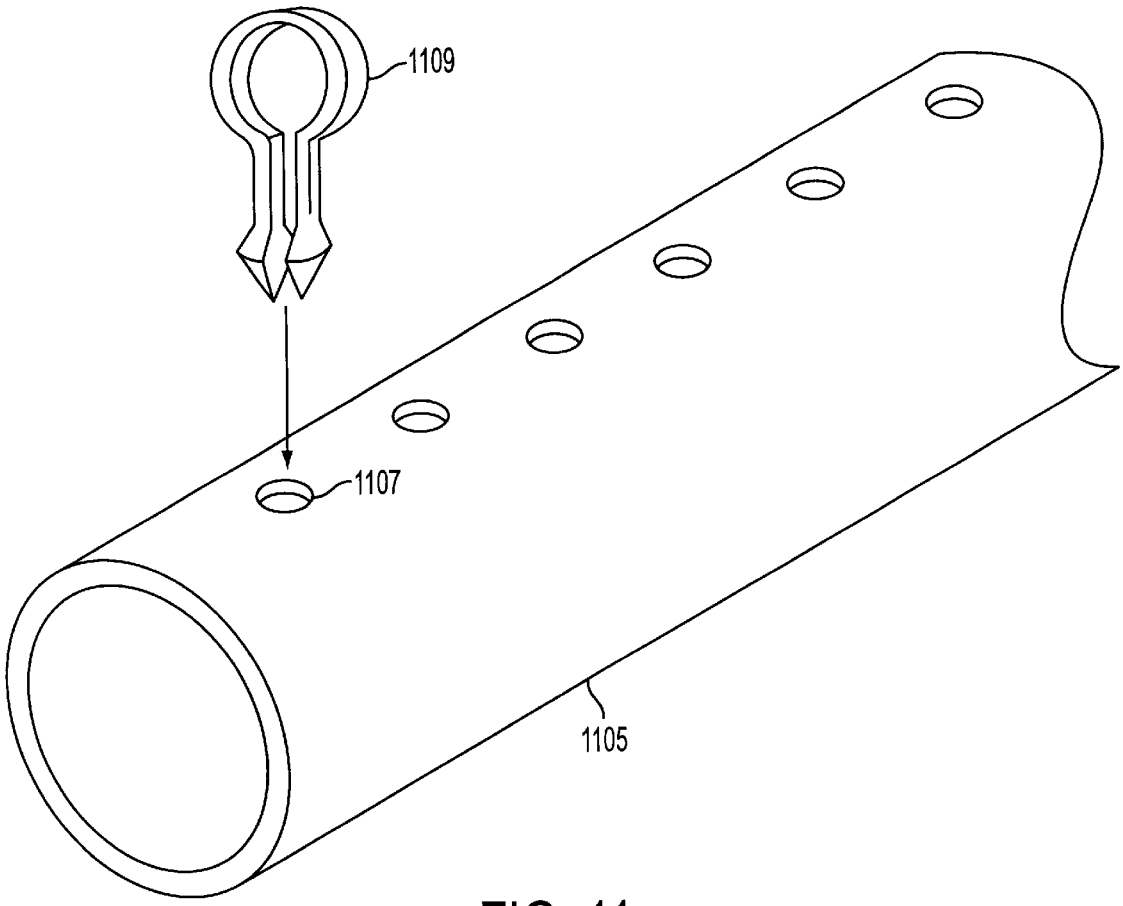

FIG. 11*c* shows another alternative similar to that of FIGS. 11*a* and 11*b*. Here, instead of flared terminating points being built into the net, as in FIG. 11*b*, U-shaped terminating points 1109 can be placed around a portion, for example, the hem, of a net and then snapped into holes 1107. This embodiment allows the advantages of the embodiment of FIGS. 11*a* and 11*b* without the disadvantage of constructing special nets. In addition, terminating points 1109 can be constructed of a resilient material such that they can be compressed for easy removal from the frame to facilitate replacement of the net.

Figure 12:
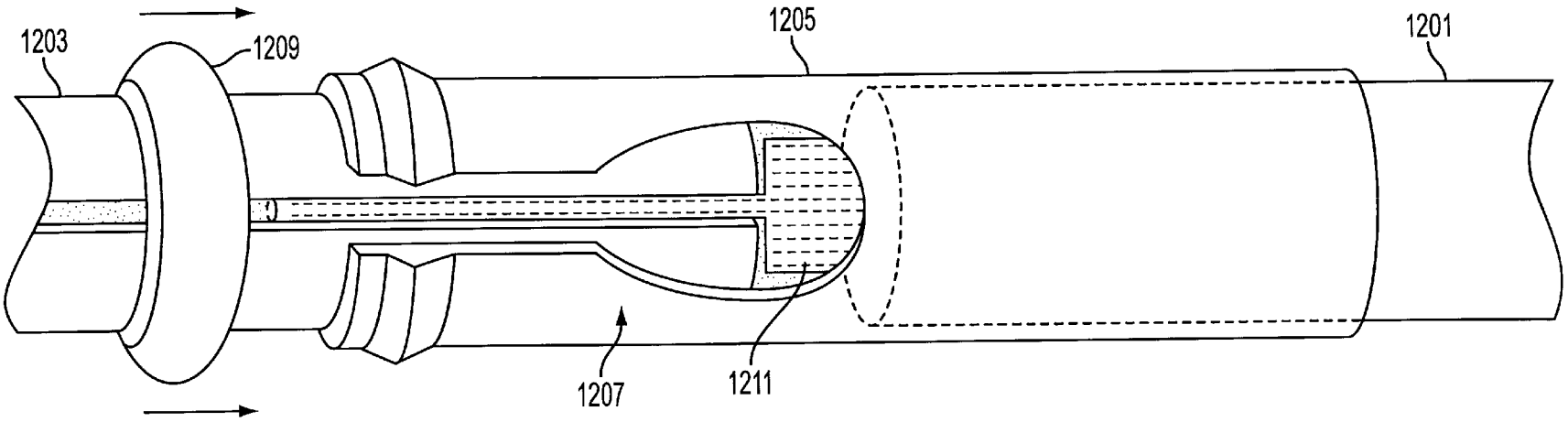
FIG. 12 displays an alterative embodiment of the invention incorporating a joint along a straight member, such as the crossbar.

FIG. 12 shows an alternative embodiment of the invention wherein a joint is incorporated into a substantially straight member, such as the crossbar of the goal. Frame members 1201 and 1203 are connected by arm 1205. As described above for orthogonally positioned frame members 501 and 503, frame members 1201 and 1203 are also connected by a flexible material such as rubber hose 1211. Arm 1205, in the embodiment shown, is permanently connected to frame member 1201 and has gap 1207 which allows frame member 1203 to bend from the position shown in FIG. 12 toward a position substantially parallel to frame member 1201. The dimensions of the frame members and the flexibility of hose 1211 determine the amount of displacement toward a parallel position actually achieved. Cap 1209 is alternatively provided to engage with arm 1205 if additional strength is needed. The configuration shown in FIG. 12, shows grooves in frame members 1201 and 1203 and arm 1205 to accommodate the hem of a net. It should be clear to one skilled in the art that this configuration applies to only one of the alternative embodiments of the present invention. Alternatively, for example, frame members 1201 and 1203 and arm 1205 could contain a plurality of holes to align with terminating points of the net.

FIG. 13 displays two alternative configurations of a joint at the point (point joint) of a lacrosse goal, in accordance with one embodiment of the invention. The point joint is at the intersection of the two lower frame members in the back of the goal. Such a joint is only used with goals which have lower frame members, such as the goal shown in FIG. 1, and not for goals shown in FIGS. 3 and 4.

Figure 13A:
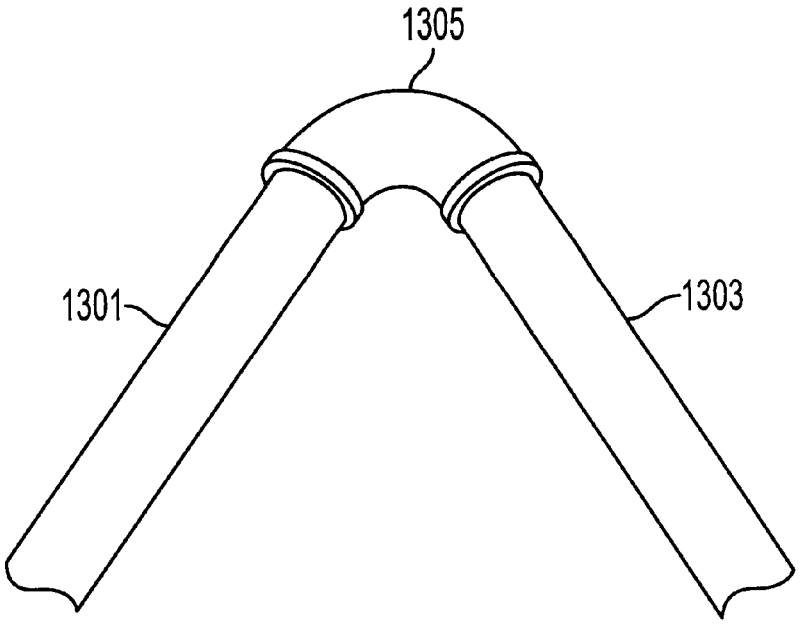
FIGS. 13*a* and 13*b* show alternative methods of constructing a point joint in one embodiment of the invention.

As can be seen from FIG. 1, the frame members meeting at the point joint both lie flat on the surface upon which the game is being played. Since there is significantly less need for structural rigidity at the point joints than there is for the other joints of the frame, the two lower frame members can be connected via any flexible means which keeps them connected but allows for relative freedom of movement. In the two examples of FIGS. 13*a* and 13*b*, lower frame members 1301 and 1303 are connected by rubber hoses in two configurations. In FIG. 13*a*, rubber hose 1305 is dimensioned such that its interior dimension matches the exterior dimension of frame members 1301 and 1303. In the configuration shown in FIG. 13*b*, rubber hose 1307 is dimensioned such that its outer dimension matches the inner dimension of frame members 1301 and 1303. In either embodiment, the hose is connected with the frame members in any conventional manner, including the use of adhesives, clamps and the like. Alternatively, in an embodiment wherein a single rubber hose runs through the entire length of all of the frame members, there is no need to glue the rubber hose to the joints and the rubber hose will serve as an inside point such as shown in FIG. 13*b*.

Figure 14:
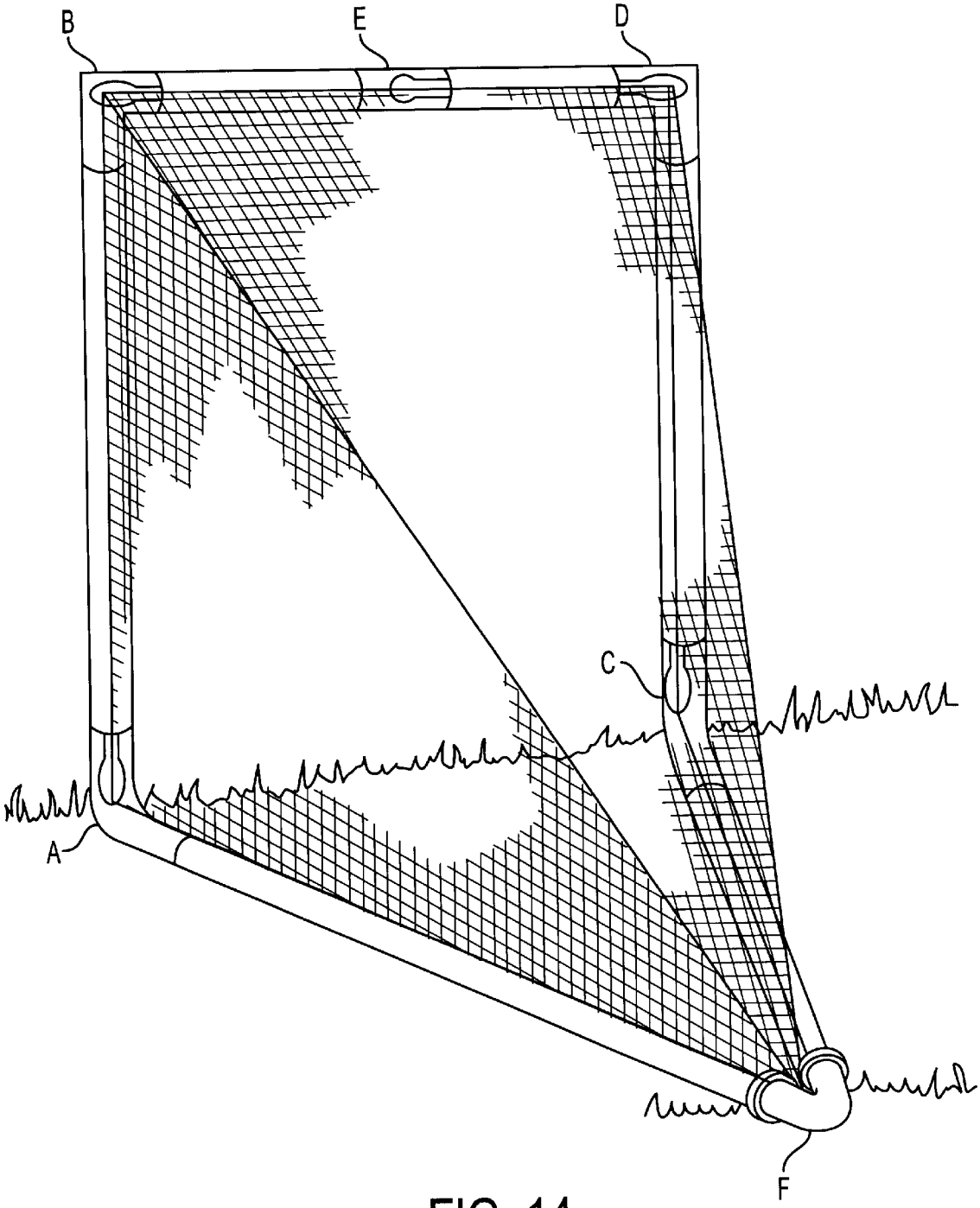
FIG. 14 shows the locations of the aforementioned joints in a preferred embodiment of the invention for a lacrosse goal.

Game goals, such as lacrosse goals, which require a substantially rigid frame for use in a game, can be configured according to the invention such that the goals are easily collapsible, and therefore easily transportable. In a preferred embodiment of the invention, joints such as that described in FIG. 7 exist at each of the two intersection points for each of the two uprights. Also, a joint such as that described in FIG. 12 is placed substantially in the center of the crossbar. The location, and configuration of these joints in the preferred embodiment are described in FIG. 14. FIG. 14 shows a goal having the same shape as the conventional lacrosse goal in FIG. 1 but also includes preferred locations for the joints described herein to construct a lacrosse goal according to the invention.

Figure 13B:
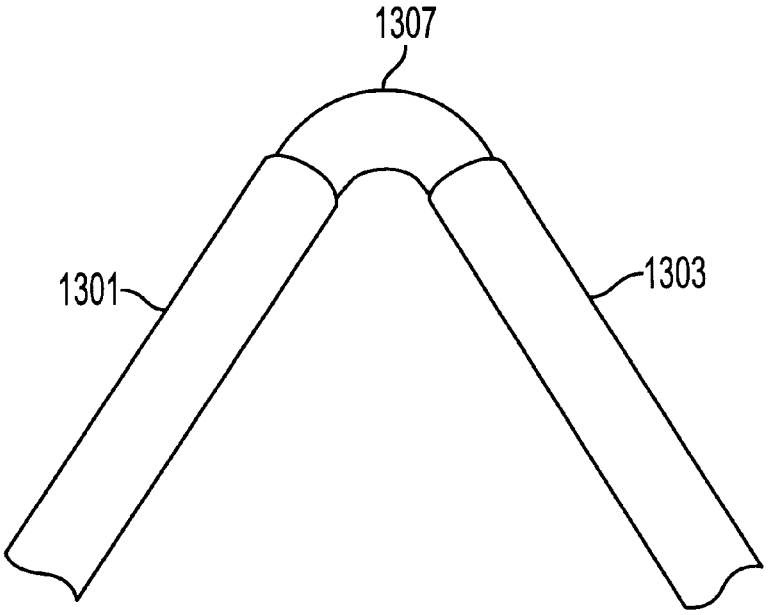

As described above, point joint F is the intersection of the two lower frame members and can preferably be configured either as, shown in FIG. 13*a* or as shown in FIG. 13*b*.

Joints A and C, which are the intersections of the lower frame members and the uprights, are preferably configured as shown in FIG. 7 with the fixed portion (that corresponding to frame member 501) constituting the lower frame member and the moveable portion (corresponding to frame member 503) constituting the uprights. When being collapsed, the uprights bend toward point joint F as can be seen by the fact that the gaps in the elbows of these joints face point joint F.

Joints B and D are the intersections of the uprights with the crossbar. Here, in the preferred embodiment, the uprights are the fixed members (corresponding to frame member 501 of FIG. 7) and the crossbar is the moveable member (corresponding to frame member 503). Thus, when collapsing, in the preferred embodiment, the crossbar bends in half such that its center points away from or in the opposite direction of point joint F. As is clear from this description, in this embodiment of a goal according to the invention the crossbar also has a joint which is part of the crossbar, allowing the crossbar to bend.

This crossbar joint is shown, preferably central to the crossbar, as point E of FIG. 14. This is a joint such as that shown in FIG. 12 wherein either side of the crossbar can be the fixed member with the other side serving at the moveable member. The crossbar will then, when collapsing, bend in half pointing away from point joint F.

It is therefore preferred, in the embodiment described above, that when collapsing the goal, joints A and C be broken first by pushing the uprights and crossbar back towards the point joint F. Then straight joint E is broken in half pointing away from point joint F. This then allows the corner joints B and D to swing back toward point joint F and to then be dislocated. As has been mentioned earlier, point joint F is substantially flexible. Thus, when joints A, B, C, and D are broken, the uprights, crossbar and ground members can be brought together into a substantially parallel position.

Figure 15:
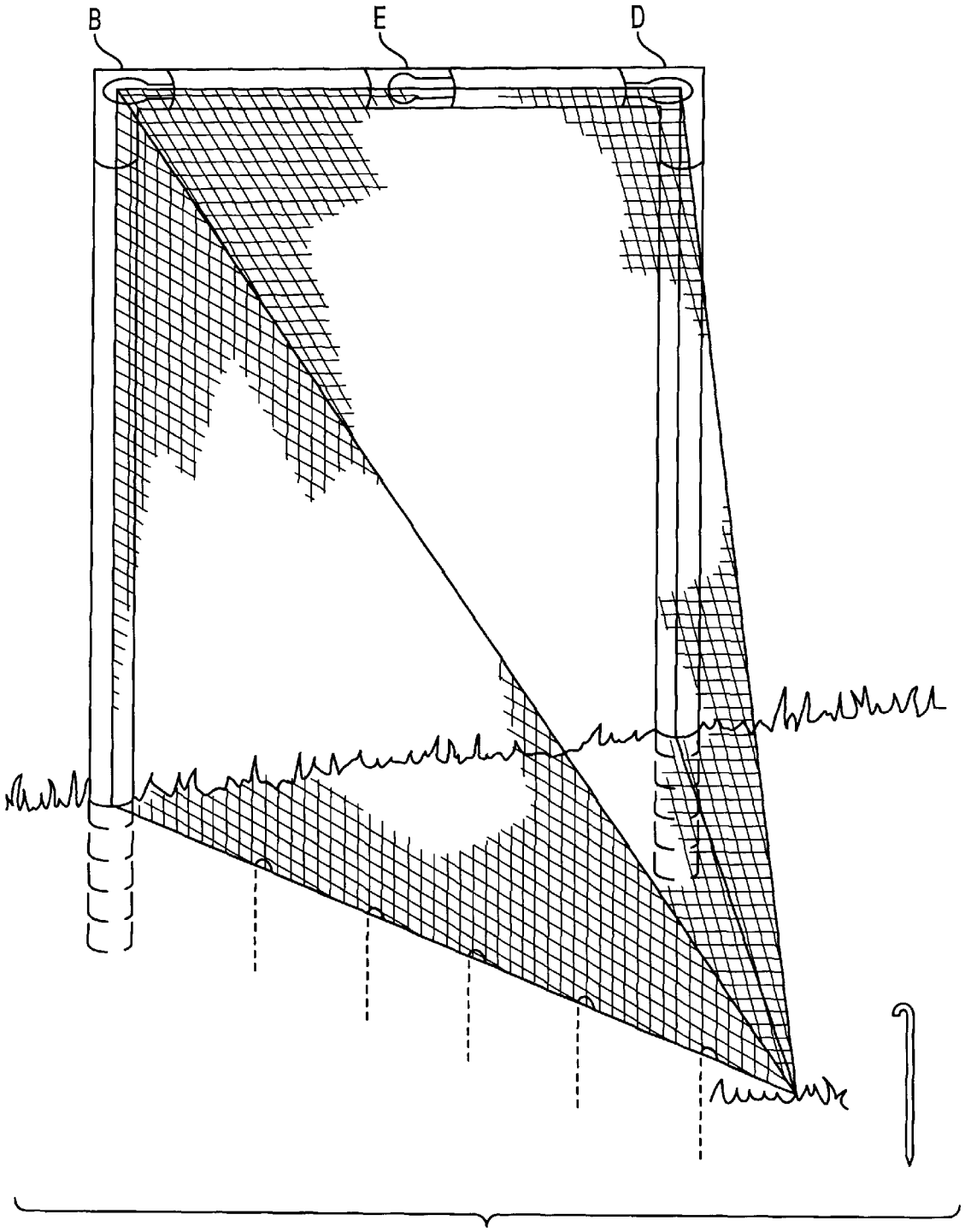
FIG. 15 shows the locations of the joints in an alternative embodiment of the invention for a Lacrosse goal.

FIG. 15 shows the turf embodiment of the invention, containing only joints B, C and D. Here, to collapse the goal, one would remove the spikes holding the net to the ground, remove the uprights from their support holes and then break joint E in half and then break joints D and E. In this embodiment, since there are no lower frame members, joints B and D can be configured to break in any direction. Alternatively, they can be configured, for example, such that the gap in the crossbar joint faces downward.

According to the invention, a full size lacrosse goal can be collapsed in a very short amount of time into a substantially small package which is easily transported. Further, the same lacrosse goal can be easily emplaced in a minimum amount of time. To put the lacrosse goal in place, it is recommended that the steps described above merely be carried out in reverse.

Figure 16:
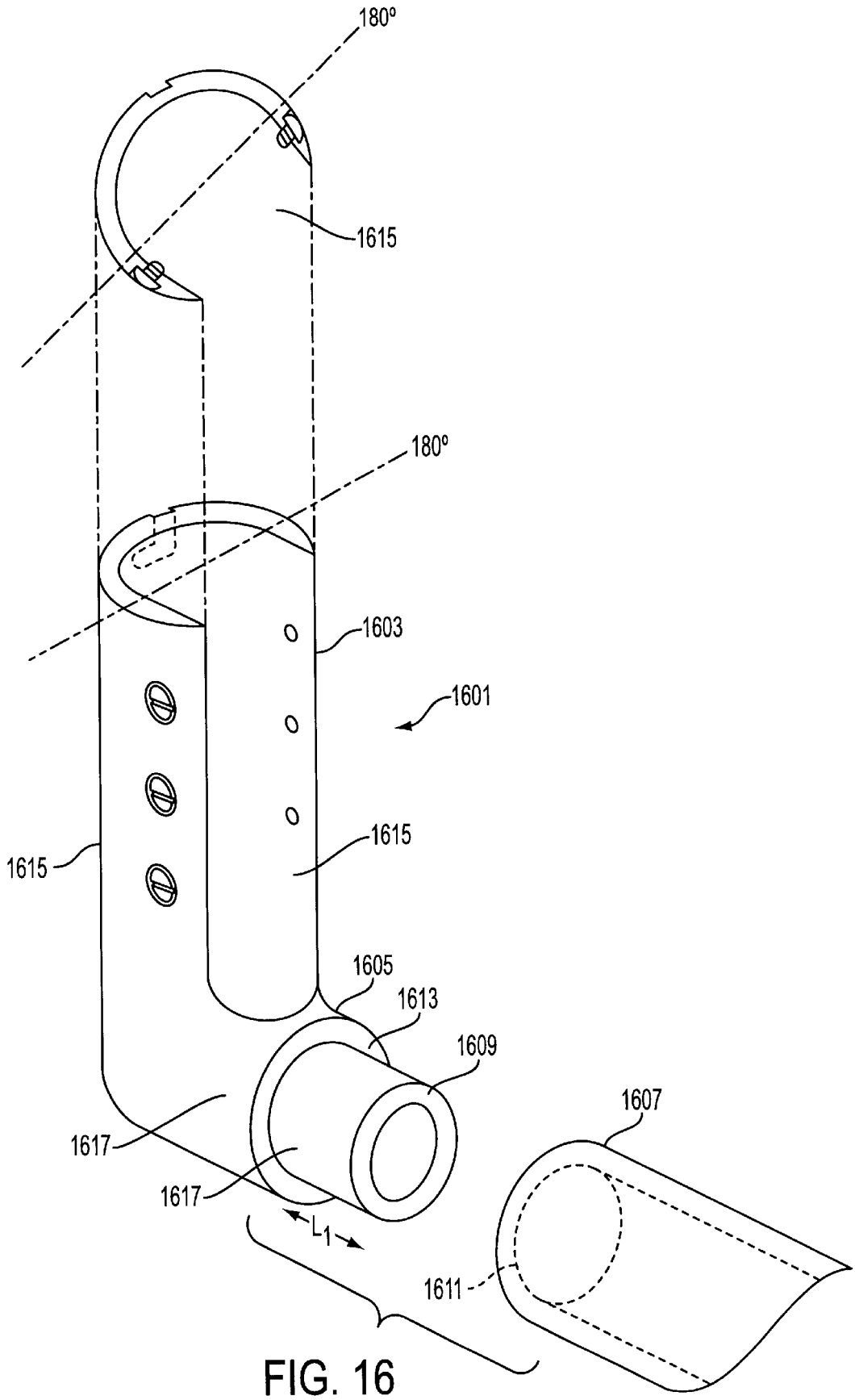
FIG. 16 shows details of the shell portion of an alternative single socket, right angle joint according to the invention.

As previously disclosed herein, a joint or link according to the invention has a gapped and an ungapped arm. Such a link can be described as a shell and a flexible member. One example of a shell is shown in FIG. 16. Shell 1601 has arms, one arm being a socket portion 1603 and another arm being an attachable portion 1605. The attachable portion 1605 is that portion of the shell 1601 which is intended to be affixed to a stationary member, such as frame member 1607. The socket portion 1603 of a shell 1601 typically has a concave shape along its length. The purpose of this socket portion 1603 is to hold/grasp/secure a moveable member in the engaged position. As a point of reference the socket portion 1603 of shells described herein can have a top and a bottom portion. The bottom portion of the socket 1603 is that portion which is closest to or includes the attachable portion 1605. The top portion is at the opposite end of the socket portion 1603. The attachable portion 1605 of the shell 1601, which is intended to be affixed to the stationary member 1607, in FIG. 16, is located at the bottom of socket portion 1603. On the shell as shown in FIG. 16, the socket and attachable portions could be reversed. The attachable portion 1605 of the shell 1601 can be a fitting, for example, as shown in FIG. 16, alternatively, a beveled edge positioned at a desired angle, in relationship to the stationary member can be used, as discussed further herein and shown in FIG. 34. In any case, when the shell is attached to the stationary member, their angular relationship is constant. The angular relationship between the socket portion of a shell and the attachable portion of a shell is fixed at a desired angle or constant. The attachable portion of a shell(s) can be affixed in any angular relationship with respect to the angle of a stationary member. A flexible member moves in and out of an opening in the socket portion of a shell called the mouth 1615 of the socket portion 1603 so that a moveable member attached thereto can be moved into an engaged position or a collapsed position. FIG. 16 shows a shell 1601 for a joint or other link which can be used for joining a pair of members at the first of their respective ends. Shell 1601 has a socket portion 1603 with an opening or mouth 1615 therein, and an attachable portion 1605. The attachable portion 1605 of the shell 1601 can be attached to a stationary member 1607. Member 1607 can be, for example, a frame member of a game goal, as previously disclosed herein. It should be noted that a joint according to the invention may have other applications. For example, such a joint may be incorporated into any collapsible apparatus, such as a spacecraft, scaffolding, portable viewing stand, tent, portable shelter or other structure.

For convenience of connecting member 1607 to the attachable portion 1605 of shell 1601, the attachable portion of the shell 1601 may have an optional guide portion 1609. As shown in FIG. 16, guide portion 1609 has an outer diameter adapted to fit within the inner diameter of frame member 1607 for a length L1. Guide portion 1609 may be a tube like structure or may be solid. For assembly, guide portion 1609 is inserted into frame member 1607 such that an end portion 1611 of frame member 1607 butts against portion 1613 of the shell. It will be known to those of ordinary skill that guide portion 1609 and frame member 1607 can be threaded such that shell 1601 and member 1607 can be screwed together. Attachment of the guide portion 1609 of shell 1601 to member 1607 can also be supplemented using glue, screws, rivets, welding or other fastening methods. Of course, in some applications, it may only be necessary to insert the guide member into the frame member without further securing the connection. The bottom interior portion 1617 of shell 1601 is located on the inside of the socket portion 1603 and on the inside of attachable portion 1605 and guide portion 1609, if they exist. It should also be noted that the frame member 1607 can be connected to the attachable portion 1605 of shell 1601 with or without the presence of guide member 1609 through any conventional means, such as welding, gluing, mechanical fasteners such as nuts and bolts, screws, rivets, or any other convenient means. It would also be within the scope of the invention for the member 1607 to have a flared portion at its end which can be inserted over either guide portion 1609 or the outside of attachable portion 1605. It should also be noted that member 1607 can be a hollow or a solid member. In case where the end portion of frame member 1607 is fit over guide member 1609, frame member 1607 requires a hollow portion at its end for length L1. In the case where the end portion of frame member 1607 is fit over the exterior of the attachable portion 1605, frame member requires a hollow portion at its end for length of the overlap plus L1, if the guide portion 1609 exists. However, the remainder of member 1607 may be solid. An opposite connection arrangement can also be used. For example, member 1607 can be formed with a guide portion for insertion into the attachable portion 1605 of shell 1601. Further, the diameter of attachable portion 1605 can be flared or tapered to accommodate the outer diameter of such a guide portion extending from member 1607. In addition, the diameter of attachable portion 1605 can be made to accommodate insertion of the end portion of member 1607 with or without a guide portion thereon.

In FIG. 16 the top view of shell 1601 is shown. In the top view of shell 1601 the perimeter of the outside diameter is nominally 68% of the full circumference of a circle. In the top view of shell 1601 the perimeter of inside diameter is nominally half the circumference of a circle. As a point of reference the mouth in the socket portion can be viewed as a portion of the circumference of a circle, when taking the top view of shell 1601 into consideration.

In another embodiment according to the invention, shell 1601 can have an socket portion of a fixed size which is attachable to an adapter (not shown) having a different diameter to accommodate a larger or smaller frame member 1607. Such an adapter can be made with or without a guide portion for insertion into member 1607 or can be made hollow having a diameter to accommodate either a guide portion protruding off member 1607 or insertion of the end portion of member 1607.

Figure 16A:
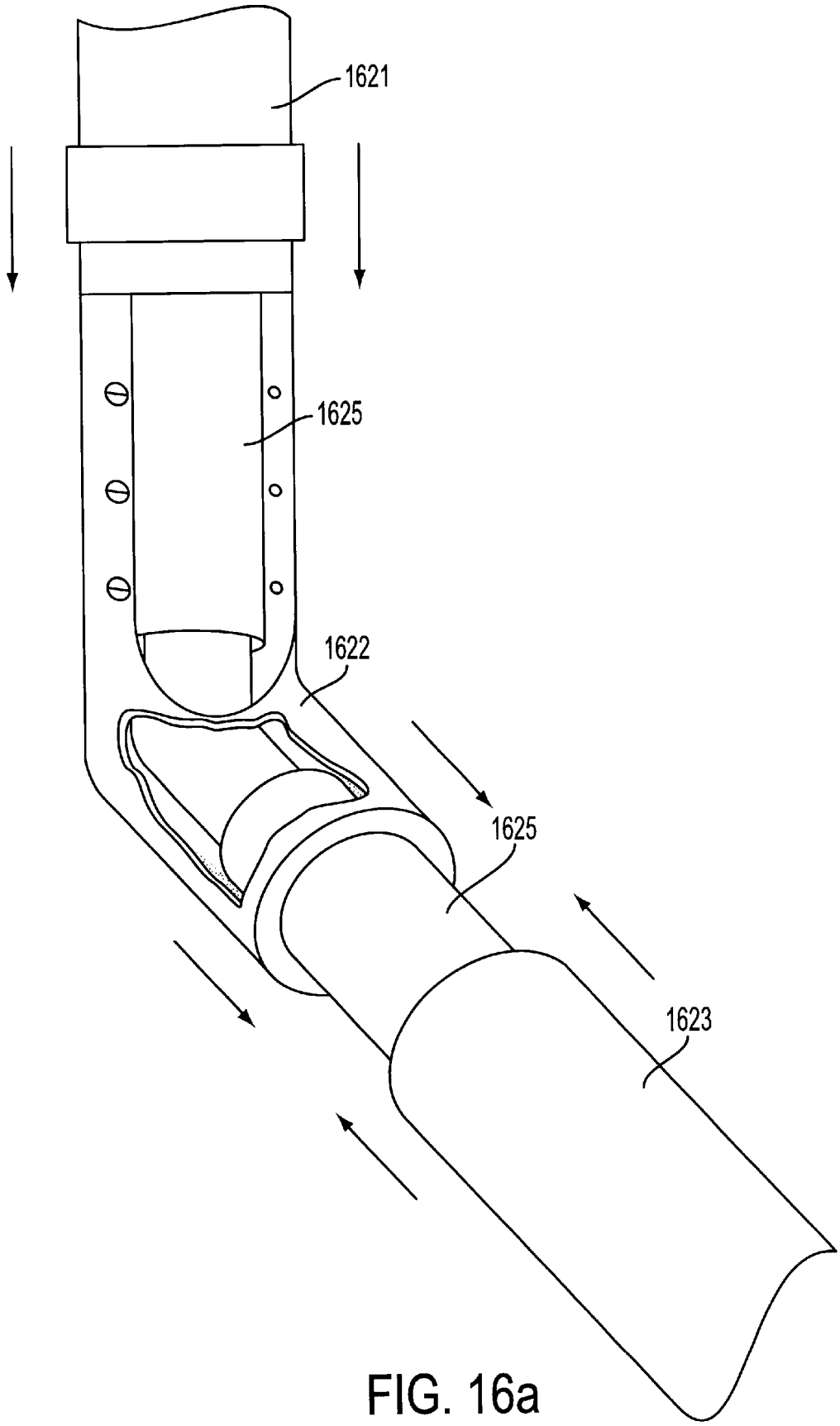
FIG. 16*a* shows a single socket, right angle joint according to the invention, where both the moveable member and the stationary member have identically tapered ends.

FIG. 16*a* shows an example of the attachment of moveable and stationary members to shell 1622, In this case, both the movable member 1621 and the stationary member 1623 have identically tapered ends 1625. In one embodiment of the arrangement shown in FIG. 16*a*, the outer diameters of the frame members 1623 and 1621 equal the outer diameter of the shell 1622 in order to form a substantially smooth surface.

Figure 17:
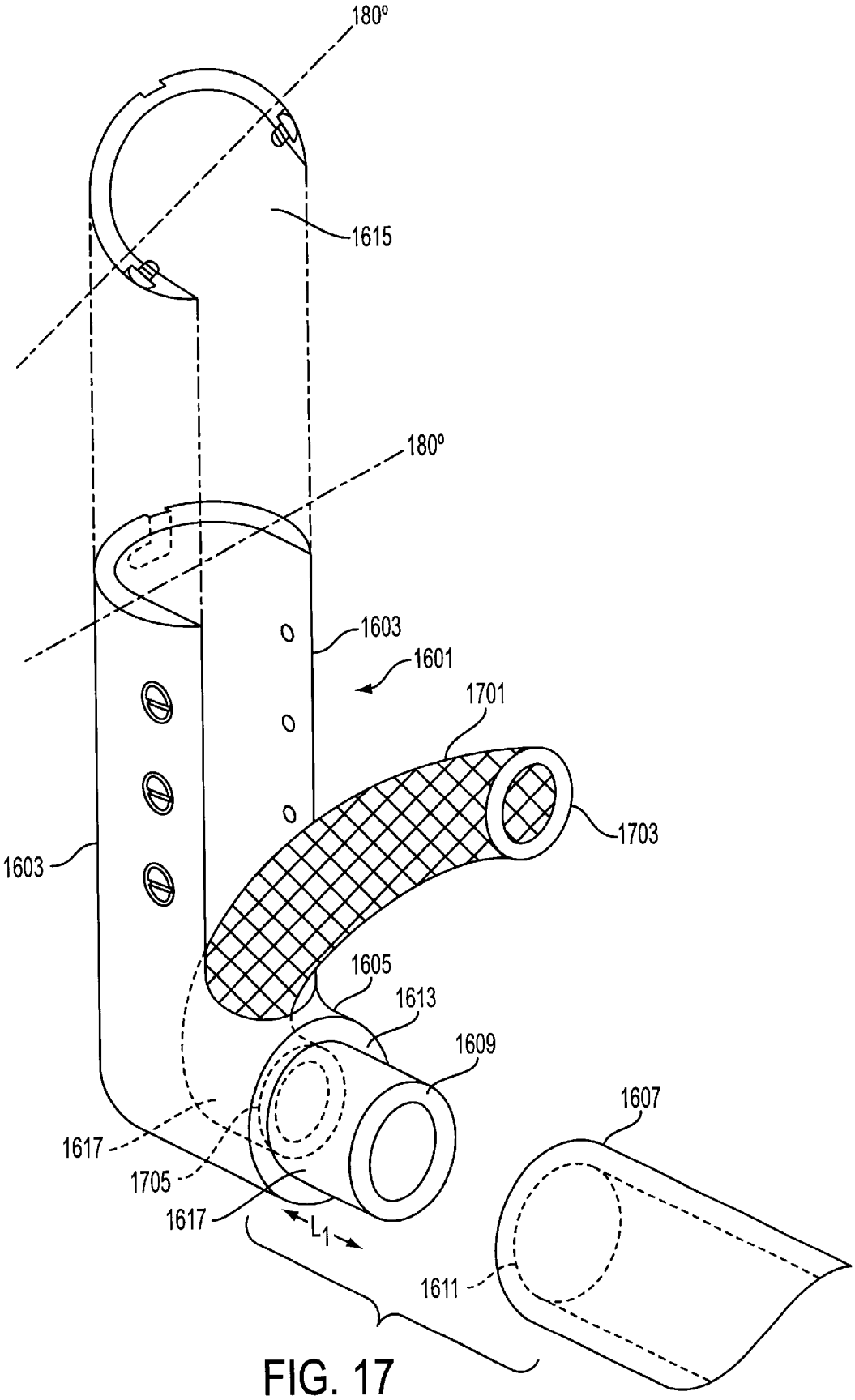
FIG. 17 shows the shell of FIG. 16 with a flexible member inserted or affixed therein which has compound angular mobility.

FIG. 17 shows a link according to the invention with flexible member 1701 inserted into the interior portion 1617 of shell 1601. Flexible member 1701 is generally inserted into a frame member beginning at end 1703 and may be fastened to the interior portion 1617 of shell 1601 as further described herein. Compound angular mobility is defined as moving at more than one angle. Flexible member 1701 allows the member attached thereto, compound angular mobility. Flexible member 1701 is internally tethered to interior portion 1617 of shell 1601. End 1703 of flexible member 1701, and any member attached thereto, can be moved in and out of socket mouth 1615 of shell 1601. Flexible member 1701 at end 1705 can be fastened to the interior portion 1617 of shell 1601 or to the interior of frame member 1607 at end 1611, by any conventional means, including expansion mechanisms or wedges. Examples of expanding mechanisms are as follows: Oatey wing nut expander, US. Pat. No. 4,493,344; All-thread connecting two wedge nuts, such as in a goose neck on a bicycle; A tightly fitting piece of rubber; A flexible V-shaped piece of metal. An expanding mechanism located inside flexible member 1701 at end 1705, which is simultaneously inserted inside attachable portion 1605, or stationary member 1607, would expand to secure end 1705 of flexible member 1701 to the interior portion of shell 1601. This configuration would fasten the flexible link to the shell. Depending on how far flexible member 1701 is inserted into the interior portion of shell 1601, an expansion mechanism within both (flexible member 1701 and interior portion 1617) may expand securing the flexible member 1701 on the inside of attachable portion 1605, or guided portion 1609 or even inside of stationary member 1607. All of these cases are valid configurations for securing the flexible member 1701 to the interior portion 1617 of shell 1601. The same would apply if the securing mechanism were glue or any other adhesive instead of an expansion mechanism or wedge.

Figure 18:
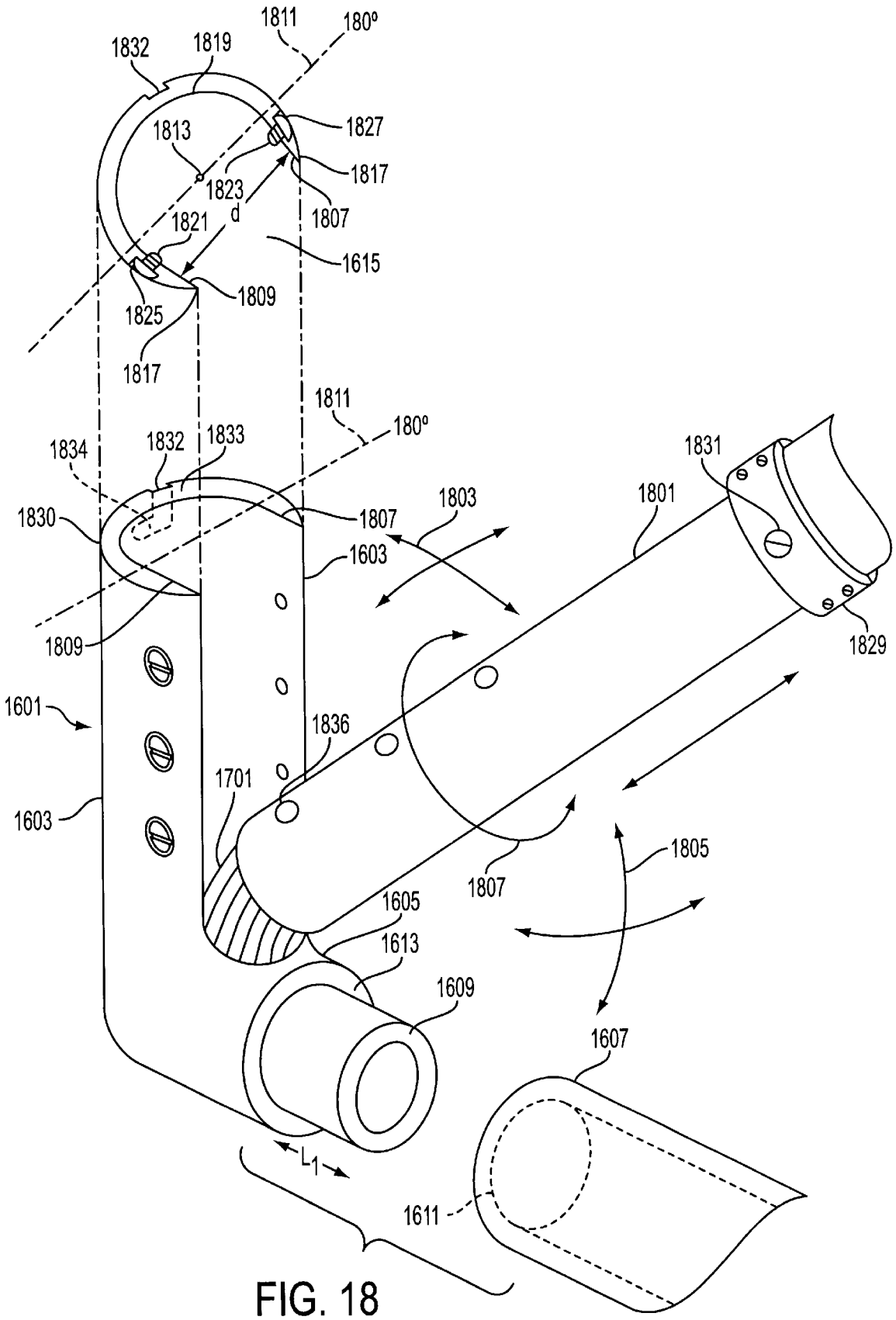
FIG. 18 illustrates the shell of FIG. 17 used with a flexible member to create a link between two members.

FIG. 18 shows frame member 1801 inserted over flexible member 1701. Depending on the application, it may be useful to fasten the outer diameter of flexible member 1701 to the inner diameter of the frame member 1801 by gluing, bolting, or other conventional attaching means. However, attaching flexible member 1701 into a frame member, in some cases is accomplished by merely inserting the flexible member into the frame member. This attachment may be sufficient because of the natural expanding quality of the flexible member, or because stresses on the members when assembled do not tend to pull them apart. This concept is the reverse of handle bar grips on a bicycle.

FIG. 18 shows the compound angular mobility of frame member 1801. Compound angular mobility is defined as moving at more than one angle, and is depicted in FIG. 18 by motion lines 1803 and 1805. Motion line 1807 indicates that frame member 1801 is twistable when connected to flexible member 1701. This twisting ability allows for unconventional collapsing of frame structures. Tethering frame member 1801 to flexible member 1701 allows frame member 1801 the ability to be adjusted in direction 1803 for insertion into the socket mouth 1615 of shell 1601.

In the collapsed position, member 1801 is pulled out of the socket mouth 1615 and moved in direction 1805.

Socket mouth 1615 of shell 1601 preferably secures member 1801 in the engaged position in such a manner that member 1801 pops in and out of socket mouth 1615 in response to force applied to the member. As previously discussed with respect to FIG. 7, elbow 601 can be considered a shell. In this embodiment, shell 601 is formed of resilient material which partially encloses member 503 when it is popped into position within gapped portion 603, thereby forming a secure fit. In order to collapse the assembly, pressure is applied on member 503 to force it out of gap 701 of shell 601.

For additional rigidity, in the joint shown in FIG. 18, it is desirable to form shell 1601 out of materials which are non-resilient or nonflexible, such as aluminum. FIG. 18 shows an arrangement according to the invention in which a secure snap fit can be achieved even when shell 1601 is made of such nonflexible material, such as aluminum. According to the invention, socket portion 1603 is formed with inner walls 1807 and 1809 at right angles to a reference line 1811, preferably passing through a center 1813 of the socket portion 1603. Thus, socket portion 1603 has a socket mouth 1615 in which the distance d between walls 1807 and 1809 is substantially constant from the edge 1817 to reference line 1811. Distance d is chosen to be approximately equal to the outside diameter of member 1801 which will be inserted into the socket portion 1603 of shell 1601. Distance d is also substantially consistent between the top of socket portion 1603 to the bottom of socket portion 1603. The substantially straight walls 1807 and 1809 at socket mouth 1615 of socket portion 1603 facilitates easy insertion and removal of member 1801 with respect to the socket portion 1603. The rounded portion 1819 of the interior of the socket portion 1603 is formed to inversely match the curvature and outside diameter of member 1801. As discussed further herein, members having shapes other than rounded or tubular can also be used and accommodated.

In order to achieve the snap fit desired to secure member 1801 into the socket portion of the shell, protrusions 1821 and 1823 are formed on walls 1807 and 1809. FIG. 18 shows such protrusions being formed using bolts, for example nylon bolts 1825 and 1827, which are placed into the walls of the socket portion and protrude through walls 1807 and 1809 to form protrusions 1821 and 1823. Preferably, bolts 1825 and 1827 are countersunk so as not to protrude from the outer diameter of the socket portion. Other forms of protrusions can also be used. For example, the protrusion can be integrated with interior walls 1807 and 1809. Preferably, such protrusions are some what responsive to pressure. For example, detent plungers, nylon screws or any slick, resilient, flexible, elastic protruding plug-ins can be used. The actual positioning of the resistance bolts need not be semetrical and they can be placed only on one side of the socket mouth or on both sides of the socket mouth. The positioning of the resistance bolts could be staggered or offset within the socket mouth. Using the approach discussed above, the shell 1601 can be made of material which does not flex but still provides the resistance for a snap fit of member 1801 into the socket mouth 1615 in the engaged position.

Member 1801 is further secured in the engaged position using cap 1829. When member 1801 is engaged, cap 1829 slides over the exterior of the upper portion 1830 of socket portion 1603 in shell 1601. Preferably, cap 1829 is equipped with a protrusion on the interior of the cap. Such a protrusion can be formed using screw 1831*a*, for example. Cap 1829 is placed over the top 1830 of shell 1601 when member 1801 is inside socket portion 1603. Cap 1829 is then rotated until the protrusion aligns with generally "L" shaped detent 1832, which is located in the top 1830 of the socket portion 1603 of shell 1601. Cap 1829 is then depressed so that the protrusion moves into detent 1832, specifically into the detent slot 1833 and turned so that the protrusion rests in portion 1834 of the detent slot 1832, thereby forming a secure engagement.

It should also be noted that it may be useful to form a frame member for insertion into the socket portion of the shell with indentations which match the protrusions providing a snap fit between the frame member and the socket portion of the shell. FIG. 18 shows such indentations 1836 formed in frame member 1801. Indentations 1836 will align with corresponding protrusions 1821 and 1823 to snap into place and provide a secure fit. This approach can be used on any of the moveable members (e.g. 1801) and shells for links or joints disclosed herein.

Figure 19:
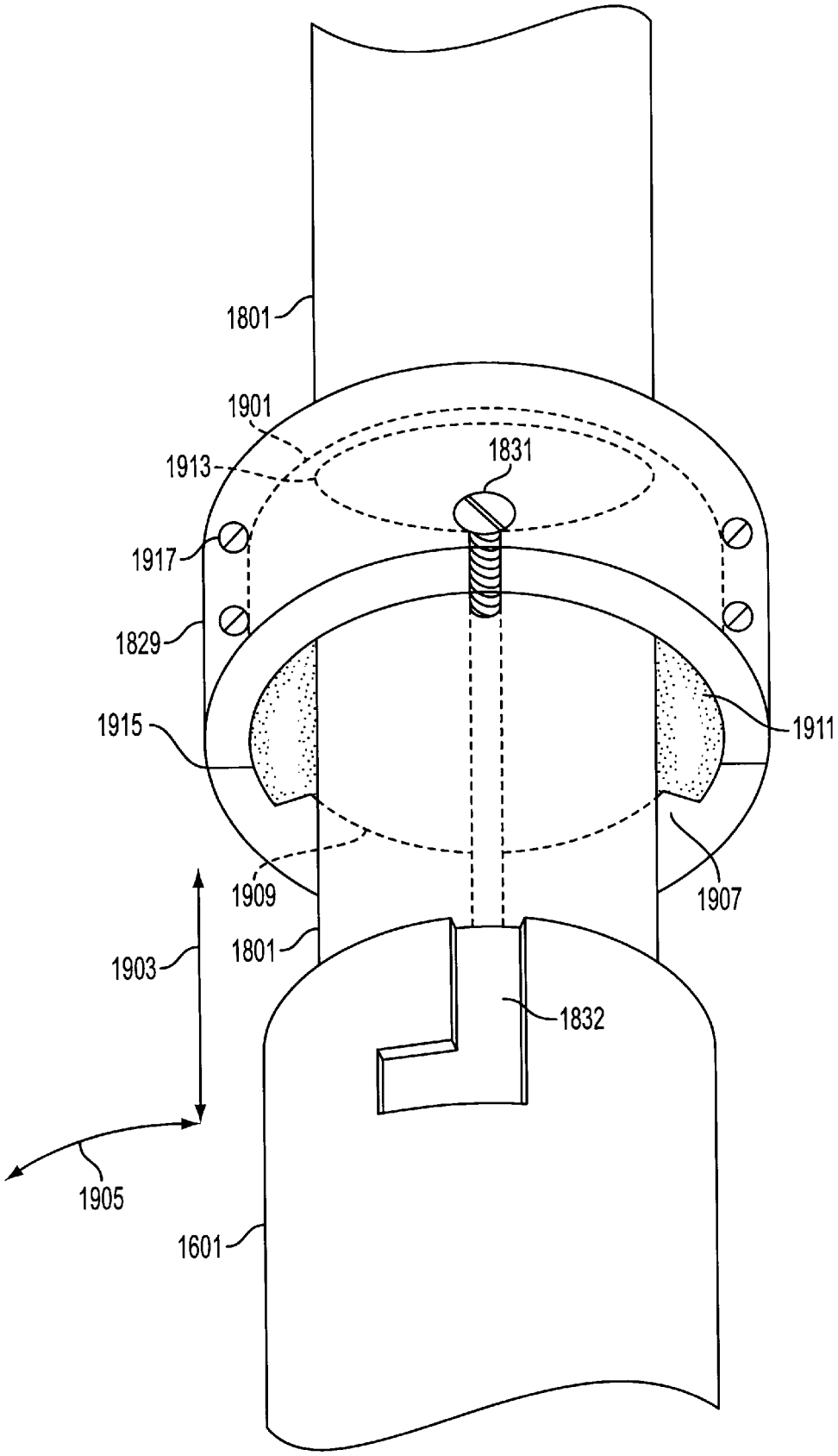
FIG. 19 illustrates a locking mechanism that secures a movable member in the socket of a shell of a joint according to the invention.

FIG. 19 is a more detailed view of detent 1832 and locking cap 1829. As shown in FIG. 19, cap 1829 is coupled around the outside of member 1801 and, when member 1801 is in the engaged position, a portion of cap 1829's interior diameter slips over the exterior of shell 1601. As shown by dotted line 1913, the top portion of the cap can have an inner diameter which is nominally equal to the outer diameter of member 1801. At the side of the cap which engages shell 1601, the inner diameter of the cap must be nominally equal to the exterior diameter of the shell. As shown in FIG. 19, screw 1831 forms a protrusion which engages slot 1832. Detent 1832 is formed in shell 1601 on the reverse side from the socket mouth 1615. Line 1903 shows the direction in which the protrusion formed by screw 1831 enters and exits the detent 1832. Line 1905 illustrates the direction of rotation of cap 1829 as it locks and releases the cap to the shell.

The portion of cap 1829 which interfaces with the mouth 1615 of the socket portion 1603 (not visible in FIG. 19) of shell 1601 is shown in FIG. 19 at 1907. Portion 1907 can have an inner diameter approximately equal to the outer diameter of member 1801, as shown by line 1909, since portion 1907 interfaces with the mouth 1615 of the socket portion 1603. In order to slip over the exterior of shell 1601, the remaining portion of the inside diameter of cap 1829 must be minimally larger than the outer diameter of shell 1601. This portion of the cap which interfaces with the socket portion 1603 of shell 1601 is shown in FIG. 19 at edge 1911. For ease of assembly, the cap 1829 can be made in 2 pieces. The halves are indicated by separation line 1915, in FIG. 19. The halves of the cap can be attached by counter sunk bolts 1917 as displayed in FIG. 19. It should be noted that these halves could be connected by any conventional means; gluing, screwing, or even a plastic zip tie around the perimeter. An advantage of the cap shown in FIG. 19 is that it can be used with non-resilient members and non-resilient shells. It will be known to those of ordinary skill, that other cap embodiments may also be used. For example, one may employ a resilient cap which deforms were placed over shell 1601 to form a secure engagement. It would also be possible to form cap 1829 without portion 1907 for example, by forming the interior of the cap with a portion engaging member 1801 having an interior diameter approximately that of the outer diameter of member 1801 and another portion of cap 1829 having an interior diameter at least equal to the outer diameter of shell 1601, thereby allowing the cap to slide over the shell for a snug fit.

The cap 1829 could also be formed without the locking structure provided by the protrusion into detent 1832. Where a protrusion is not used in the cap, detent 1832 can also be eliminated. It should be noted that in the case where a protrusion is not present, the securing of member 1801 in the engaged position is accomplished by merely emplacing the cap over the shell.

Figures 20, 21:
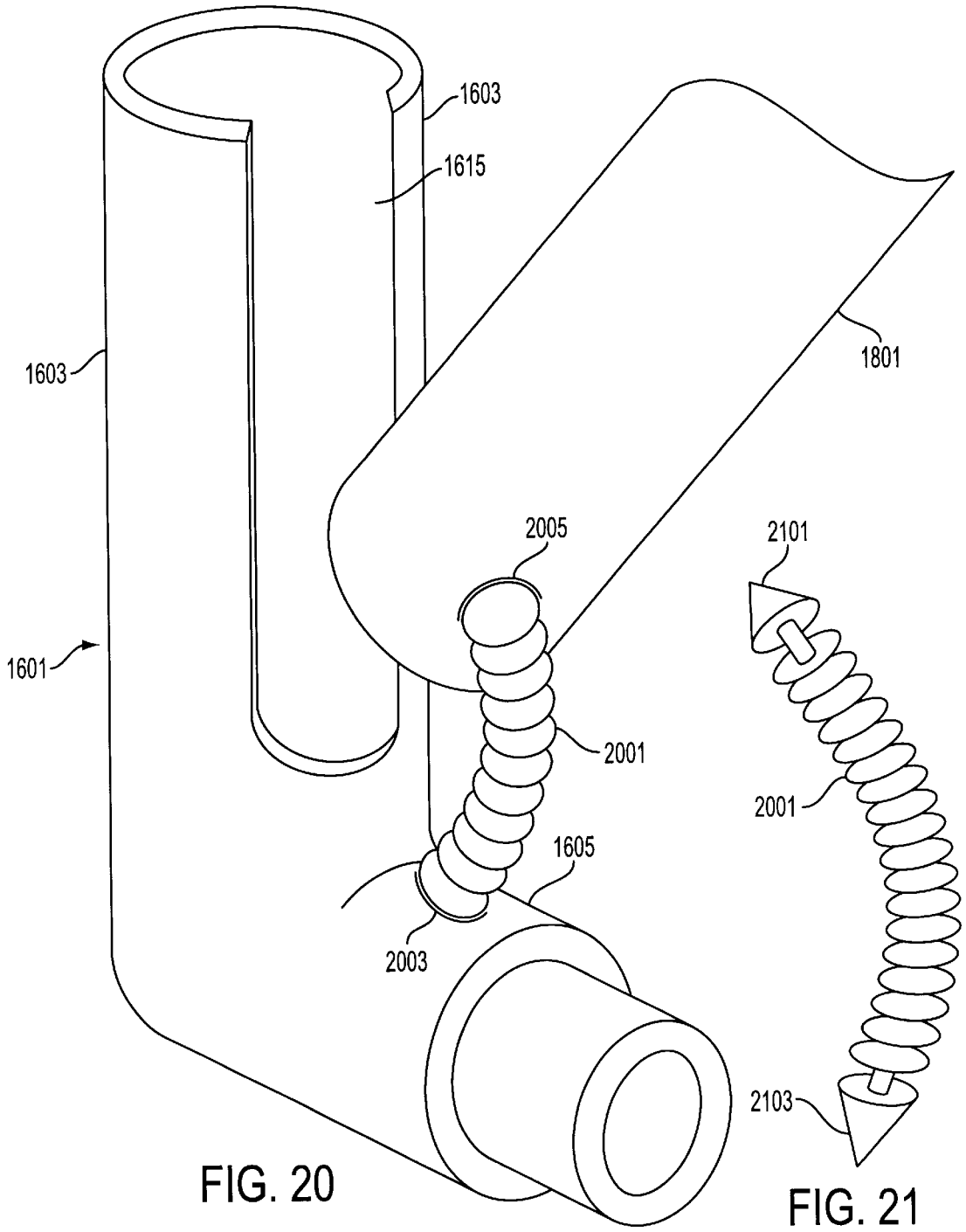
FIG. 20 illustrates an external flexible link which is an alternative to the flexible member inserted into the shell to provide the desired compound angular mobility.
FIG. 21 illustrates an external flexible member which is an alternative to the flexible member inserted into the shell to provide compound angular mobility.

FIG. 20 shows another embodiment which employs a flexible member 2001 which connects to shell 1601 at the attachable portion 1605 as shown at 2003. Flexible member 2001 connects at an opposite end to member 1801 as shown at 2005. Member 1801 can be inserted and removed from socket portion 1603 of shell 1601 to form the erect and collapsed position, respectively. As shown in FIG. 20, flexible member 2001 is tethered to the exterior of shell 1601. Flexible member 2001 can be made of a coiled resilient material or other elastic material or a spring. FIG. 21 shows element 2001 having insertion points 2101 and 2103 at either end. Insertion points 2101 and 2103 are cone shaped and fit into holes 2003 and 2005, as shown in FIG. 20. This provides a external flexible connection between member 1801 and shell 1601 so that member 1801 can be inserted and removed from socket portion 1603 of shell 1601. The exterior flexible member 2001 in some applications may be useful to facilitate replacement of the flexible member.

Figure 22:
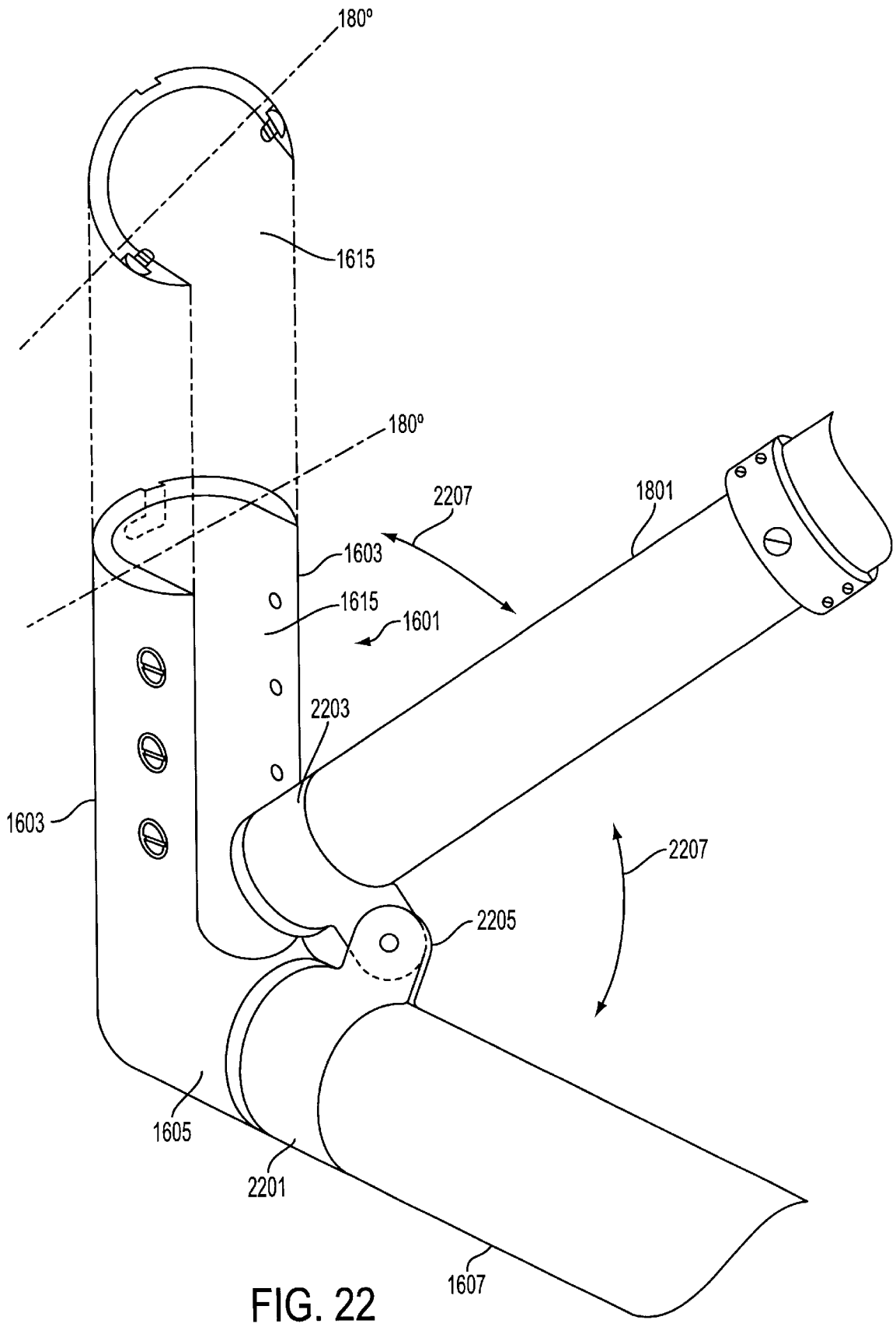
FIG. 22 illustrates an external band clamp link which is an alternative to the flexible member inserted into the shell to provide the desired degrees of movement.

FIG. 22 shows an alternative embodiment of an exterior flexible member connected to attachable portion 1605 of the shell 1601, and moveable frame member 1801. Where the stationary frame member 1607 is integrated with shell 1601, the exterior flexible member can be connected directly to frame member 1607. FIG. 22 shows band 2201 around frame member 1607 or attachable portion 1605 of shell 1601 and band 2203 around the frame member 1801. Member 1607 is shown as being integrated with shell 1601. Bands 2201 and 2203 are connected at moveable link or pivot 2205 to provide motion of member 1801 at least in the direction shown by lines 2207. Member 1801 can be moved into the erect position by insertion into socket portion 1603 or a collapsed position where member 1801 is removed from socket portion 1603. It should be noted that the external band configuration of tethering member 1801 can be accomplished using bands make of metal, nylon, plastic or rubber. This external band link configuration is an inexpensive way of tethering member 1801 which is favorable in situations where only angular mobility, not compound angular mobility of frame member 1801 is necessary.

Figure 23:
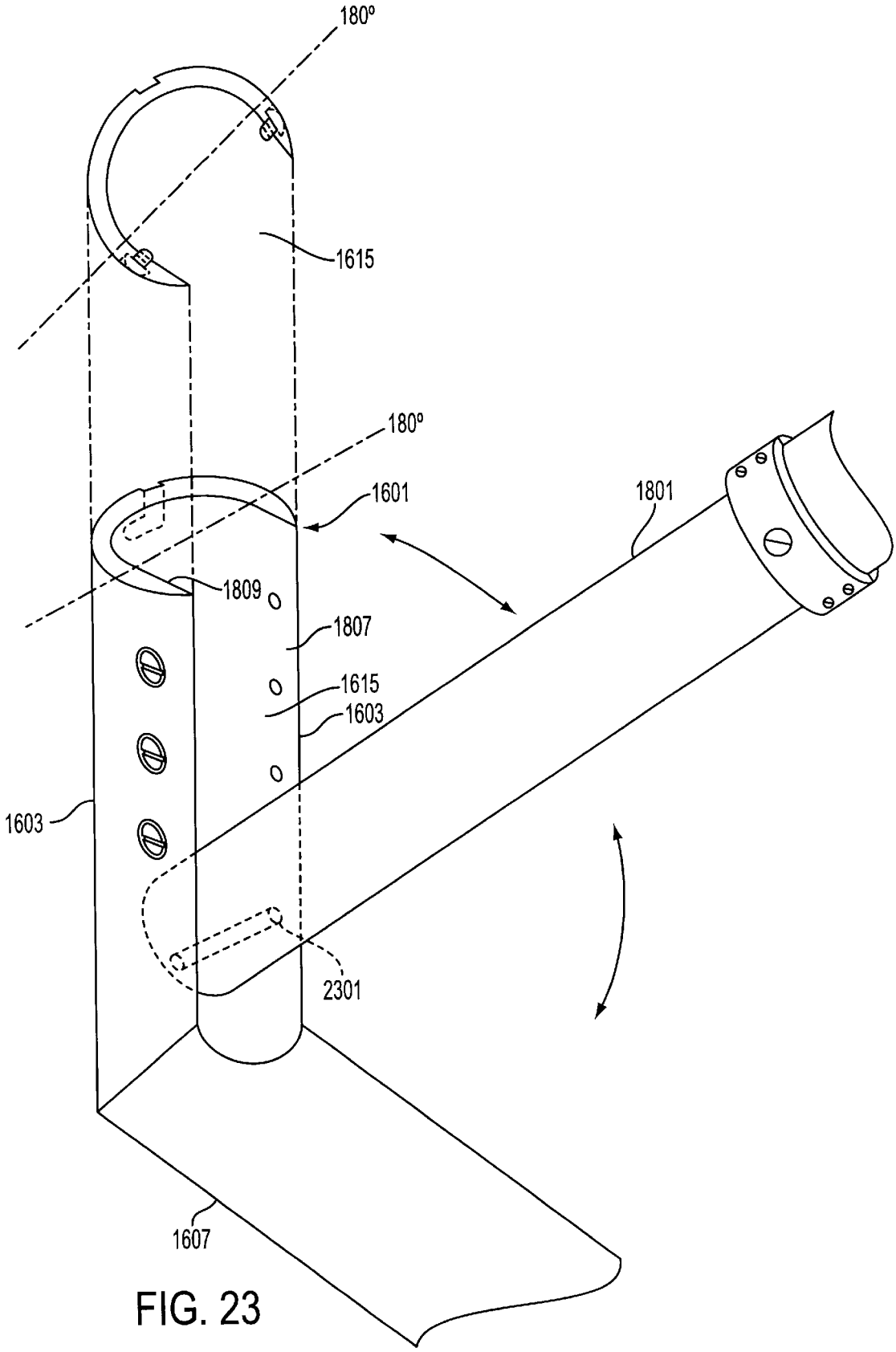
FIG. 23 illustrates an internal pivot pin link which is an alternative to the flexible member inserted into the shell to provide the desired degrees of movement.

FIG. 23 shows an alternative embodiment of an internal flexible member. In his configuration according to the invention pin 2301 passes through the walls 1807 and 1809 at a desired location in the socket portion 1603 of shell 1601. Member 1801 can rotate or pivot about the pin. Rotating member 1801 up into the socket portion 1603 forms the erect position while rotating member 1801 out of socket portion 1603 allows collapsing of the structure. This internal pin link method is a method of tethering member 1801 which is favorable in situations where only angular mobility, not compound angular mobility of frame member 1801 is necessary.

Figure 24:
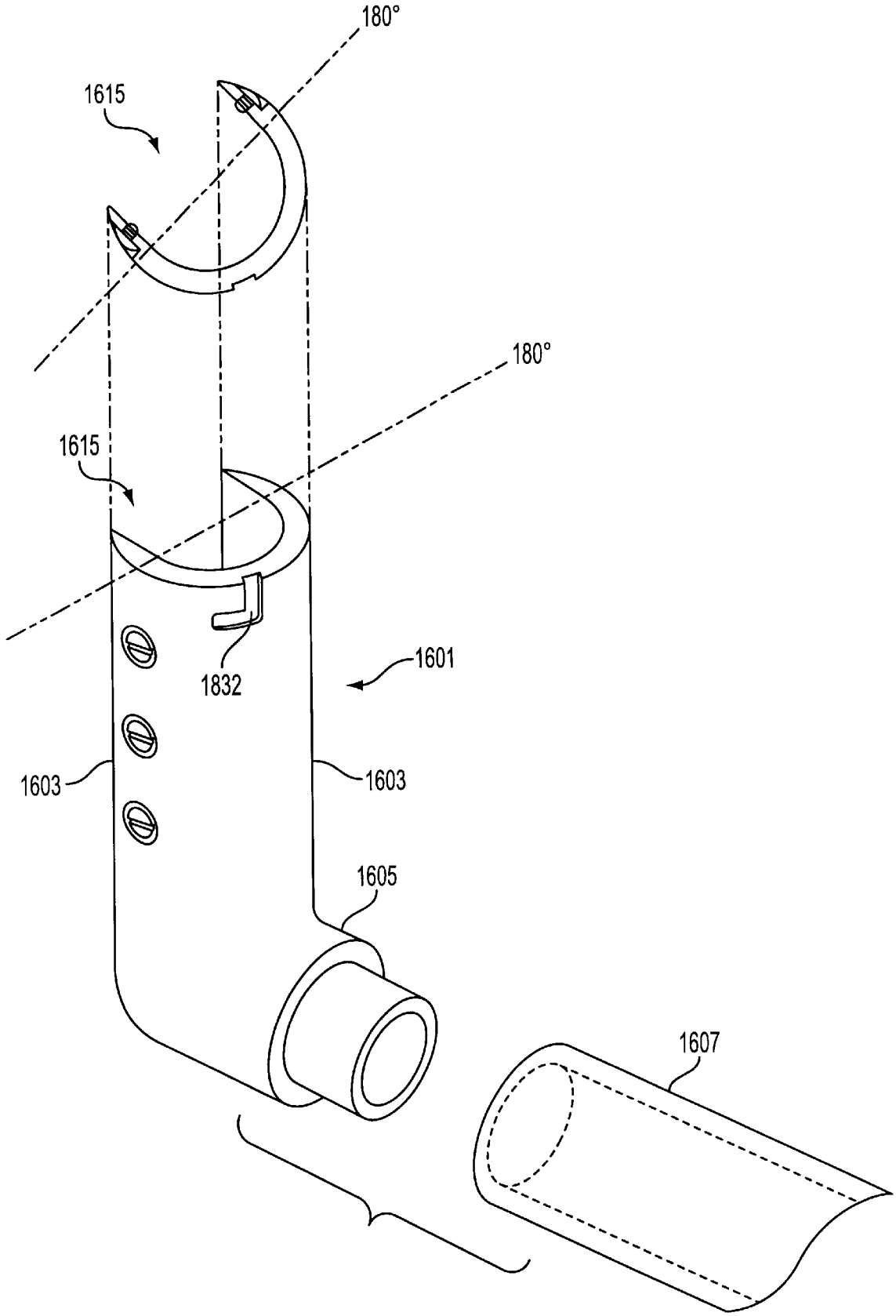
FIG. 24 illustrates the shell of the joint of FIG. 17 with the mouth of the socket portion facing in another direction to provide a different dislocating direction.
Figure 25A:
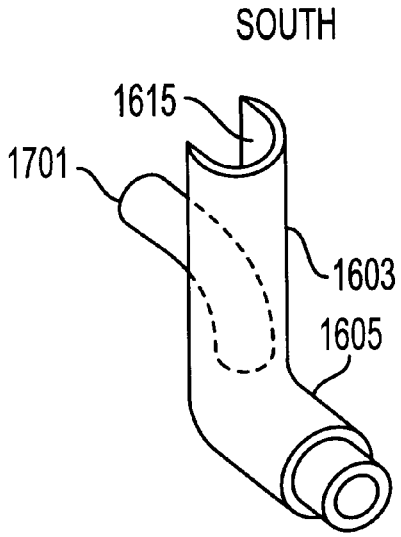
FIGS. 25*a*–25*d* illustrate the mouth of the socket portion of the joint of FIG. 17 facing in several possible directions in relationship to the intended position of the stationary member.
Figure 25B:
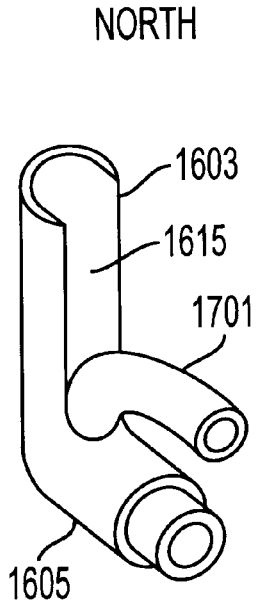
Figure 25C:
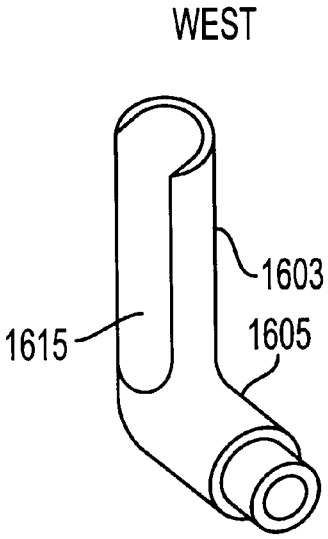
Figure 25D:
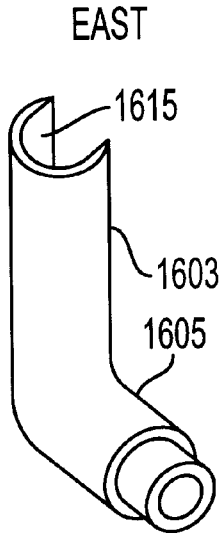

FIG. 24 illustrates a shell according to the invention with the socket mouth 1615 facing in a different direction from that shown in FIG. 16. For example, in FIG. 16, the socket mouth 1615 faces member 1607. In FIG. 24, the socket mouth 1615 faces a direction opposite attachable portion 1605 connected to member 1607. As illustrated in FIGS. 25*a*–25*d*, the socket mouth 1615 can be physically located in virtually any relationship to the stationary member or attachable portion 1605 of shell 1601. FIGS. 25*a*–25*d*, show four possible positions represented by North, South, East and West. It will be known to those of ordinary skill, however, that the socket mouth 1615 can open in any desired direction, specifically, 360 degrees around the socket portion 1603, a top view of whose circumference forms part of a circle. This allows flexible member 1701, which connects to a collapsing frame member, to provide any dislocating direction desired. This also allows for dislocation of the movable frame member in any direction.

Figure 26:
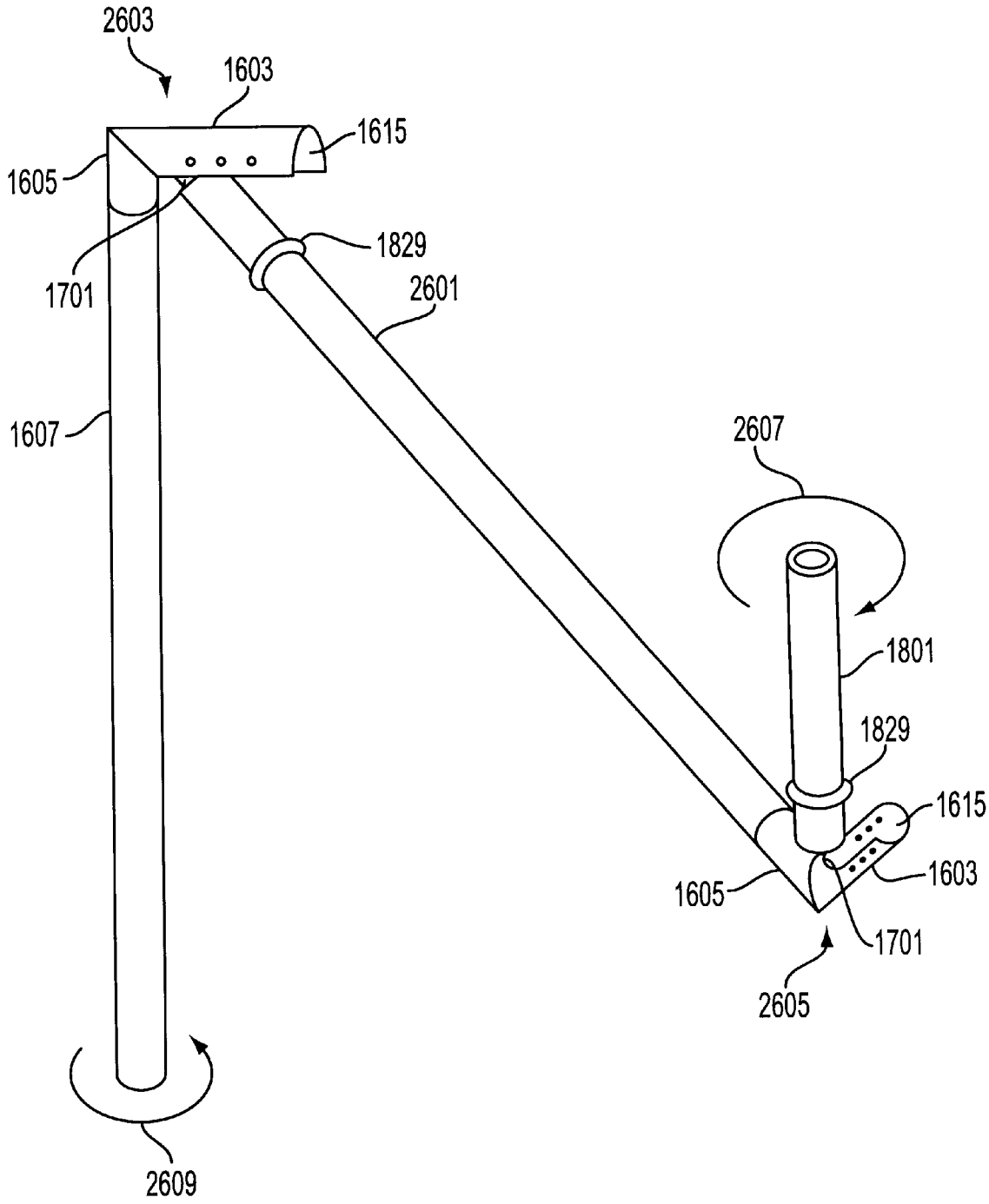
FIG. 26 illustrates that when two or more joints of FIG. 17, are used in conjunction with each other the first and third members may twist in opposite directions, which provides collapsing of structures in non-conventional ways.

FIG. 26 illustrates frame member 2601 interfacing with the socket portion 1603 of shell 2603 and the attachable portion 1605 of shell 2605. As shown in FIG. 26, the socket portions 1603 of shells 2603 and 2605 are positioned relative to attachable portions 1605 thereof in order to achieve a desired degree of motion. As previously noted, flexible members 1701 are twistable and allow the frame members 2601 and 1801 to easily move in and out of socket portion 1603 of shells 2603 and 2605, respectively. FIG. 26 shows specifically that member 1801 and member 1607 may twist in opposite directions. The opposite twisting ability also applies to adjacent members. In FIG. 26, this is indicated by rotation lines 2607 and 2609. This opposite twisting affect is extremely valuable when considering that, in game goal applications, most adjacent frame members have nets attached to each member's interior edge. As shown in FIG. 26, these joints 2603 and 2605, allow for compound angular mobility of the moveable members 1801 and 2601, including twisting, which allows for unconventional collapsing of frame structures such as game goals. Virtually any collapsible design can be implemented by locating shells at desired positions and orienting the socket and attachable portions of the shells at various angles.

Figure 27:
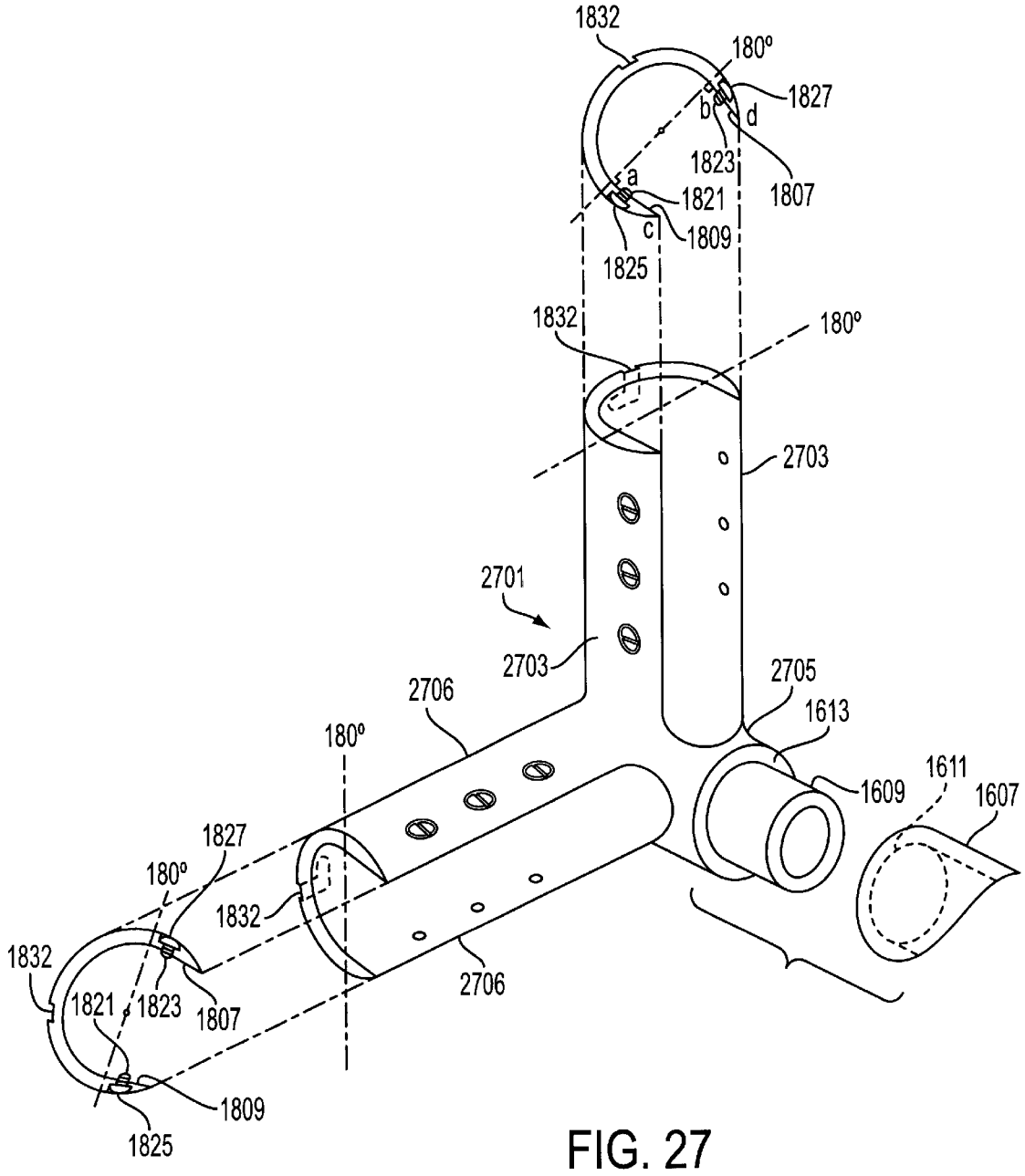
FIG. 27 illustrates a shell for a joint according to the invention having two sockets and a portion intended to affix a stationary member, which provides connectivity for three members.
Figure 38:
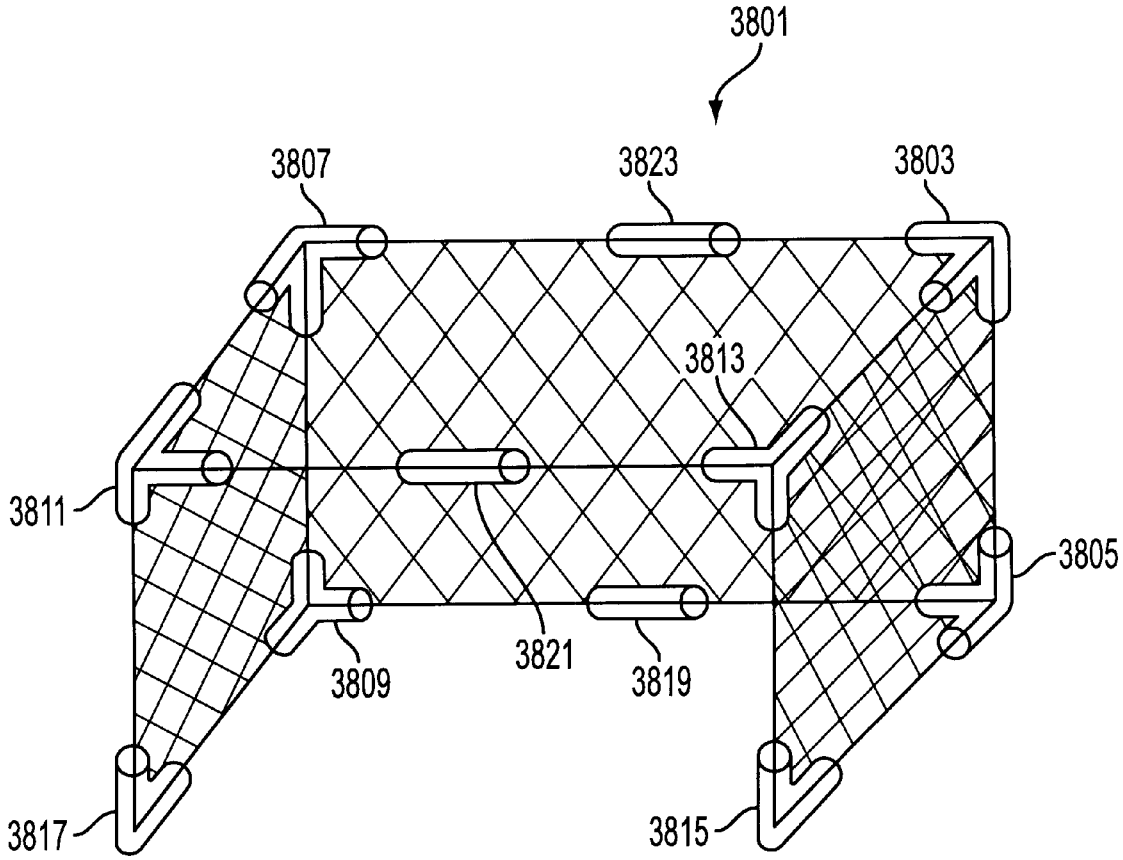
FIG. 38 illustrates an alternative game goal configuration, box shaped, using dual socket shells.

FIG. 27 illustrates a shell for a joint according to the invention having a plurality of socket portions, namely 2703 and 2706. Such a shell would be useful for collapsible structures where three members come together. One example discussed further herein is shown in FIG. 38 which can be a game goal. While a conventional lacrosse goal frame has a shape where only two members intersect at any given corner, other goal frames such as the ones used in conventional street hockey or hockey, have box-like goal frame structures, similar to that of FIG. 38, where three members intersect at some corners. Shell 2701 has a first socket portion 2703, an attachable portion 2705 and a second socket portion 2706. Each socket portion can be formed using the techniques described previously herein, namely a mouth in a socket portion may face any direction, one configuration of which is illustrated in FIG. 27. FIG. 27 shows a shell with two socket portions and one attachable portion. It will be known to those of ordinary skill that at least one socket portion is necessary for a joint according to the invention. It is within the scope of this invention that, socket portion 2703 or socket portion 2706 could be replaced with an attachable portion such as that shown at 2705. Thus, a joint according to the invention has at least one socket portion in a fixed relation to an attachable portion or frame member integrated therein. Each socket portion is tethered with a flexible member for connection to a moveable frame member, as previously disclosed herein. This shell 2701, facilitates formation of box-like structures which can have erected and collapsed configurations.

Figure 28:
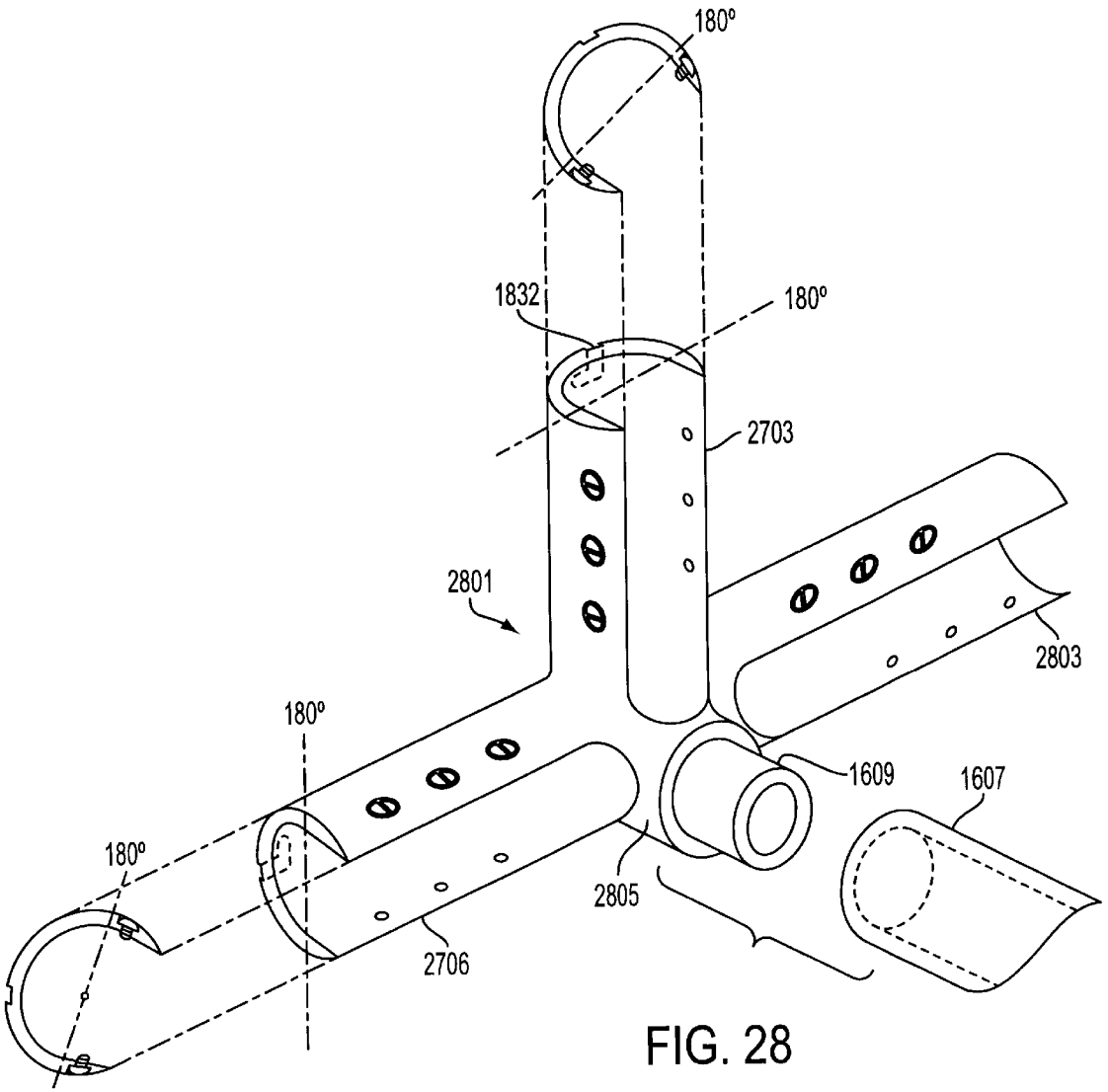
FIG. 28 illustrates another possible shell for a joint according to the invention, having a plurality of sockets and a portion intended to affix a stationary member, which provides connectivity for a plurality of members.

FIG. 28 illustrates still another possible shell for a joint according to the invention having a plurality of socket portions, namely 2703, 2706 and 2803.

Shell 2801 is similar to that shown in FIG. 27 with the addition of a third socket portion 2803. Each of the socket portions can be of the same configuration, as shown in FIGS. 27 and 28. Alternatively, the socket portions can have different configurations or use different flexible members, such as those shown in FIGS. 20, 21, 22 and 23. Any combination of socket portions and attachable portions and any combination of flexible members can be used, according to the invention. Each socket portion is configured to have a mouth facing any direction, so that any dislocation direction (of the moveable member) is possible. The angle of the socket portions in relationship to the stationary member is fixed and can be set at any angle, shown in FIG. 28 as 0, 90 and 180 degrees, respectively.

Figure 29:
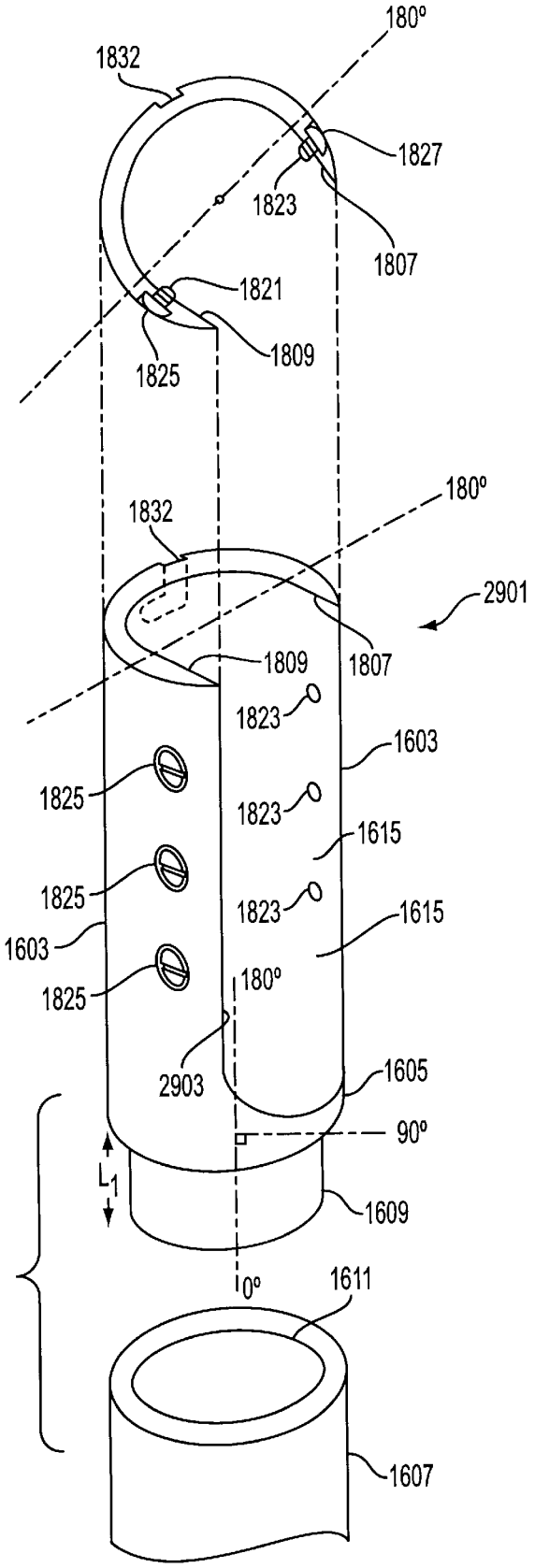
FIG. 29 illustrates the shell for a straight joint according to the invention.

FIG. 29 illustrates a shell for a straight link or joint according to the invention. In the straight shell 2901, socket portion 1603 is oriented at 180 degrees relative to attachable portion 1605. The relative angle between the socket portion and the attachable portion is depicted by reference line 2903 in FIG. 29. The attachable portion is shown having guide portion 1609 for connection with member 1607. However, attachable portion 1605 can be formed without a guide member and can be connected to or integrated with frame member 1607 using any of the methods and structures disclosed herein. Mouth 1615 of socket portion 1603 is shown having the embodiments previously described herein. It should be noted that each of the socket portions previously disclosed herein and as shown in FIG. 29 has a plurality of protrusions 1821 and 1823 formed by bolts 1825 and 1827. For example, FIG. 29 shows three protrusions on each of the opposite walls 1809 and 1807 of the mouth 1615 of the socket portion 1603. It will be known to those of ordinary skill, that any number of such protrusions can be formed, as suitable for the application and the dimensions of the socket mouth. These protrusions need not be positioned semetrically or may be positioned on one side of the socket mouth only, as previously disclosed herein.

Figure 30:
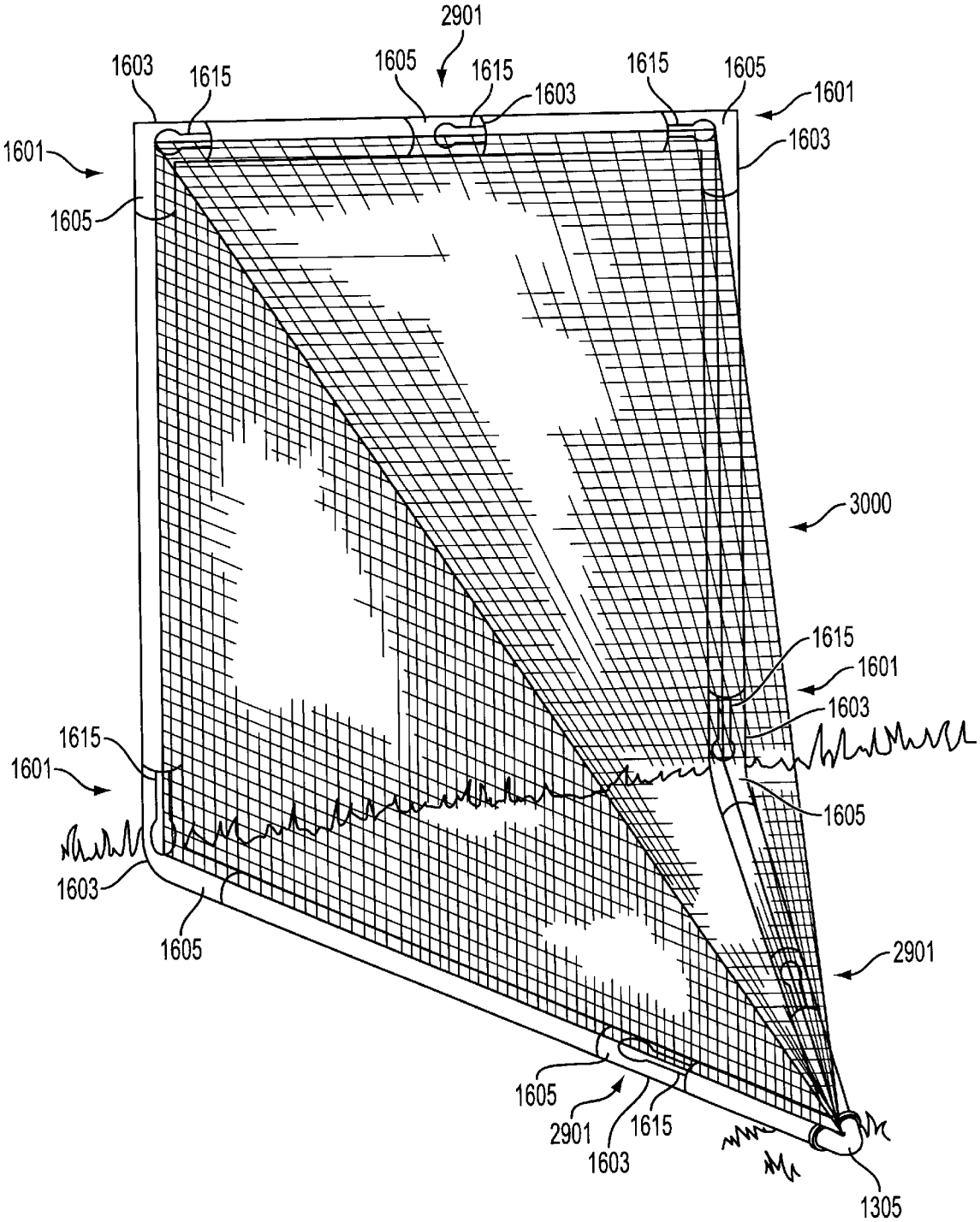
FIG. 30 illustrates a game goal with four right angle joints, a straight joint incorporated in the crossbar, a straight joint incorporated in each ground member and a point joint, in an erect position.
Figure 30A:
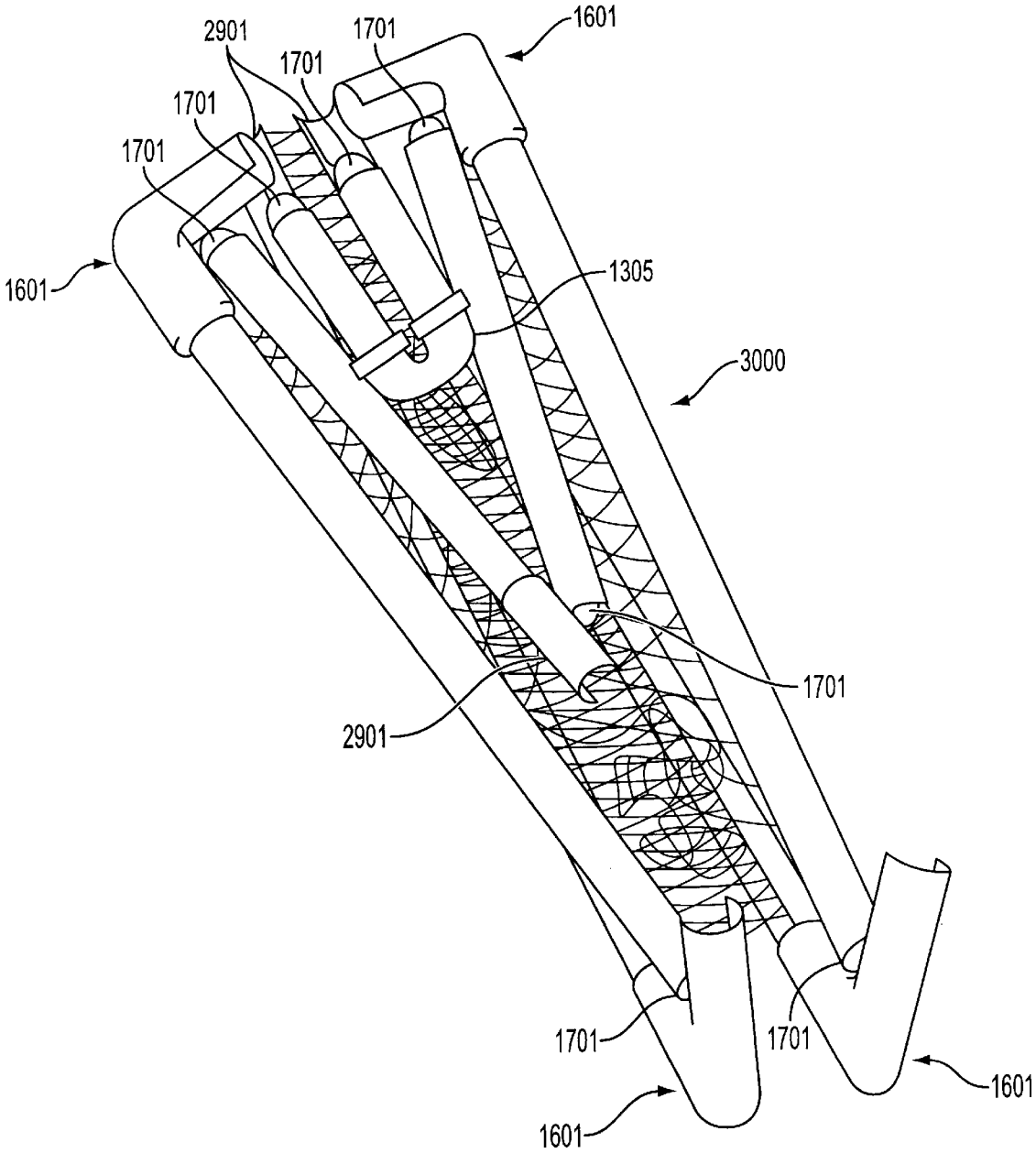
FIG. 30*a* illustrates the game goal of FIG. 30 in the folded position.

FIG. 30 illustrates a game goal 3000 in an assembled or erected position with various types of joints incorporated therein. Game goal 3000 has a straight joint 2901 incorporated in each ground member. The goal shown in FIG. 30 uses several corner shells 1601 with socket portion 1603 and attachable portion 1605 and frame members attached thereto. Each socket mouth portions 1615 face a direction that facilitates erection and collapsing of the goal by orienting the socket mouth 1615 at desired positions relative to the attachable portion 1605. The goal 3000 in FIG. 30 also incorporates a straight joint 2901, in the crossbar and in each ground member, having socket portions 1603 and attachable portions 1605 in a 180 degree relationship to each other. The particular game goal 3000 in FIG. 30 also incorporates a point joint 1305, as previously discussed herein. The portable game goals in FIGS. 30, 30*a*, 31 and 31*a* are, in terms of mobility, single unit structures comprising of a loosely bound assembly of components, which in normal operation are not detachable. In the preferred embodiment of a lacrosse goal frame, the straight joint incorporated in the crossbar has a mouth 1615 facing the point joint in the erect position. FIG. 30*a* shows the game goal of FIG. 30, having a straight joint 2901 in the crossbar and in each ground member, in the collapsed position. The flexible and twistable members 1701 used within the shells 1601 and 2901 work together with point joint 1305 to facilitate the degrees of motion necessary to collapse the goal into the desired form shown in FIG. 30*a*. As a result, a large goal such as that shown in FIG. 30 can be collapsed to a conveniently portable form, such as that shown in FIG. 30*a*. Of course, the use of shells as disclosed herein can be extended to structures other than game goals. Thus, a game goal or other structure can be formed to permit arrangement thereof in an erect or collapsed configuration using a plurality of links and frame members. In the collapsed position there exists a loosely bound assembly, which can be folded, positioned or collapsed such that the frame members can be arranged substantially parallel to each other or in the same plane, as shown in FIG. 30*a* for ease of transport and storage. Moreover, in a game goal having a net, the net need not be removed when the structure is collapsed. Specifically, a net attached to the interior edges of the frame members would not be stretched, ripped or bound by the folding of the frame. Therefore, the net can be attached permanently or for removal, even though net removal is not required to collapse the goal.

Figure 31:
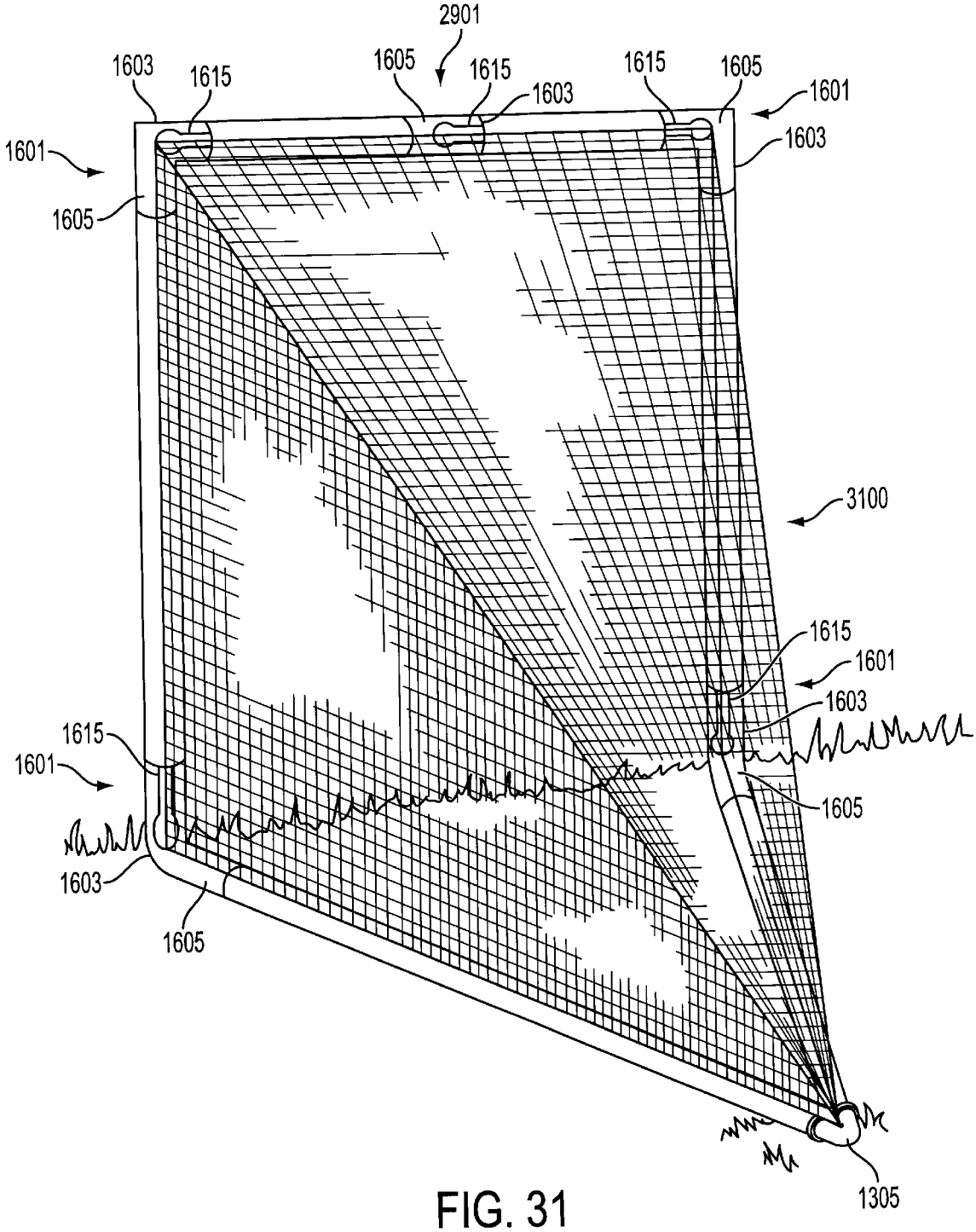
FIG. 31 illustrates a game goal with four right angle joints, a straight joint incorporated in the crossbar and a point joint, in an erect position.

FIG. 31 illustrates another example configuration of a game goal 3100 in an assembled or erected position with various types of joints incorporated therein. Game goal 3100 has one straight joint 2901 incorporated in the crossbar and no straight joints in the ground members. The goal shown in FIG. 31 uses several corner shells 1601 with socket portion 1603 and attachable portion 1605 and frame members attached thereto. Each socket mouth 1615 faces a direction that facilitates erection and collapsing of the goal by orienting the socket mouth at a desired position relative to the attachable portion 1605. The goal 3100 in FIG. 31 incorporates a straight joint 2901, in the crossbar, having socket portions 1603 and attachable portions 1605 in a 180 degree relationship to each other. The particular game goal 3100 in FIG. 31 also incorporates a point joint 1305, as previously discussed herein. In the preferred embodiment of a lacrosse goal frame, the straight joint incorporated in the crossbar has a mouth 1615 facing the point joint in the erect position. As previously noted, the only difference between collapsible game goal 3000 and 3100 is that game goal 3000 has a straight joint incorporated in each ground member for additional collapsing of the frame. It will be known to those of ordinary that straight joints may be positioned any where within straight members to facilitate the desired collapsing or folding.

Figure 31A:
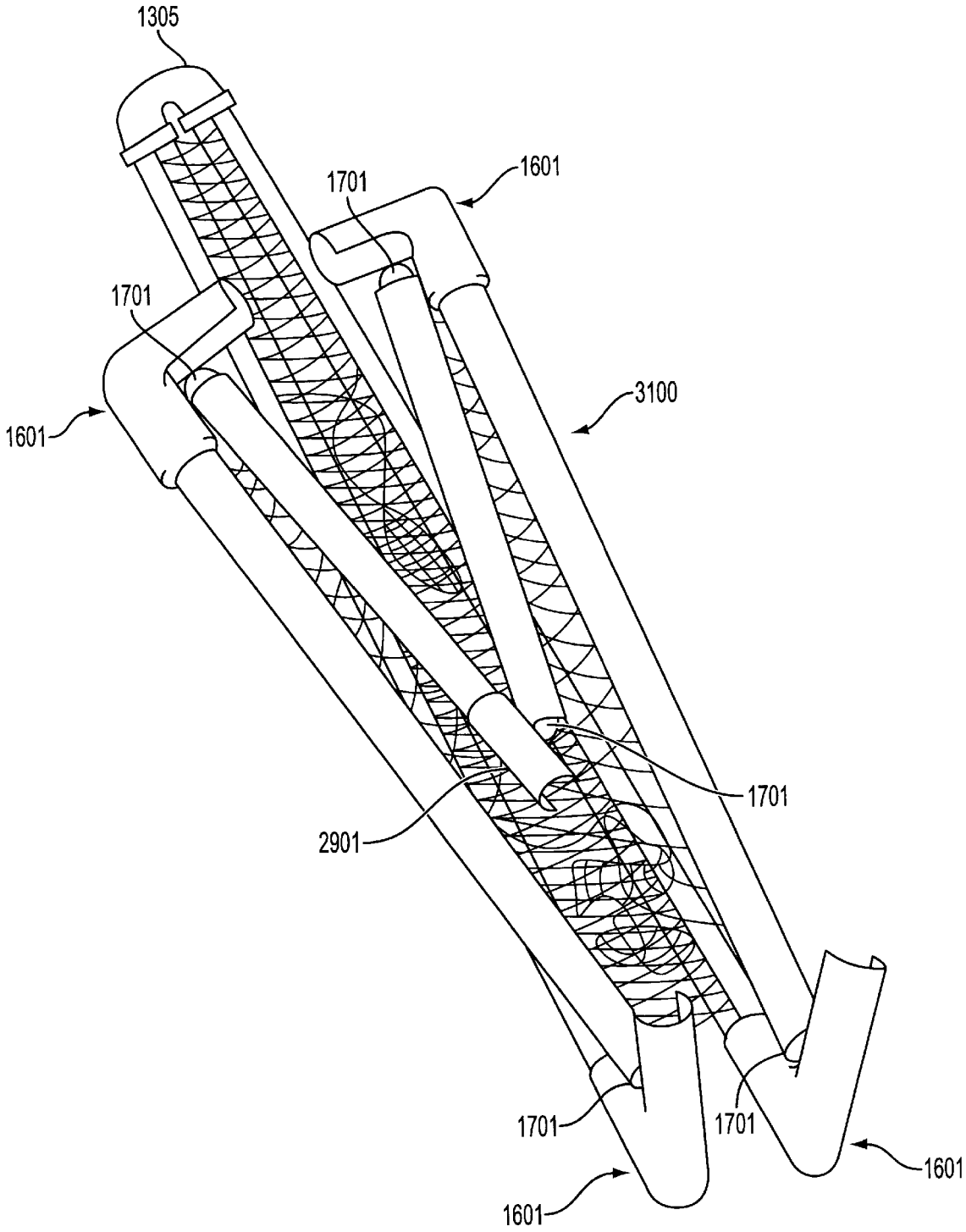
FIG. 31*a* illustrates the game goal of FIG. 31 in the folded position.

FIG. 31*a* shows the game goal of FIG. 31, having only one straight joint, located in the crossbar, in the collapsed position. The flexible and twistable members 1701 used within the shells 1601 and 2901 work together with point joint 1305 to facilitate the degrees of motion necessary to collapse the goal into the desired form shown in FIG. 31*a*. As a result, a large goal such as that shown in FIG. 31 can be collapsed to a conveniently portable form, such as that shown in FIG. 31*a*. In the collapsed position there exists a loosely bound assembly, which can be folded, positioned or collapsed such that the frame members can be arranged substantially parallel to each other or in the same plane, as shown in FIG. 31*a*, for ease of transport and storage.

While the figures herein illustrate shells for forming straight links and corner links, it is within the scope of the invention to form shells having socket portions and attachable portions in any angular relationship to one another. It is also within the scope of the invention that shells may have mouths facing any direction, and may have one or more socket portions in any angle in relationship to one another or the stationary member. It should be noted that any combination of socket shells or tethering mechanisms may be used in conjunction with each other, for any given joint.

Figure 32:
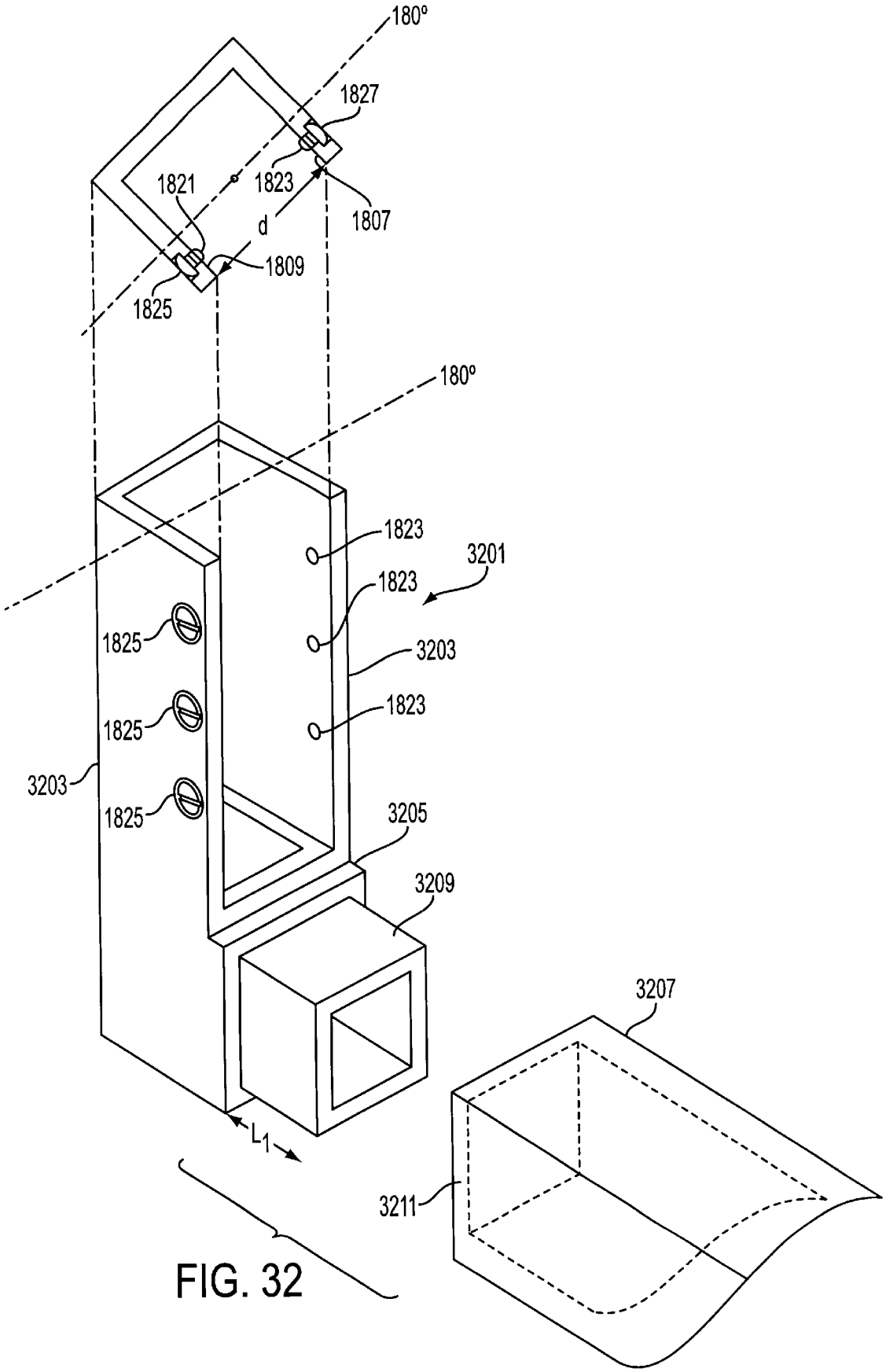
FIG. 32 illustrates a single socket right angle joint shell having a different form to accommodate a member having corners therein.

In some applications, frame members forming a structure may not be in a tubular shape. To accommodate virtually any shape frame member, a shell according to the invention can be configured in the shape corresponding to the shape of the frame member. FIG. 32 illustrates one such shell. In FIG. 32, the shell is configured in a form to accommodate a frame member having corners thereon. Shell 3201 has a socket portion 3203 and an attachable portion 3205. The walls of the socket portion 3203 and the shape of attachable portion 3205 have sharp edges to accommodate members with corners, such as frame member 3207. Shell 3201 can also have guide portion 3209 having a length $L_1$ and dimensions which allow to fit within the confines of the inner dimensions of member 3207 as defined by thickness 3211. A flexible member would be tethered into the lower interior portion of shell 3203 for connection to another frame member which moves in and out of socket portion 3203. As previously described with respect to the tubular shaped shell 1601, protrusions 1821 and 1823 are used to achieve a snap fit with the member being inserted. These can be formed with bolts 1825 an 1827 or by some other means. It is worth noting that formation of a shell of this type may offer manufacturing advantages over the tubular shells since the distance d between walls 1807 and 1809 is constant throughout the depth of the socket portion 3201. A cap having an interior with a shape corresponding to the shape of the frame member and the extension of the shell could be used to further secure the frame member in the erect position, as previously disclosed in the case of the tubular shell of FIGS. 18 and 19. Since sharp edges exist on the exterior of shell 3201, it is not necessary to incorporate slot 1832 into the shell. It may also not be necessary to incorporate a protrusion in the interior of the cap, to achieve a secure fit for the cap or a closed locking mechanism (not shown). It would be known to those of ordinary skill that a shell can be formed to accommodate any shaped structural frame member. For example, the shell can be octagonal, hexagonal, triangular or any other shape depending on the shape of the frame member to be inserted therein.

Figure 33B:
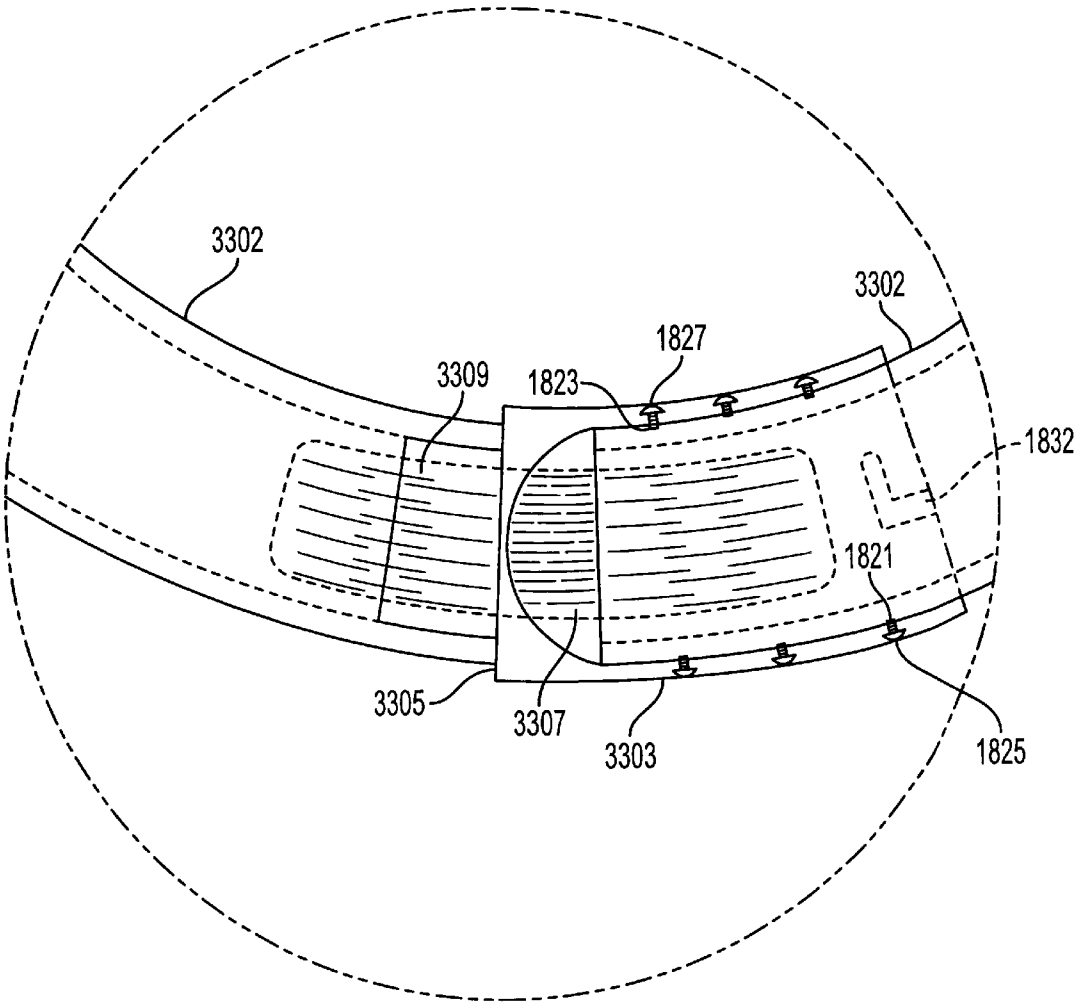
FIGS. 33*a* and 33*b* illustrate a joint having a single socket, straight shell which accommodates a frame member having a curvature along its length.
Figure 33A:
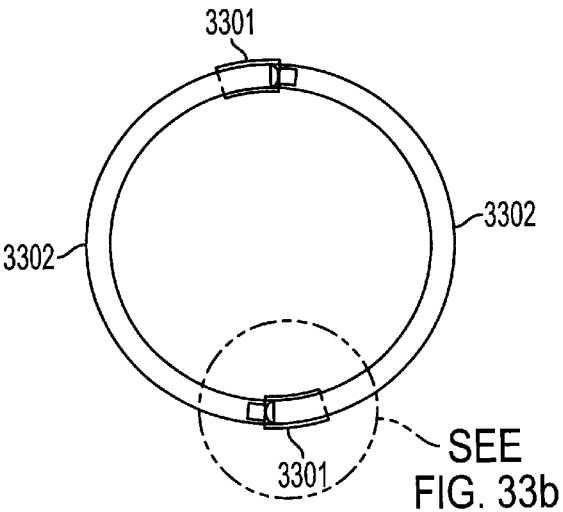

FIGS. 33*a* and 33*b* illustrate still another embodiment of the invention in which a shell has a curvature to accommodate any shaped frame member which is curved along its length. Joints 3301 are shown joining curved frame members 3302. Joint 3301 is shown in exploded view having a shell with a socket portion 3303 and an attachable portion 3305. Flexible member 3307 is connectable to the interior of socket portion 3303 and to frame member 3302 so that the frame member 3202 can be moved in and out of socket portion 3303. Attachable portion 3305 can be formed with guide member 3303 to facilitate connection to another frame member 3302. Socket portion 3303 could be integrated with member 3202, which would eliminated the need for guided portion 3309. Attachable portion 3305 and guide portion 3309 can be formed in any of the configurations previously disclosed herein, for example, as discussed with respect to the configuration shown in FIG. 16. The socket portion can be formed with protrusions 1821 and 1823, for example, using bolts 1825 and 1827 countersunk into sidewalls of the socket portion, as previously disclosed herein. Similarly, the wall opposite the mouth of the socket can be formed with slot 1832 to provide a secure fit with a cap (not shown), as previously discussed. As also previously discussed, slot 1832 may not be needed where the frame member has edges. Link 3301 can be formed with the shell having any particular shaped member having a curvature along its length. For example, frame member 3302 can be triangular, octagonal, hexagonal, or any other shape and shell 3301 can be formed having a socket portion 3303 which shape inversely matches that of the frame member.

It will be known to those of ordinary skill that different arms of a joint can have different shapes to accommodate frame members connecting thereto. For example, the attachable portion in FIG. 32 or FIGS. 33*a* and 33*b* could be formed to accommodate a tubular frame member while the socket portion is formed to accommodate a frame member having edges. Any other such combination can also be used. An advantage of the invention is that a shell can be formed to accommodate any combination of shapes of frame members, since the socket portion and attachable portion need not be the same. The flexible, twistable member allows a frame member of any shape to be accommodated in a corresponding socket portion, while the remaining socket and attachable portions may have different shapes and may face in any direction.

Figure 34:
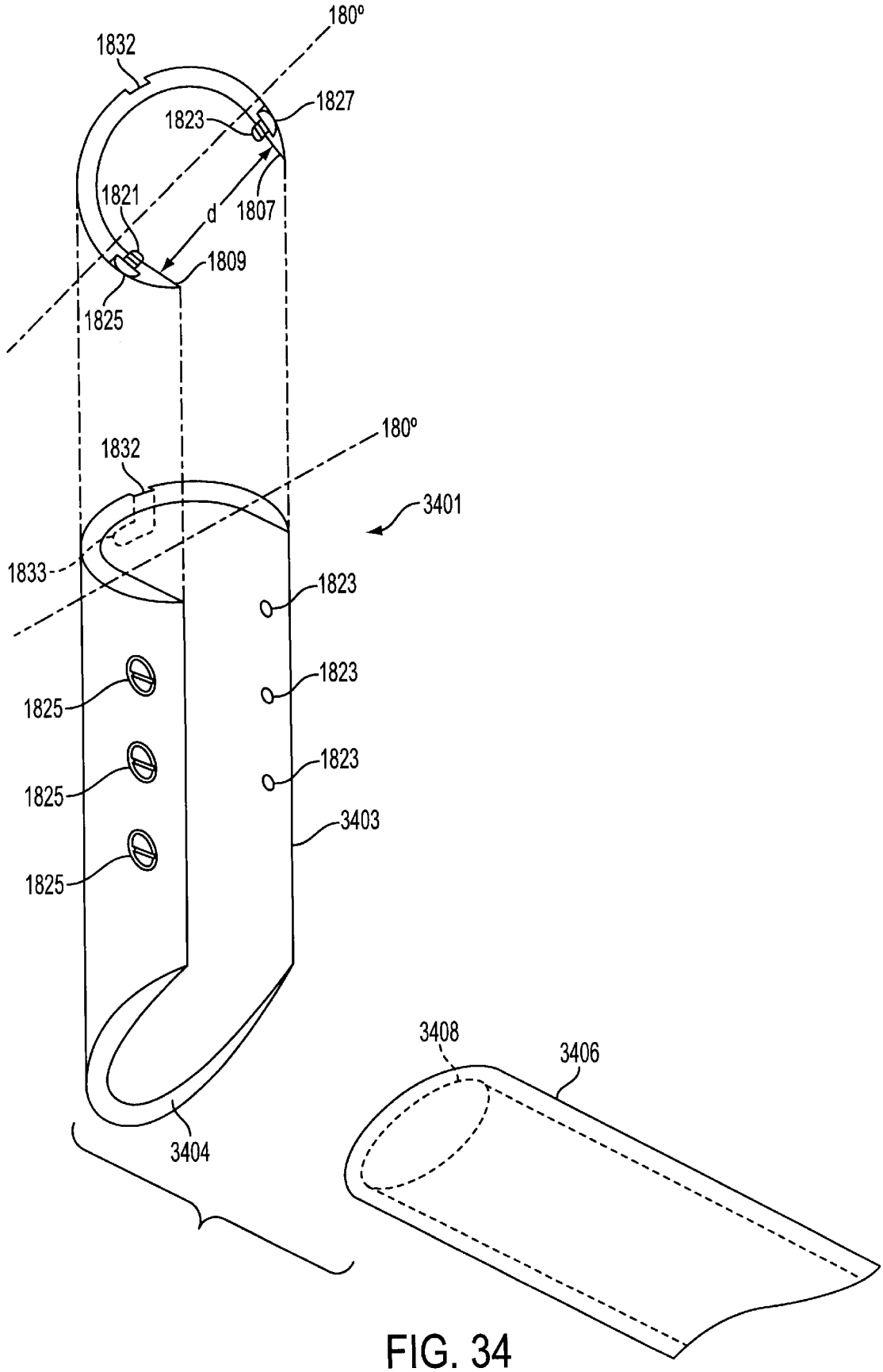
FIG. 34 illustrates the preferred embodiment of a single socket, right angle shell where the portion to be attached to the stationary member is a beveled edge which is formed at a desired angle or is integrated with the stationary member at the desired angle.

The preferred embodiment of a right angle joint is detailed in FIG. 34. This is the preferred embodiment because it is easily and inexpensively manufactured. The shell in FIG. 34 can be easily fabricated with standard machine shop saws instead of die cast molding, sand cast molding or plastic injection molding, which are processes necessary to form elbow shaped shells or shells with guided portions. FIG. 34 illustrates a shell of an alternative joint where the portion of the shell to be attached to a stationary member is formed without a guided portion. The attachable portion 3404 is formed at a desired angle which complements the angle of end 3408 of the stationary member, the summation of angles equal the shells desired angle in relationship to the stationary member. The socket portion 3403 of the shell could be integrated with the stationary member at the desired angle. Shell 3401 has socket portion 3403 and an attachable portion 3404. Attachable portion 3404 is an edge of the shell which is intended to be affixed to a stationary member. The attachable portion 3404 is cut or manufactured at an angle so as to form a fixed relationship with a member 3406. An end portion 3408 of member 3406 is cut at an angle to complement the angle of attachable portion 3404, (when affixed) the summation of which forms the desired angle between stationary member 3406 and the socket portion 3403 of shell 3401. As shown in FIG. 34, member 3406 is a separate element which is fastened to attachable portion 3404. However, it will be known to those of ordinary skill that socket portion 3403 and member 3406 can be formed as one integrated assembly in order to avoid the need for fastening frame member 3406 to attachable portion 3404, for example, by soldering, welding, braising, or gluing.

Figure 34A:
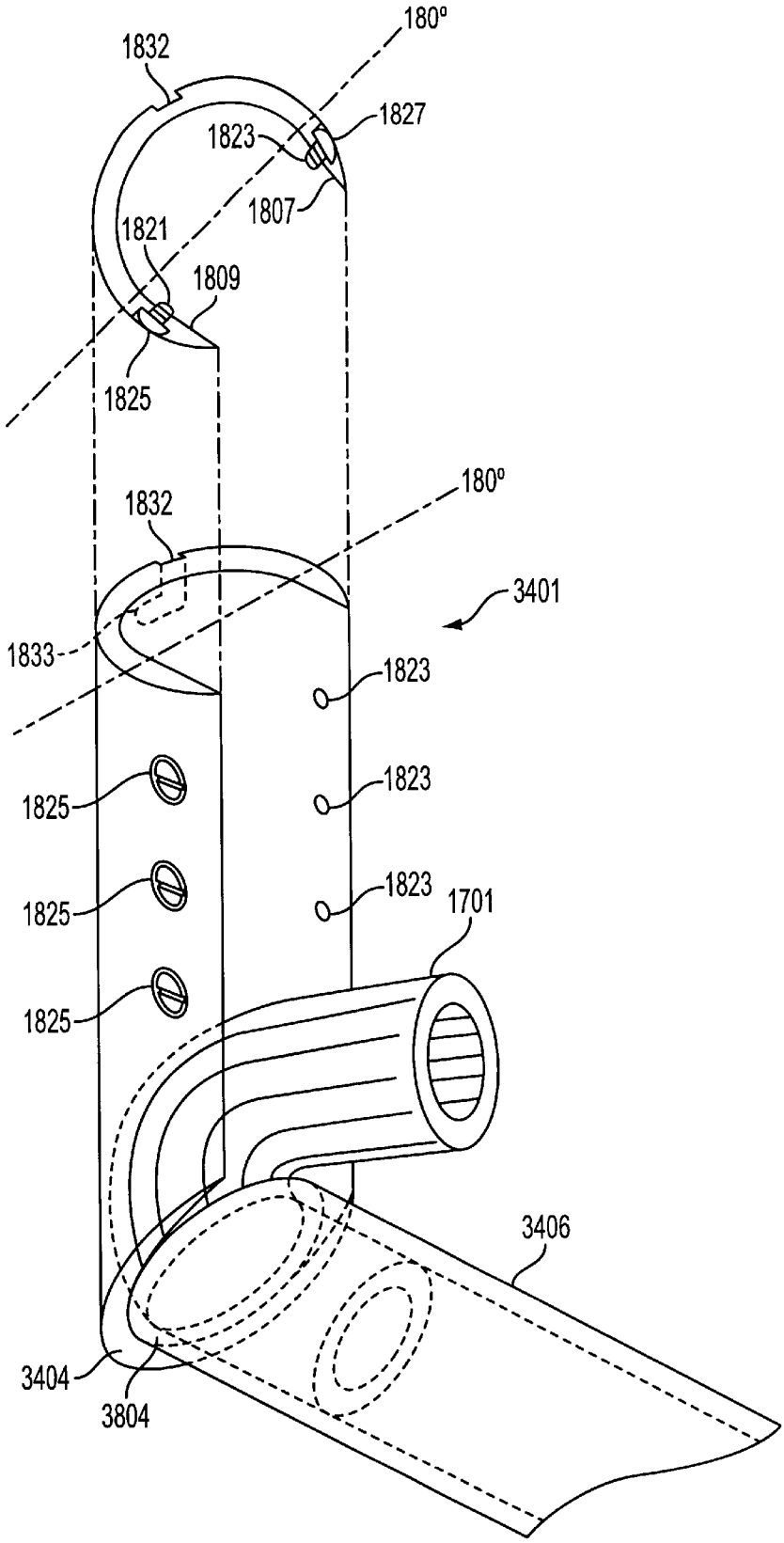
FIG. 34*a* illustrates the preferred embodiment of a single socket, right angle shell attached to the stationary member, with the flexible member shown therein.

FIG. 34*a* shows FIG. 34 with shell 3401 attached to member 3406 and with flexible member 1701 inserted. It is important to note, that because shell 3401 does not have a guided portion the flexible member is attached to the inside of stationary member 3406 directly. This is the preferred embodiment.

The remaining elements, including the protrusions and slots, as previously discussed can be incorporated into the shell so that a flexible member can be inserted into the shell to accommodate insertion and removal of a frame member into the socket portion, as previously discussed herein. The frame member and shell can also have any shape or combination of shapes as previously discussed herein. The socket portions can also be fixed at any angle, in relationship to the stationary member as previously discussed herein.

Figure 35:
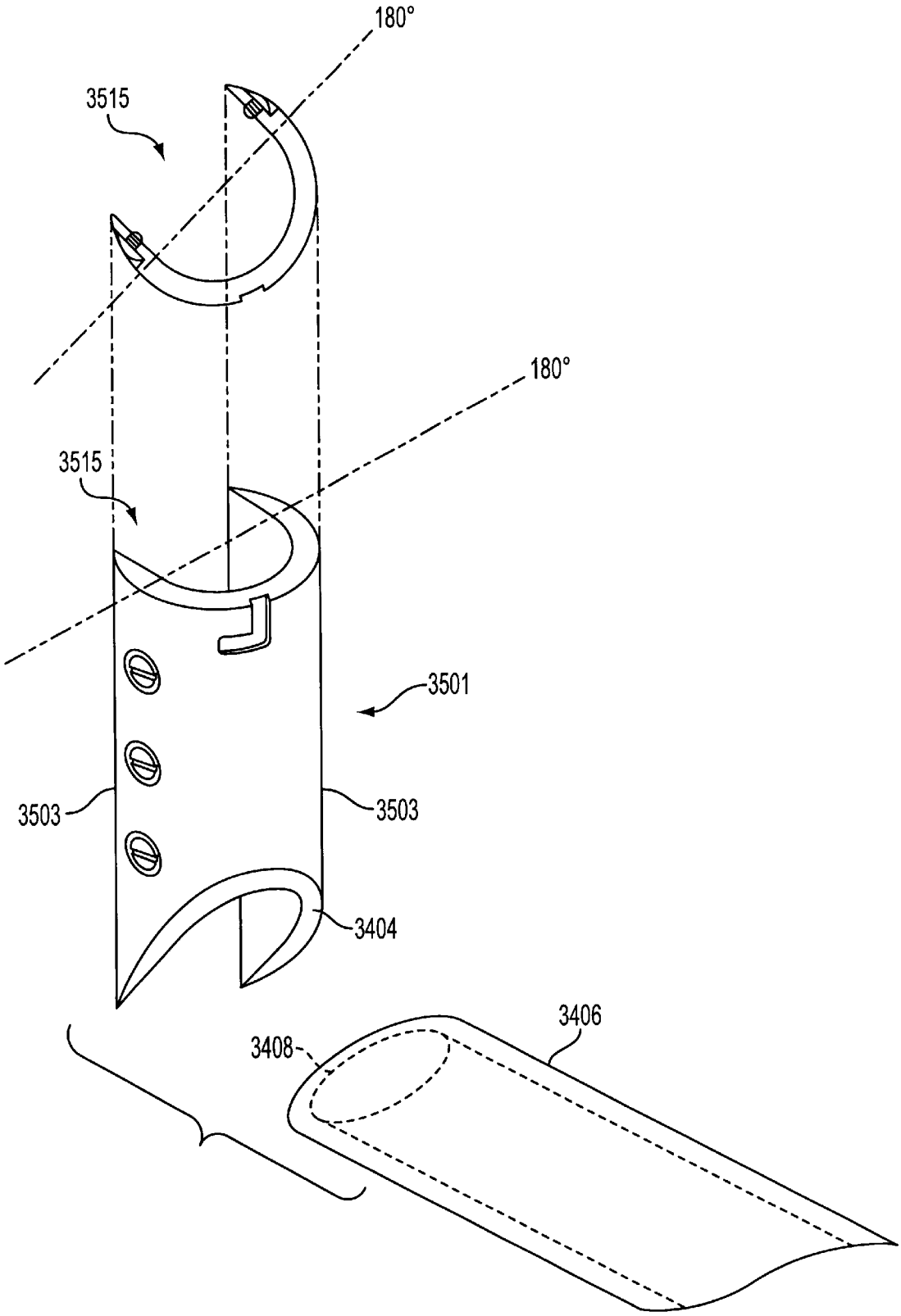
FIG. 35 illustrates the shell shown in FIG. 34 with the mouth of the socket portion facing another direction.

FIG. 35 illustrates another configuration, of the joints shown in FIG. 34. In this case, shell 3501 is shown with socket portion 3503 having a mouth 3515 facing in the direction opposite the attachable portion 3504 of the shell 3501. Shell 3501 at attachable portion 3404 is to be connected to frame member 3406 in a fixed manner at edge 3408. It will be known to those of ordinary skill that, as previously discussed herein, the mouth of the socket portion of the shell forming the link or joint between frame members can be arranged to face any direction and that the angular relationship between the shell and the stationary frame member 3406 can be any angle desired. Thus, it is possible to form a link or joint having virtually any angular relationship between the socket portion an the stationary member. The mouth of the socket may face in any desired direction, depending on the needs of collapsing and erecting a structure.

Figure 36:
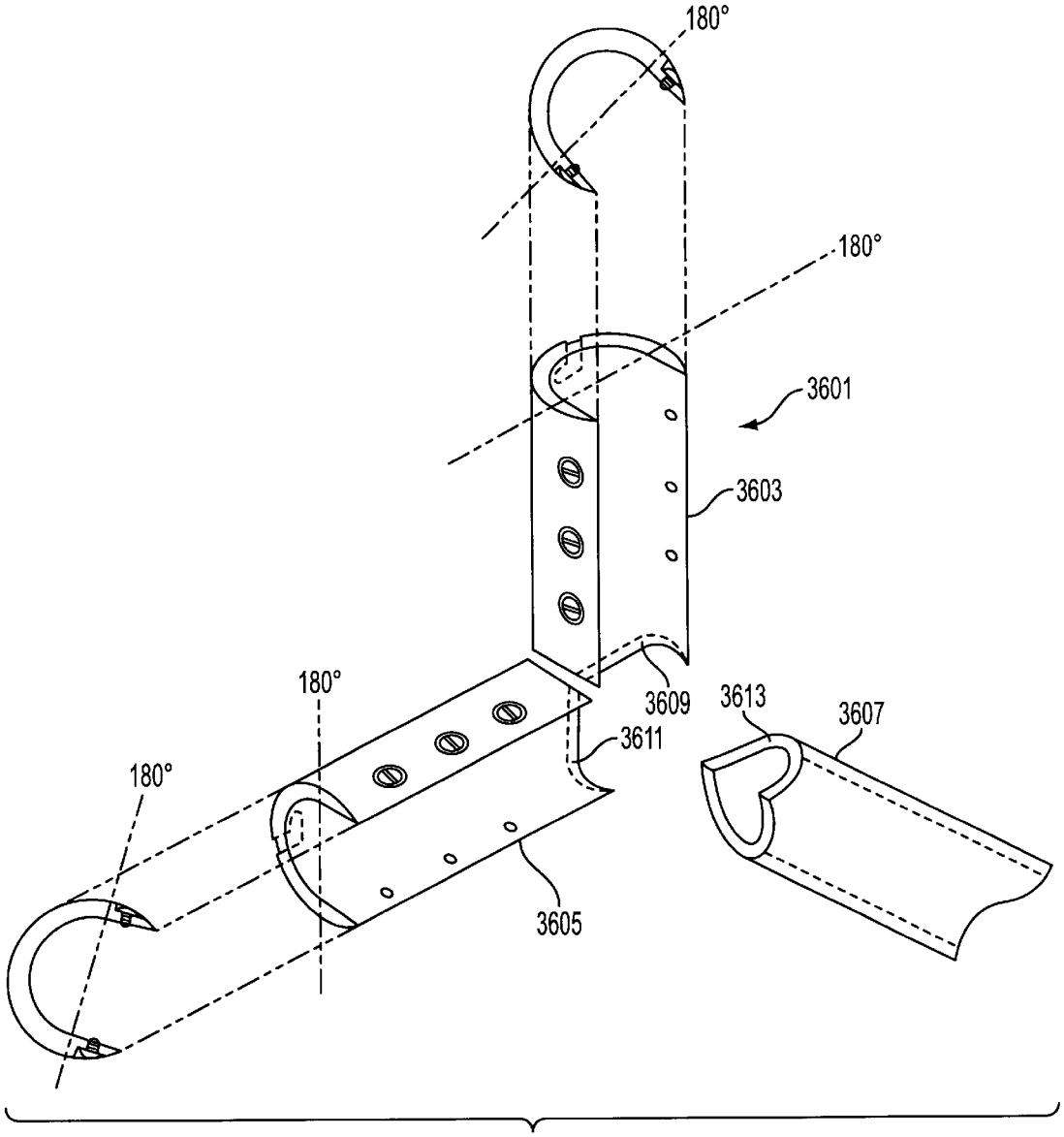
FIG. 36 illustrates a shell for a joint according to the invention having a plurality of socket portions each of which has a beveled edge portion intended to affix a stationary member and to each other, which provides connectivity for a plurality of members.

FIG. 36 shows an embodiment of the link or joint using shells or socket portions disclosed in FIGS. 34, and 35. FIG. 36 illustrates a joint with multiple socket portions which is useful where 3 members intersect, for example, joint 3807 in FIG. 38. FIG. 36 illustrates a shell with multiple socket portions whose attachable portions are angled edges intended to attach to each other and with the stationary member or integrated therewith at a desired angle. It will be known to those of ordinary skill that a link or joint can be formed to accommodate any number of socket portions fastening with one or more stationary members. The multiple socket link or joint 3601 in FIG. 36 has socket portions 3603 and 3605 which connect to stationary member 3607. Attachable portions 3609 and 3611, are cut in complementing angles with end 3613 to form a desired angular relationship with stationary member 3607. Stationary member 3607 can be fastened to the socket portions 3603 and 3605 by welding, soldering, braising, gluing or any other method now known or later developed. Further, member 3607 can be integrally formed with socket portions 3603 and 3605 to eliminate the need for fastening. A flexible, twistable member is used with each of the socket portions 3603 and 3605 so that frame members can be moved into the socket portions to an erected position and moved out of the socket portions and placed in a collapsed position. As previously discussed, the flexible member should be twistable to allow compound angular mobility relative to the stationary member, such as member 3607. Socket portions 3603 and 3605 can be equipped with locking slots and protrusions as previously disclosed herein.

The joints or links disclosed herein can be used with virtually any kind of structure which has an erected and a collapsed position. When erected, for example, a pair of frame members define a plane in three dimensional space. When collapsed the member attached to the flexible link may move in any relation to that plane, not merely up and down when the flexible link is twistable. This provides compound angular mobility of the moveable member which facilitates collapsing of any structure.

Figure 37:
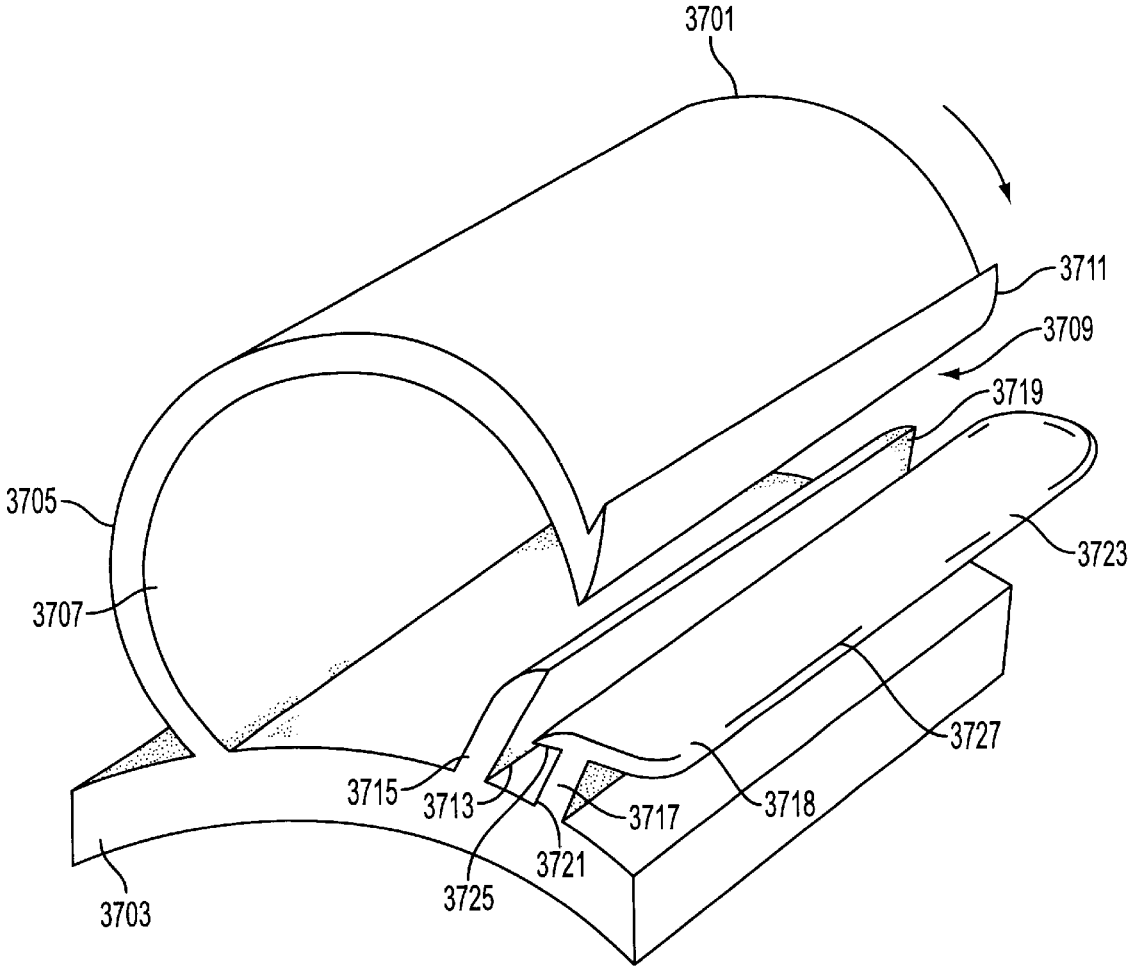
FIG. 37 illustrates a device for permanently securing a net to the frame, under normal operations and provides easy removal of the net when it requires replacement or rips.

One structure in which links according to the invention are useful is a game goal, such as a lacrosse goal or a street hockey goal. A net attached at various places to the frame members is a feature of many such game goals. FIG. 37 illustrates a device which can be attached to a frame member or integrated into a frame member in order to facilitate easy removal and attachment of a net. Net fastener 3701 has a curved base 3703, which may be fastened to or integrated with a frame member. While base 3703 is shown having a curvature, for example to attach to or be integrated with a tubular frame member, it will be known to those of ordinary skill that base portion 3703 can be formed in any shape to accommodate the shape of the frame member. For example, base 3703 can have a square or rectangular shape, or a shape to accommodate a hexagonal or octagonal or triangular frame member. Base 3703 can be attached to the frame member using glue or screws or rivets or any other suitable attachment means. A rounded portion 3705 emerges from base 3703 and curves back on its self thereby forming a tunnel-like portion 3707. When being used to secure an item such as a net, a portion of the net or other item is passed through opening 3709 so that the portion of the net is placed inside tunnel portion 3707. One end of curved member 3705 has a lip 3711. Lip 3711 protrudes above the curved diameter of curved portion 3705. Rounded portion 3705 is made of a flexible material and flexes under externally applied pressure so that lip 3711 snaps into slot 3713. Slot 3713 is formed by back portion 3715 which extends upward from the base 3703 and by support portion 3717 of engagement member 3718. Back portion 3715 has a flat or curved wall 3719 at a predetermined distance from wall 3721 of support portion 3717. Support portion 3717 has formed thereon a top portion 3723. A rear portion 3725 of top portion 3723 snaps over lip 3711 when the lip is inserted into slot 3713. This secures the curved portion 3705 in an engaged position whereby the net is held in tunnel 3707. When external pressure is applied to an opposite end 3727 of top portion 3723, rear portion 3725 is lifted thereby resulting in disengagement of lip 3711 from slot 3713. When disengaged, a net or other item can be removed through space 3709 from tunnel 3707. While devices such as that shown in FIG. 37 have been employed to secure wires on flat surfaces, according to the present invention, curved base 3703 provides the ability to connect a net to a rounded surface, such as a round frame member of a game goal so that the net can be easily attached and removed for replacement, if the net rips. This type of net fastening mechanism would hold the net in a stationary position on the frame structure, whether it be erect or collapsed, in normal operation.

FIG. 38 illustrates an alternative game goal configuration that can be formed using joints according to the invention. FIG. 38 illustrates a game goal 3801 with multiple socket portion joints at corners 3803, 3805, 3807, 3809, 3811, and 3813. The game goal shown in FIG. 38 also has single socket right angle joints at corners 3815 and 3817. The game goal 3801 incorporates straight joints at locations 3819, 3821, and 3823. Each of the joints at the various locations can be formed with socket and attachable portions to allow the goal to collapse in any desired fashion. Thus, according to the invention, a game goal can be constructed with a net, frame members, and a plurality of joints having socket and attachable portions as disclosed herein. The net could be attached using the U-shaped terminating points or the device for securing a net to the frame shown in FIG. 37. Of course, other net fastening devices can also be employed. It will be known to those of ordinary skill that straight joints may be incorporated in the frame structure in any location desired, to facilitate collapsing.

A game goal can be defined as any structure with an opening formed by two uprights and a crossbar. The crossbar is connected to the uprights at their top ends. This arrangement is in a single plane. A frame structure, consisting of frame members, is formed in the three dimensions, for the purposes of forming a concave net configuration. This concave frame structure may be box shaped (e.g. as in a conventional street hockey or water polo goal) or it may be pyramid shaped (e.g. as in a conventional lacrosse goal). In both applications the frame structure extends backwards, in the third dimension in relationship to the goal opening.

Figure 39A:
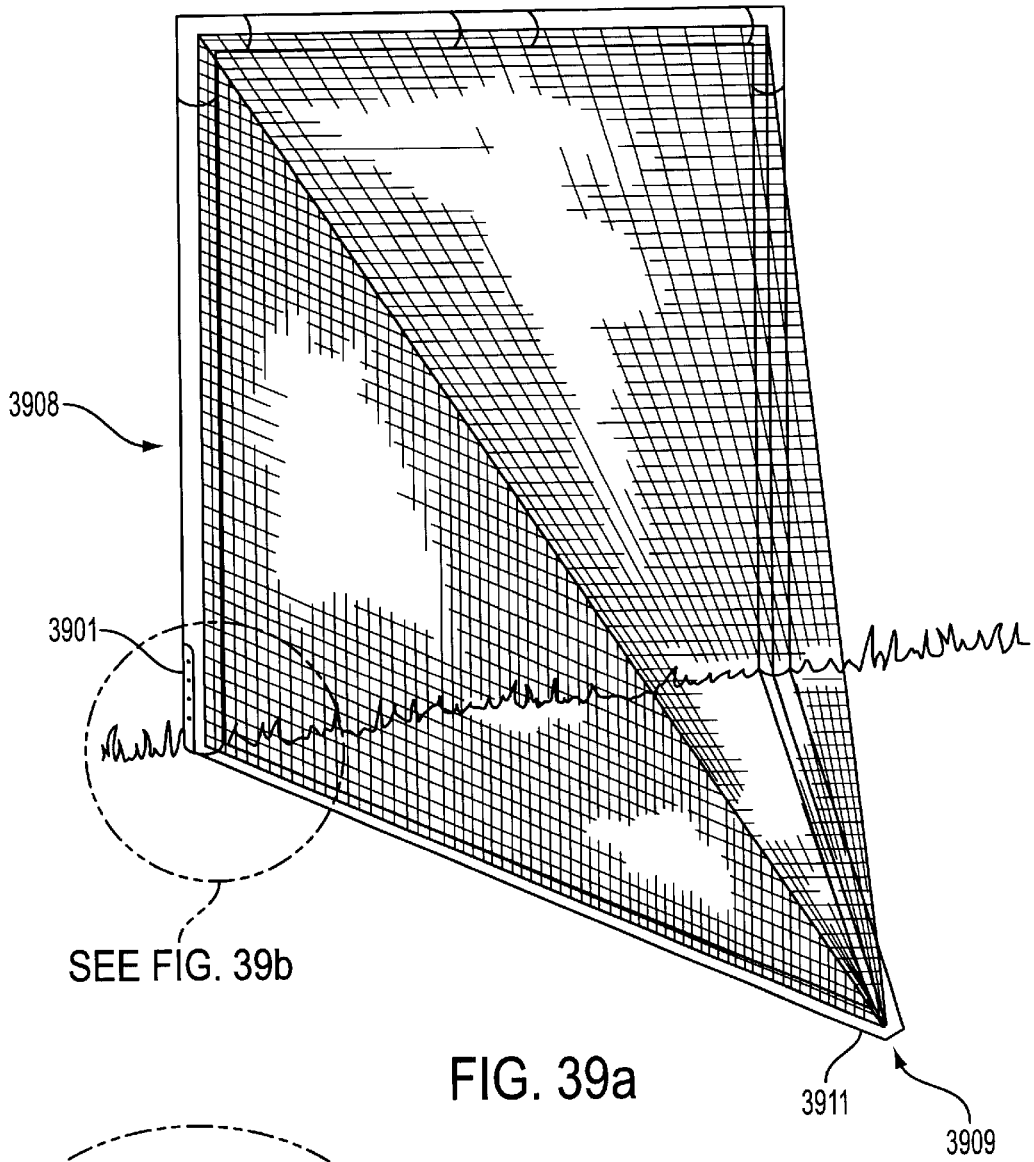
FIGS. 39*a* and 39*b* illustrate a game goal having a joint with a single socket shell portion which is attached to a flat stationary member.
Figure 39B:
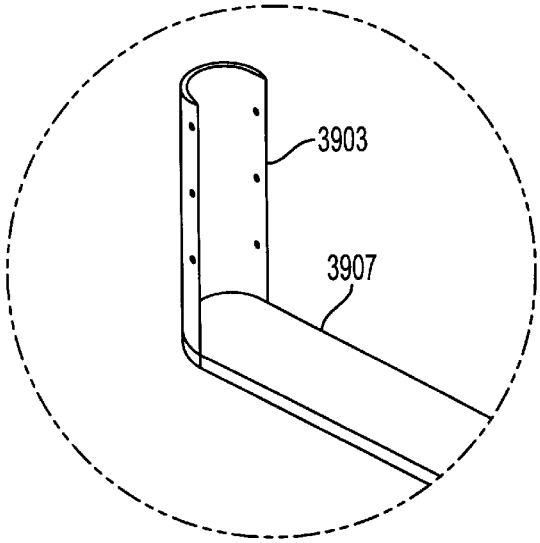

FIGS. 39*a* and 39*b* illustrate still another variation of a link according to the invention for use in applications where a flat frame member is employed. One such application is a National Collegiate Athletic Association specification compliant lacrosse goal. FIGS. 39*a* and 39*b* show joint 3901 having a shell with socket portion 3903 integrated with flat stationary member 3907. Member 3908, when tethered to the flat stationary member by a flexible link, moves in and out of socket portion 3903 using a flexible member (not shown) as previously disclosed herein. It should be noted that in joint 3901, there is no interior portion to attach the flexible link to because socket portion 3903 and flat stationary member 3907 do not have an inside portion. Therefore the flexible member (not shown) can be attached to the flat stationary member 3907 by simply drilling a small hole through both and fastening with a nut and bolt, or any other conventional fastening device or means, including rivets, glue, etc. Point joint 3909 also has a flat bottom 3911.

While several embodiments of the invention have been described, it will be understood that it is capable of further modifications. For example, the goals described herein use a net as the means for receiving a projectile. It should be understood that a net is used to allow spectators an unobstructed view of the game. Alternatively a solid cloth could be used in place of the net. Such a cloth could be clear, opaque or any combination thereof, similarly, a projectile receiving means could be made of portions of a solid cloth or any other composition approximating the functionality of a net or webbing. Thus, this application is intended to cover any variations, uses, or adaptations of the invention, following in general the principles of the invention and including such departures from the present disclosure as to come within knowledge or customary practice in the art to which the invention pertains, and as may be applied to the essential features herein before set forth and falling within the scope of the invention or the limits of the appended claims.

What is claimed is:

1. A link adapted to join a pair of members having a curvature and an outside diameter, said link comprising:

a shell having a non-resilient socket portion and an attachable portion thereon;

a flexible member fixedly attached to said shell proximate to said attachable portion, said flexible member being adapted to attach to a first one of the pair of members and adapted to angularly move the first one of the pair of members into an interior of and out of said socket portion, wherein the interior of said socket portion has a rounded portion which substantially matches the curvature and outside diameter of the first one of the pair of members.

2. A link as recited in claim 1, said attachable portion adapted for attachment to a second one of the pair of members.

3. A link as recited in claim 1, said flexible member being twistable.

4. A link as recited in claim 3, said flexible member having compound angular mobility.

5. A link as recited in claim 1, said shell being substantially straight, said socket portion and said attachable portion being at opposite ends of said shell.

6. A link as recited in claim 5, said flexible member being twistable.

7. A link as recited in claim 1, said socket portion and said attachable portion of said shell being in about 90° relation to each other.

8. A link as recited in claim 7, having a mouth in said socket portion, said flexible member being moveable into and out of said shell at said socket portion through said mouth, said mouth being located at any position around a circumference of said socket portion.

9. A link as recited in claim 7, said flexible member being twistable.

10. A link as recited in claim 1, said socket portion and said attachable portion being less than 90° apart from each other.

11. A link as recited in claim 10, having a mouth in said socket portion, said flexible member being moveable into and out of said shell at said socket portion through said mouth, said mouth being located at any position around a circumference of said socket portion.

12. A link as recited in claim 10, said flexible member being twistable.

13. A link as recited in claim 1, said socket portion and said attachable portion being greater than 90° apart from each other.

14. A link as recited in claim 13, having a mouth in said socket portion, said flexible member being moveable into and out of said shell at said socket portion through said mouth, said mouth being located at any position around a circumference of said socket portion.

15. A link as recited in claim 13, said flexible member being twistable.

16. A link as recited in claim 1, said link having an engaged position wherein a first member is positioned in said socket portion in a first relation to a second member, and a disengaged position wherein said first and second members are in a second relation different from said first relation.

17. A link as recited in claim 1, said socket portion having interior walls, at least a portion of said interior walls being spaced apart by a constant spacing for a fixed distance into said socket portion.

18. A link as recited in claim 17, said interior walls having at least one protrusion, said protrusion extending from at least one of said walls into said mouth.

19. A link as recited in claim 1, said socket portion having a rear wall, said rear wall including a substantially L-shaped slot at a top portion thereof.

20. A link adapted to join a pair of members having a curvature and an outside diameter, said link comprising:

a shell having a non-resilient socket portion and an attachable portion thereon;

said socket portion having a mouth in a circumference thereof, a position of said mouth defining an angular dislocating direction adapted to receive a first one of the pair of members, said socket portion having means to provide a resistance force for a snap fit with the first one of the pair of members, wherein the interior of said socket portion has a rounded portion which substantially matches the curvature and outside diameter of the first one of the pair of members.

21. A link as recited in claim 20, said socket portion and said attachable portion being in a fixed relation.

22. A link as recited in claim 21, further comprising a flexible member fixedly attached to said shell proximate to said attachable portion, said flexible member attached to the first one of the pair of members for angularly moving the first one of the pair of members in and out of said socket portion.

23. A link as recited in claim 22, said flexible member being attached to the first one of the pair of members to provide the first one of the pair of members with compound angular mobility.

24. A link as recited in claim 22, said flexible member being twistable.

25. A link as recited in claim 22, said flexible link being attachable to the first one of said pair of members to position the first one of said pair of members in a desired relation to [another] a second one of said pair of members in a disengaged position.

26. A link as recited in claim 25, wherein when positioned in said desired relation in said disengaged position the first one and the second one of said pair of members collapse onto each other.

27. A link as recited in claim 25, wherein when positioned in said desired relation in said disengaged position the first one and the second one of said pair of members collapse offset from each other.

28. A link as recited in claim 25, wherein in said disengaged position the second one of said pair of members attached to said flexible member collapses to a position in a rotated relation to a position of the first one of said pair of members in said engaged position.

29. A link as recited in claim 22, the first one of said pair of members being tethered to said link by said flexible member.

30. A foldable structure comprising:

a plurality of frame members;

a link joining at least two of said frame members having a curvature and an outside diameter, said link having:

a socket portion;

an associated flexible member adjustable in position relative to said socket portion; and an attachable portion, wherein one of said plurality of frame members is connected to said attachable portion, another frame member of said plurality of frame members is connected to said flexible member, said another frame member being angularly insertable into an interior of said socket portion to at least partially establish an erect position of said structure and angularly removable from said socket portion to at least partially establish a folded position of said structure, said socket portion providing a resistance force for a snap fit with said another frame member, and wherein the interior of said socket portion has a rounded portion which substantially matches the curvature and outside diameter of said another frame member.

31. The structure as recited in claim 30, said adjustable member being a flexible member attached to said link.

32. The structure as recited in claim 30, at least some of said plurality of said frame members being foldable into a configuration wherein said frame members are arranged substantially parallel to each other in a same plane.

33. The structure as recited in claim 32 comprising a game goal.

34. The structure as recited in claim 33 comprising a net.

35. The structure as recited in claim 34, said plurality of frame members comprising a crossbar, and two uprights, a portion of said net being attached to said crossbar and uprights.

* * * * *